US008287079B2

(12) United States Patent
Yamazaki

(10) Patent No.: US 8,287,079 B2
(45) **Date of Patent: *Oct. 16, 2012**

(54) LANDING POSITION DETERMINING METHOD AND DEVICE FOR PROCESSING-LIQUID EJECTION NOZZLES, AND INKJET RECORDING APPARATUS

(75) Inventor: Yoshirou Yamazaki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 698 days.

This patent is subject to a terminal disclaimer.

(21) Appl. No.: 12/413,156

(22) Filed: Mar. 27, 2009

(65) Prior Publication Data

US 2009/0244149 A1 Oct. 1, 2009

(30) Foreign Application Priority Data

Mar. 31, 2008 (JP) ..... 2008-094309
Mar. 31, 2008 (JP) ..... 2008-094337

(51) Int. Cl.
*B41J 29/393* (2006.01)
*B41J 29/38* (2006.01)

(52) U.S. Cl. ..... 347/19; 347/6; 347/9; 347/14

(58) Field of Classification Search ..... 347/6, 9, 347/14, 19
See application file for complete search history.

(56) References Cited

U.S. PATENT DOCUMENTS

| | | | | |
|---|---|---|---|---|
| 5,898,443 | A | 4/1999 | Yoshino et al. | |
| 6,371,609 | B1 | 4/2002 | Oikawa | |
| 6,471,348 | B1 * | 10/2002 | Koitabashi | 347/100 |
| 2002/0054198 | A1 * | 5/2002 | Saijo | 347/101 |
| 2007/0146410 | A1 * | 6/2007 | Kawakami et al. | 347/21 |

FOREIGN PATENT DOCUMENTS

| | | | |
|---|---|---|---|
| JP | 8-118616 | A | 5/1996 |
| JP | 11-198357 | A | 7/1999 |
| JP | 2001-138494 | A | 5/2001 |

* cited by examiner

*Primary Examiner* — Matthew Luu
*Assistant Examiner* — Jannelle M LeBron
(74) *Attorney, Agent, or Firm* — Birch, Stewart, Kolasch & Birch, LLP

(57) ABSTRACT

A landing position determining method for processing-liquid ejection nozzles comprises: setting a specified processing liquid deposited pattern; ejecting the processing liquid from the processing-liquid ejection nozzles onto a recording medium to form the processing liquid deposited pattern; depositing the colored ink from a plurality of ink nozzles onto the processing liquid deposited pattern, and recording a plurality of linear colored ink images to form a processing liquid landing position determination pattern on the recording medium; detecting presence/absence of a change in at least one of densities and line widths of the plurality of linear colored ink images in the processing liquid landing position determination pattern, and determining, from at least one of density distribution and line width distribution in a linear colored ink image in which the change is present, a landing position for the processing-liquid ejection nozzle selected as the landing position determination targets.

13 Claims, 25 Drawing Sheets

LANDING POSITION DETERMINING METHOD AND DEVICE FOR PROCESSING-LIQUID EJECTION NOZZLES, AND INKJET RECORDING APPARATUS

The entire contents of literature cited in this specification are incorporated herein by reference.

BACKGROUND OF THE INVENTION

The present invention relates to a landing position determining method and device for processing-liquid ejection nozzles, and more particularly, to a method and device for determining landing positions of the processing liquid ejected from processing-liquid ejection nozzles in an inkjet recording apparatus having nozzles that eject colorless and transparent processing liquid for agglomerating colored inks.

Conventionally, when an image is printed on a recording medium in an inkjet recording apparatus, there has been a case in which water resistance of a recorded image is insufficient depending on a type of the recording medium.

In particular, when a color image is recorded, if a large quantity of ink is ejected on a recording medium in an attempt to print a high-density image, feathering may be caused depending on penetration of the ink into the recording medium. On the other hand, if it is attempted to print a high-density image while suppressing the penetration, a blur may be caused among inks of different colors. In both the cases, an image quality in printing a color image is substantially deteriorated.

Therefore, in recent years, in order to improve water resistance of a printed image and obtain a high-quality image (print) in an inkjet recording apparatus, a method of using processing liquid is proposed.

The processing liquid has an action of agglomerating and fixing color materials of colored inks. Therefore, when such processing liquid is used in the inkjet recording apparatus, before the colored inks are deposited on the recording medium, the processing liquid is deposited on the recording medium and the colored inks are deposited on the processing liquid. This makes it possible to prevent feathering and a blur of the colored inks on the recording medium and obtain a high-quality image.

In this case, usually, the processing liquid is deposited over an image recording area (image wise) of the colored inks on the recording medium by an inkjet head.

In ejecting the processing liquid, if there is a nozzle that does not eject the processing liquid among nozzles of the inkjet head, an area on which the processing liquid is not deposited is formed on the recording medium.

Naturally, if the colored inks are deposited on the area on which the processing liquid is not deposited on the recording medium, fixing and agglomeration of the color materials of the colored inks is insufficient. Therefore, desired ink density and a desired dot diameter are not obtained and the image quality is deteriorated.

In particular, when the inkjet head has a line head configuration, if a non-ejecting nozzle is present, the processing liquid is not deposited on an area on a recorded image and an image quality in the area is deteriorated, and hence the area appears like a line (streak) and is extremely conspicuous.

As the processing liquid, colorless and transparent processing liquid is used in order to accurately control color density of a recorded image area on the recording medium. Therefore, although it is extremely difficult to detect whether or not the processing liquid is deposited on the recording medium, it is extremely important in maintaining a quality of a recorded image to detect whether or not the processing liquid is deposited on an area on which the ink is to be deposited (image recording area).

Therefore, conventionally, there is known a technology of detecting the colorless and transparent processing liquid by performing test print prior to formal print.

For example, JP 08-118616 A discloses a method of forming a line formed by depositing a colored ink one on top of processing liquid and a line formed by depositing only the colored ink, comparing densities, hues, blurs, and the like of those lines, and detecting a non-ejecting nozzle using a result of the comparison. JP 08-118616 A also discloses a method of, after depositing processing liquid on a recording medium to form a stepped line, depositing a colored ink (solid deposited) over the entire surface of the recording medium, calculating density, a color, and the like of a line on which the processing liquid and the ink overlap, and detecting a non-ejecting nozzle using the density, the color, and the like.

JP 11-198357 A discloses a method of depositing processing liquid on areas on which two colored inks are deposited adjacent to each other on a recording medium, determining whether or not landing positions of the colored inks and the processing liquid coincide with each other, and adjusting the landing position of the processing liquid.

JP 2001-138494 A discloses a method of performing print-alignment for processing liquid and an ink using an optical characteristic that changes according to density and a blur that relatively change.

However, in the method disclosed in JP 08-118616 A, although a nozzle that is not ejecting the processing liquid can be detected, a method of determining a landing position of the processing liquid such that landing positions of the processing liquid and the ink coincide with each other is not disclosed, and hence it is impossible to prevent deterioration in an image quality of a recorded image due to ink fixing failure caused by the shift of the landing positions of the processing liquid and the ink.

In the method disclosed in JP 11-198357 A, the landing position of the processing liquid can be adjusted by adjusting timing of ejection in movement in a scanning direction of processing-liquid ejection nozzles. However, the method can be applied to only an apparatus in which processing-liquid ejection nozzles (processing liquid head) eject the processing liquid while moving in the scanning direction. In other words, the method cannot be applied to an apparatus in which processing-liquid ejection nozzles arranged in parallel in the scanning direction of the processing liquid head are moved in a direction orthogonal to the scanning direction of the processing liquid head to deposit the processing liquid on a recording medium.

In the method disclosed in JP 2001-138494 A, the print-alignment for the processing liquid and the ink can be performed. However, in order to calculate the optical characteristic of the density and the blur of the ink used for aligning printing (recording) of the ink and printing (recording) of the processing liquid, a plurality of patterns formed by depositing the processing liquid on or near a print pattern formed by two kinds of colored inks have to be generated. Therefore, the method is time consuming and there is concern about an individual difference of each of the colored inks.

SUMMARY OF THE INVENTION

It is an object of the present invention to solve the above-mentioned problems of the related arts and provide a landing position determining method and device for a processing-liquid ejection nozzle that can be applied to an inkjet recording apparatus having a recording head in which processing-liquid ejection nozzles and ink ejection nozzles are respectively aligned linearly and can determine a landing position of processing liquid from a processing liquid head with a stable and simple method, and provide the inkjet recording apparatus.

A landing position determining method for processing-liquid ejection nozzles according to a first aspect of the present invention comprises:

setting a processing liquid deposited pattern so that, by one processing-liquid ejection nozzle and a plurality of processing-liquid ejection nozzles located on both sides of the one processing-liquid ejection nozzle selected as landing position determination targets of the deposited processing liquid, a plurality of linear landing position determination target areas are formed in which the processing liquid is continuously deposited for a predetermined number of dots while gradually changing density of the processing liquid to be deposited to one of increase and decrease in one direction and a number of dots with one of high and low density of the processing liquid decreases farther away from centered linear landing position determination target area of the plurality of linear landing position determination target areas, and, by remaining processing-liquid ejection nozzles, the processing liquid is continuously deposited while the density of the processing liquid is changed in a direction opposite to a direction of the plurality of linear landing position determination target areas;

ejecting the processing liquid from the processing-liquid ejection nozzles onto a recording medium to form the processing liquid deposited pattern on the recording medium according to the set processing liquid deposited pattern;

depositing the colored ink from a plurality of ink nozzles, which include an ink nozzle corresponding to the selected processing-liquid ejection nozzle, and are selected, from ink nozzles on both sides of the ink nozzle, with a predetermined nozzle interval, onto the processing liquid deposited pattern, and recording a plurality of linear colored ink images to form a processing liquid landing position determination pattern on the recording medium;

scanning the processing liquid landing position determination pattern formed on the recording medium with a detection sensor;

detecting the plurality of linear colored ink images in the processing liquid landing position determination pattern scanned by the detection sensor;

measuring at least one of densities and line widths of the detected plurality of linear colored ink images; and detecting presence/absence of a change in the at least one of the measured densities and line widths of the plurality of linear colored ink images, and determining, from at least one of density distribution and line width distribution in a linear colored ink image in which the change is present, a landing position of the processing liquid ejected from the processing-liquid ejection nozzle selected as the landing position determination targets.

A landing position determining method for processing-liquid ejection nozzles according to a second aspect of the present invention comprises:

setting a processing liquid deposited pattern so that, by processing-liquid ejection nozzles selected not to be adjacent to one another as landing position determination targets of the deposited processing liquid out of all the processing-liquid ejection nozzles, linear landing position determination target areas are formed in which the processing liquid is continuously deposited for a predetermined number of dots while gradually changing density of the processing liquid to be deposited to one of increase and decrease in one direction, and, by remaining processing-liquid ejection nozzles not selected as the landing position determination targets, the processing liquid is continuously deposited while the density of the processing liquid is changed in a direction opposite to a direction of the linear landing position determination target areas;

repeatedly ejecting the processing liquid from the processing-liquid ejection nozzles onto the recording medium to repeatedly form the same processing liquid deposited pattern on the recording medium according to the set processing liquid deposited pattern;

setting, as ink nozzles corresponding to the processing-liquid ejection nozzles selected as the landing position determination targets, a plurality of types of ink nozzles that deposit colored ink of colors different from one another, repeatedly ejecting the colored ink by each ink nozzle of the set plurality of types of ink nozzles and a plurality of ink nozzles around the set plurality of types of ink nozzles onto one processing liquid deposited pattern repeatedly formed on the recording medium to form linear colored ink images on the recording medium while changing a type of the ink nozzle and a color of the colored ink, and recording a plurality of the linear colored ink images on the recording medium for each of a plurality of the colors to form a processing liquid landing position determination pattern on the recording medium;

scanning the processing liquid landing position determination pattern formed on the recording medium with a detection sensor;

detecting the plurality of the linear colored ink images for the each of the plurality of the colors in the processing liquid landing position determination pattern scanned by the detection sensor;

measuring at least one of densities and line widths of the plurality of the linear colored ink images for the each of the plurality of the colors; and detecting presence/absence of a change in the at least one of the measured densities and line widths of the plurality of the linear colored ink images for the each of the plurality of the colors, finding, out of linear colored ink images in which the change is present, at least one linear colored ink image having at least one of a direction of a change in density coincident with a direction of a change in the density of the processing liquid of the linear landing position determination target areas and a direction in which a change in line width decreases coincident with a direction in which the change in the density of the processing liquid of the linear landing position determination target areas increases, and determining, when the found at least one linear colored ink image having the coincident direction of the change is present on the same line, positions of the at least one linear colored ink image as landing positions of the processing liquid ejected from the processing-liquid ejection nozzles selected as the landing position determination targets.

A landing position determining device for processing-liquid ejection nozzles according to a third aspect of the present invention comprises:

a nozzle setting unit that selects, as landing position determination targets of the deposited processing liquid, one processing-liquid ejection nozzle and a plurality of processing-liquid ejection nozzles located on both sides of the one processing-liquid ejection nozzle;

a processing liquid deposited pattern setting unit that sets a processing liquid deposited pattern so that the processing-liquid ejection nozzles selected as the landing position determination targets form a plurality of linear landing position determination target areas in which the processing liquid is continuously deposited for a predetermined number of dots while gradually changing density of the processing liquid to be deposited to one of increase and decrease in one direction and a number of dots with one of high and low density of the processing liquid decreases farther away from centered linear landing position determination target area of the plurality of linear landing position determination target areas, and remaining processing-liquid ejection nozzles not selected as the landing position determination targets continuously deposit the processing liquid while the density of the processing liquid is changed in a direction opposite to a direction of the plurality of linear landing position determination target areas;

an ejection control unit that performs ejection control for the processing-liquid ejection nozzles to eject the processing liquid from the processing-liquid ejection nozzles onto the recording medium to form the processing liquid deposited pattern on the recording medium according to the set processing liquid deposited pattern, and performs ejection control for a plurality of ink nozzles, which include an ink nozzle corresponding to the selected processing-liquid ejection nozzle, and are selected, from ink nozzles on both sides of the ink nozzle, with a nozzle interval, to deposit the colored ink from the plurality of ink nozzles onto the processing liquid deposited pattern formed on the recording medium, and record a plurality of linear colored ink images on the recording medium to form a processing liquid landing position determination pattern on the recording medium;

a data acquiring unit that scans the processing liquid landing position determination pattern formed on the recording medium with a detection sensor, and acquires image data of the plurality of linear colored ink images in the scanned processing liquid landing position determination pattern;

a measuring unit that measures at least one of densities and line widths of the plurality of linear colored ink images; and a determining unit that detects presence/absence of a change in the at least one of the densities and the line widths of the plurality of linear colored ink images measured by the measuring unit, and determines, from at least one of density distribution and line width distribution in a linear colored ink image in which the change is present, a landing position of the processing liquid ejected from the processing-liquid ejection nozzles selected as the landing position determination targets.

A landing position determining device for processing-liquid ejection nozzles according to a fourth aspect of the present invention comprises:

a nozzle setting unit that selects, as landing position determination targets of the deposited processing liquid, a plurality of processing-liquid ejection nozzles not to be adjacent to one another out of all the processing-liquid ejection nozzles;

a processing liquid deposited pattern setting unit that sets a processing liquid deposited pattern so that the plurality of processing-liquid ejection nozzles selected as the landing position determination targets continuously deposit the processing liquid for a predetermined number of dots while gradually changing density of the processing liquid to be deposited to one of increase and decrease in one direction to form linear landing position determination target areas, and remaining processing-liquid ejection nozzles not selected as the landing position determination targets continuously deposit the processing liquid while the density of the processing liquid is changed in a direction opposite to a direction of the linear landing position determination target areas;

an ejection control unit that performs ejection control for the processing-liquid ejection nozzles to repeatedly eject the processing liquid from the processing-liquid ejection nozzles onto the recording medium to repeatedly form the same processing liquid deposited pattern on the recording medium according to the set processing liquid deposited pattern, and performs ejection control for the ink nozzles to set, as ink nozzles corresponding to the processing-liquid ejection nozzles selected as the landing position determination targets, a plurality of types of ink nozzles that deposit colored ink of colors different from one another, repeatedly ejects the colored ink by each ink nozzle of the set plurality of types of ink nozzles and a plurality of ink nozzles around the set plurality of types of ink nozzles onto one processing liquid deposited pattern repeatedly formed on the recording medium to form linear colored ink images on the recording medium while changing a type of the ink nozzle and a color of the colored ink, and record a plurality of the linear colored ink images on the recording medium for each of a plurality of the colors to form a processing liquid landing position determination pattern on the recording medium;

a data acquiring unit that scans the processing liquid landing position determination pattern formed on the recording medium with a detection sensor, and acquires image data of the plurality of the linear colored ink images for the each of the plurality of the colors in the scanned processing liquid landing position determination pattern;

a measuring unit that measures at least one of densities and line widths of the plurality of the linear colored ink images for the each of the plurality of the colors; and a determining unit that detects presence/absence of a change in the at least one of the measured densities and line widths of the plurality of the linear colored ink images for the each of the plurality of the colors, finds, out of linear colored ink images in which the change is present, at least one linear colored ink image having at least one of a direction of a change in density coincident with a direction of a change in the density of the processing liquid of the linear landing position determination target areas and a direction in which a change in line width decreases coincident with a direction in which the change in the density of the processing liquid of the linear landing position determination target areas increases, and determines, when the found at least one linear colored ink image having the coincident direction of the change is present on the same line, positions of the at least one linear colored ink image as landing positions of the processing liquid ejected from the processing-liquid ejection nozzles selected as the landing position determination targets.

A landing position determining method for processing-liquid ejection nozzles according to a fifth aspect of the present invention comprises:

setting a processing liquid deposited pattern so that, by one processing-liquid ejection nozzle and a plurality of processing-liquid ejection nozzles located on both sides of the one processing-liquid ejection nozzle selected as landing position determination targets of the deposited processing liquid, a plurality of linear landing position determination target areas are formed which includes a processing liquid deposited area on which the processing liquid is continuously deposited for a predetermined number of dots and a processing liquid non-deposited area on which the processing liquid is not continuously deposited for the predetermined number of dots and in which the predetermined number of dots for which the processing liquid is not deposited decreases farther away from a center of the processing liquid non-deposited area, and, in remaining processing-liquid ejection nozzles, the processing liquid is continuously deposited;

ejecting the processing liquid from the processing-liquid ejection nozzles onto a recording medium to form the processing liquid deposited pattern on the recording medium according to the set processing liquid deposited pattern;

depositing the colored ink from a plurality of ink nozzles, which include an ink nozzle corresponding to the selected processing-liquid ejection nozzle, and are selected, from ink nozzles on both sides of the ink nozzle, with a predetermined nozzle interval, onto the processing liquid deposited pattern formed on the recording medium, and recording a plurality of linear colored ink images on the recording medium to form a processing liquid landing position determination pattern on the recording medium;

scanning the processing liquid landing position determination pattern formed on the recording medium with a detection sensor;

detecting the plurality of linear colored ink images in the processing liquid landing position determination pattern scanned by the detection sensor;

measuring at least one of densities and line widths of the detected plurality of linear colored ink images; and detecting presence/absence of a changing point of the at least one of the measured densities and line widths of the plurality of linear colored ink images, and determining, from a change in position of the changing point in a linear colored ink image in which the changing point is present, a landing position of the processing liquid ejected from the processing-liquid ejection nozzles selected as the landing position determination targets.

A landing position determining method for processing-liquid ejection nozzles according to a sixth aspect of the present invention comprises:

setting a processing liquid deposited pattern so that, by processing-liquid ejection nozzles selected not to be adjacent to one another as landing position detection targets of the deposited processing liquid, a linear non-ejection detection target area in which a processing liquid deposited area on which the processing liquid is continuously deposited for a predetermined number of dots and a processing liquid non-deposited area on which the processing liquid is not continuously deposited for the predetermined number of dots continue is formed, and, by remaining processing-liquid ejection nozzles not selected as the landing position detection targets, the processing liquid is continuously deposited;

repeatedly ejecting the processing liquid from the processing-liquid ejection nozzles onto the recording medium to repeatedly form the same processing liquid deposited pattern on the recording medium according to the set processing liquid deposited pattern;

setting, as ink nozzles corresponding to the processing-liquid ejection nozzles selected as the landing position detection targets, a plurality of types of ink nozzles that deposit colored ink of colors different from one another, repeatedly ejecting the colored ink by each of ink nozzle of the set plurality of types of ink nozzles and a plurality of ink nozzles around the set plurality of types of ink nozzles to the linear non-ejection detection target area of one processing liquid deposited pattern repeatedly formed on the recording medium to form linear colored ink images on the recording medium while changing a type of the ink nozzle and a color of the colored ink, and recording a plurality of the linear colored ink images on the recording medium for each of a plurality of the colors to form a processing liquid landing position detection pattern on the recording medium;

scanning the processing liquid landing position detection pattern formed on the recording medium with a detection sensor;

detecting the plurality of the linear colored ink images for the each of the plurality of the colors in the processing liquid landing position detection pattern scanned by the detection sensor;

measuring at least one of densities and line widths of the plurality of the linear colored ink images for the each of the plurality of the colors; and detecting presence/absence of a changing point of the at least one of the measured densities and line widths of the plurality of the linear colored ink images for the each of the plurality of the colors, finding at least one linear colored ink image in which the changing point is present, and detecting, when the at least one linear colored ink image in which the changing point is present is present on the same line, positions of the at least one linear colored ink image as landing positions of the processing liquid ejected from the processing-liquid ejection nozzles selected as the landing position detection targets.

A landing position determining device for processing-liquid ejection nozzles according to a seventh aspect of the present invention comprises:

a nozzle setting unit that selects, as landing position detection targets of the deposited processing liquid, one processing-liquid ejection nozzle and a plurality of processing-liquid ejection nozzles located on both sides of the one processing-liquid ejection nozzle;

a processing liquid deposited pattern setting unit that sets a processing liquid deposited pattern so that the processing-liquid ejection nozzles selected as the landing position detection targets form a plurality of linear landing position detection target areas which includes a processing liquid deposited area on which the processing liquid is continuously deposited for a predetermined number of dots and a processing liquid non-deposited area on which the processing liquid is not continuously deposited for the predetermined number of dots and in which the predetermined number of dots for which the processing liquid is not deposited decreases farther away from a center of the processing liquid non-deposited area, and remaining processing-liquid ejection nozzles continuously deposit the processing liquid;

an ejection control unit that performs ejection control for the processing-liquid ejection nozzles to eject the processing liquid from the processing-liquid ejection nozzles onto the recording medium to form the processing liquid deposited pattern on the recording medium according to the set processing liquid deposited pattern, and performs ejection control for a plurality of ink nozzles, which include an ink nozzle corresponding to the selected processing-liquid ejection nozzle, and are selected, from ink nozzles on both sides of the ink nozzle, with a nozzle interval, to deposit the colored ink from the plurality of ink nozzles onto the processing liquid deposited pattern formed on the recording medium, and record a plurality of linear colored ink images on the recording medium to form a processing liquid landing position detection pattern on the recording medium;

a data acquiring unit that scans the processing liquid landing position detection pattern formed on the recording medium with a detection sensor, and acquires image data of the plurality of linear colored ink images in the scanned processing liquid landing position detection pattern;

a measuring unit that measures at least one of densities and line widths of the detected plurality of linear colored ink images; and a detecting unit that detects presence/absence of a changing point of the at least one of the measured densities and line widths of the plurality of linear colored ink images, and detects, from a change in position of the changing point in a linear colored ink image in which the changing point is present, a landing position of the processing liquid ejected from the processing-liquid ejection nozzles selected as the landing position detection targets.

A landing position determining device for processing-liquid ejection nozzles according to a eighth aspect of the present invention comprises:

a nozzle setting unit that selects, as landing position detection targets of the deposited processing liquid, a plurality of processing-liquid ejection nozzles not to be adjacent to one another;

a processing liquid deposited pattern setting unit that sets a processing liquid deposited pattern so that the plurality of processing-liquid ejection nozzles selected as the landing position detection targets form a linear non-ejection detection target area in which a processing liquid deposited area on which the processing liquid is continuously deposited for a predetermined number of dots and a processing liquid non-deposited area on which the processing liquid is not continuously deposited for the predetermined number of dots continue, and remaining processing-liquid ejection nozzles not selected as the landing position detection targets continuously deposit the processing liquid;

an ejection control unit that performs ejection control for the processing-liquid ejection nozzles to repeatedly eject the processing liquid from the processing-liquid ejection nozzles onto the recording medium to repeatedly form the same processing liquid deposited pattern on the recording medium according to the set processing liquid deposited pattern, and performs ejection control for the ink nozzles to set, as ink nozzles corresponding to the processing-liquid ejection nozzles selected as the landing position detection targets, a plurality of types of ink nozzles that deposit colored ink of colors different from one another, repeatedly ejects the colored ink by each ink nozzle of the set plurality of types of ink nozzles and a plurality of ink nozzles around the set plurality of types of ink nozzles to the linear non-ejection detection target area of one processing liquid deposited pattern repeatedly formed on the recording medium to form linear colored ink images on the recording medium while changing a type of the ink nozzle and a color of the colored ink, and record a plurality of the linear colored ink images on the recording medium for each of a plurality of the colors to form a processing liquid landing position detection pattern on the recording medium;

a data acquiring unit that scans the processing liquid landing position detection pattern formed on the recording medium with a detection sensor, and acquires image data of the plurality of the linear colored ink images for the each of the plurality of the colors in the processing liquid landing position detection pattern scanned by the detection sensor;

a measuring unit that measures at least one of densities and line widths of the plurality of the linear colored ink images for the each of the plurality of the colors; and a detecting unit that detects presence/absence of a changing point of the at least one of the measured densities and line widths of the plurality of the linear colored ink images for the each of the plurality of the colors, finds at least one linear colored ink image in which the changing point is present, and detects, when the at least one linear colored ink image in which the changing point is present is present on the same line, positions of the at least one linear colored ink image as landing positions of the processing liquid ejected from the processing-liquid ejection nozzles selected as the landing position detection targets.

DETAILED DESCRIPTION OF THE PREFERRED EMBODIMENTS

Embodiments of the present invention are described in detail below with reference to the accompanying drawings.

First Embodiment

Figure 1:
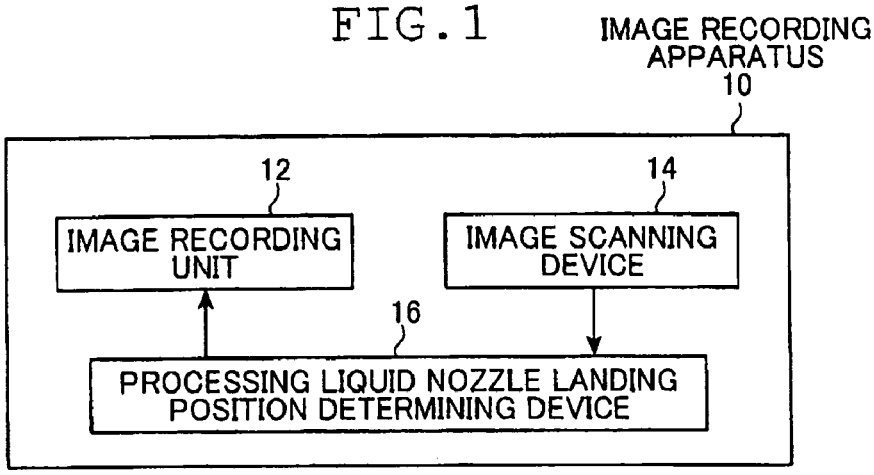
FIG. 1 is a block diagram of a configuration of an example of an image recording apparatus to which the present invention is applied.

FIG. 1 is a diagram of a configuration of an image recording apparatus 10 to which the present invention is applied.

The image recording apparatus 10 is an ink jet recording apparatus that records, according to supplied image information, an image on a recording medium with the use of colored inks for forming an image and processing liquid for fixing the colored inks. The image recording apparatus 10 includes an image recording unit 12, an image scanning device 14, and a processing liquid nozzle landing position determining device 16 according to this embodiment of the present invention.

The image recording unit 12 includes an inkjet head (hereinafter, simply referred to as ejection head) having ink ejection nozzles (hereinafter, also simply referred to as ink nozzles) and processing-liquid ejection nozzles (hereinafter, also simply referred to as processing liquid nozzles) and conveying means for conveying a recording medium. The image recording unit 12 records an image on a supplied recording medium according to supplied image information and forms, for example, a processing liquid deposited pattern by the processing liquid nozzles and a processing liquid landing position determination pattern by the processing liquid nozzles and the ink nozzles.

The image scanning device 14 scans the image recorded on the recording medium by the image recording unit 12 with the use of a photographing device including a charge-coupled device (CCD) or a metal oxide semiconductor (MOS) sensor, converts data of the scanned image into digital data, and supplies the digital data to the processing liquid nozzle landing position determining device 16. As the image scanning device 14, a publicly-known scanner can be used.

The processing liquid nozzle landing position determining device (hereinafter, also referred to as determining device) 16 determines landing positions of droplets of the processing liquid (ejected processing liquid droplets) ejected onto the recording medium from the processing liquid nozzles of the image recording unit 12. Preferably, the determining device 16 determines ejection states of a selected processing liquid nozzle, an ink nozzle corresponding to the selected processing liquid nozzle, a plurality of selected ink nozzles for a test (hereinafter, also simply referred to as test ink nozzles) spaced apart from one another at predetermined nozzle intervals on both sides of the ink nozzle, and ink nozzles located around the selected ink nozzles (hereinafter, also simply referred to as peripheral ink nozzles). Further, the determining device 16 detects shift of landing positions of the processing liquid and the inks ejected from the processing liquid nozzles and the ink nozzles. Preferably, the determining device 16 corrects the positional shift and performs setting of new association between the processing liquid nozzles and the ink nozzles.

Figure 2:
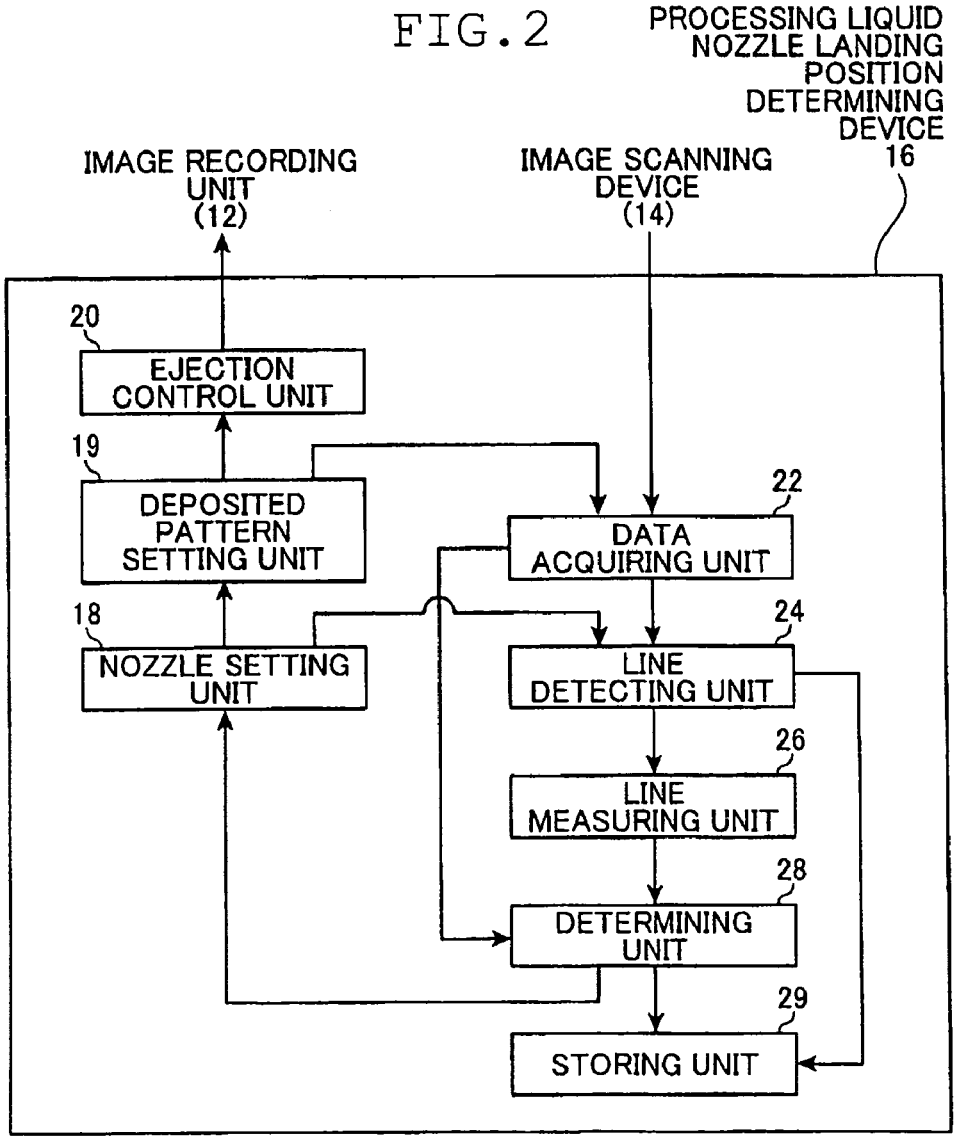
FIG. 2 is a block diagram of a configuration of a landing position determining device for a processing liquid nozzle according to a first embodiment of the present invention.

As illustrated in FIG. 2, the determining device 16 includes a nozzle setting unit 18, a deposited pattern setting unit 19, an ejection control unit 20, a data acquiring unit 22, a line detecting unit 24, a line measuring unit 26, a determining unit 28, and a storing unit 29.

The nozzle setting unit 18 performs, for example, number setting for the processing liquid nozzles, number setting for the processing liquid nozzles as processing liquid landing position determination targets, determination of an ink nozzle corresponding to the target processing liquid nozzle, determination of a plurality of selected ink nozzles spaced apart from one another at predetermined nozzle intervals from the ink nozzle, determination of corresponding ink nozzles around the selected ink nozzle.

When processing liquid nozzles as processing liquid landing position determination targets are determined, for example, target processing liquid nozzles are selected out of all the processing liquid nozzles so as not to be adjacent to one another as processing liquid landing position determination targets.

When landing positions of the processing liquid ejected from the processing liquid nozzles are determined from a processing liquid landing position determination pattern formed by the processing liquid nozzles and the ink nozzles, a predetermined processing liquid nozzle, e.g., a processing liquid nozzle at one end of the ejection head or a processing liquid nozzle next to the processing liquid nozzle for which a landing position is determined, is selected as a target processing liquid nozzle. A nozzle number of the selected target processing liquid nozzle is sent to the line detecting unit 24.

The deposited pattern setting unit 19 sets, according to the processing liquid nozzles as the landing position determination targets set by the nozzle setting unit 18, a processing liquid deposited pattern (see FIGS. 4 and 17 referred to later) as a test pattern for depositing the processing liquid with the use of all the processing liquid nozzles in order to determine a landing position of the processing liquid.

In the deposited pattern setting unit 19, the processing liquid deposited pattern is generated as test pattern data for processing liquid deposited (hereinafter, also simply referred to as processing liquid pattern data).

For example, the processing liquid deposited pattern is set as follows. In one processing liquid nozzle and a plurality of processing liquid nozzles on both sides of the one processing liquid nozzle, which are selected as a landing position determination target out of all the processing liquid nozzles, a linear landing position determination target area (hereinafter, referred to as line target area) having density distribution (gradation), in which a predetermined dot number of the processing liquid is continuously deposited while the density of the processing liquid is gradually changed to be higher or lower in one direction, is formed, and a plurality of line target areas, in which the number of dots with higher or lower processing liquid density decreases further away from the centers of the above-mentioned line target areas, are formed. In the remaining processing liquid nozzles not selected as the landing position determination targets, the processing liquid is continuously deposited while the density of the processing liquid is changed in a manner opposite to that in the line target area. In other words, in the landing position determination target area including the plurality of line target areas, each of the line target areas itself not only has density distribution (gradation) in a line direction but also has density distribution from the center in a width direction orthogonal to the line direction. For example, in an example illustrated in FIG. 4, an equal density portion is formed in an arrow shape (reverse V shape). It goes without saying that, in areas other than the plurality of line target areas, each of the lines has density distribution in the opposite direction.

The ejection control unit 20 generates, according to processing liquid pattern data of the processing liquid deposited pattern set by the deposited pattern setting unit 19, test pattern data for ink deposited (hereinafter, referred to as ink pattern data) for depositing the colored inks with the use of the corresponding ink nozzle, the test ink nozzles, and the peripheral ink nozzles. The ejection control unit 20 supplies the processing liquid pattern data and the ink pattern data to the image recording unit 12 and controls operations of the image recording unit 12. In other words, the image recording unit 12 is controlled so as to eject and deposit the processing liquid from the processing liquid nozzles of the ejection head according to the supplied processing liquid pattern data to form a processing liquid deposited pattern (see FIG. 4) in which a plurality of line target areas are formed on the recording medium and so as to eject and deposit the colored inks on the recording medium from the ink nozzles of the ejection head according to the supplied ink pattern data, record a linear colored ink image (hereinafter, simply referred to as line image) on the recording medium, and form a test pattern, i.e., a processing liquid landing position determination pattern (see FIG. 5).

After the processing liquid landing position determination pattern formed by the image recording unit 12 on the basis of the control by the ejection control unit 20 is scanned by the image scanning device 14, the data acquiring unit 22 acquires from the image scanning device 14, image data of the processing liquid landing position determination pattern (test pattern) used for determining landing positions of the processing liquid ejected from the processing liquid nozzles (hereinafter, also simply referred to as landing position determination data). The data acquiring unit 22 acquires, from the deposited pattern setting unit 19, feature data used for determination of landing positions of the processing liquid ejected from the processing liquid nozzles in the determining unit 28.

The data acquiring unit 22 further acquires processing liquid pattern data of the processing liquid deposited pattern from the deposited pattern setting unit 19.

The line detecting unit 24 detects, from landing position determination data acquired by the data acquiring unit 22, data of a line image (hereinafter, simply referred to as line data) printed by the corresponding ink nozzle, the test ink nozzles, and the peripheral ink nozzles and supplies the detected line data to the line measuring unit 26.

The line measuring unit 26 measures density on the recording medium, of the line image recorded in the line data (hereinafter, also simply referred to as density of the line image) and line width of the line image recorded in the line data (line width in a direction orthogonal to a recording medium conveying direction on the recording medium; also simply referred to as width of the line image) and supplies measurement result data, in which a result of the measurement is recorded, to the determining unit 28. For the density and the width of the line image, it is unnecessary to measure absolute values thereof. The density of the line image may be measured as a change in the density or density distribution of the line image. The width of the line image may be measured as a change in the line width or line width distribution of the line image.

The determining unit 28 detects presence or absence of a change in the density and/or the line width of the line image recorded in the line data or presence or absence of the density distribution and/or the line width distribution. The determining unit 28 determines, from a state of the change or the density distribution and/or the line width distribution, in particular, from directionality of the change or the distribution, landing positions of ejection processing droplets of the processing liquid nozzles selected as the landing position determination targets of the processing liquid and supplies a result of the determination to the storing unit 29 as determination result recording data.

As described in detail later, in the first embodiment, for example, the determining unit 28 obtains, from a change in density distribution and/or line width distribution of two line images formed by the ink nozzles, feature points of the respective line images. The determining unit 28 calculates and determines landing positions of ejection processing liquid droplets ejected from the processing liquid nozzles with the use of positions of the respective line images, the lengths of the obtained respective feature points, the lengths of the line images, and a distance between the two line images which are determined in advance (see FIGS. 8 to 14).

The determining unit 28 detects presence or absence of a change in the density and/or the line width of the line image recorded in the line data. The determining unit 28 calculates, from density distribution and/or line width distribution in the linear colored ink image in which the change is present, specifically, from the feature points of the density and/or the line width of the line image, landing positions of the processing liquid deposited by the processing liquid nozzles selected as the landing position determination targets of the processing liquid with the use of, for example, the lengths of the feature points of the two line images, the distance between the two line images, and ink landing positions determined in advance in association with ink nozzles that print the two line images. The determining unit 28 determines ejection states of the selected processing liquid nozzle, the corresponding ink nozzle, the test ink nozzles, and the peripheral ink nozzles, a positional relation between the depositing positions of the target processing liquid nozzle and the ink nozzle, and update of the corresponding ink nozzle and supplies a result of the determination to the storing unit 29 as determination result recording data.

A method of determining a landing position of the processing liquid ejected from the target processing-liquid ejection nozzle is described later.

The storing unit 29 is a unit that stores determination result recording data such as landing positions of the processing liquid ejected from the processing liquid nozzles, a nozzle number of the non-ejecting processing liquid nozzle, positional shift between the target processing liquid nozzle and the corresponding ink nozzle, a positional relation between the target processing liquid nozzle and the corresponding ink nozzle, the test ink nozzles, or the peripheral ink nozzles, and an update number of the corresponding ink nozzle (change to a peripheral ink nozzle). Publicly-known storing means such as a server can be used as the storing unit 29.

A method of determining landing positions of the processing liquid ejected from the processing-liquid ejection nozzles is described with reference to FIGS. 3 to 15.

Figure 3:
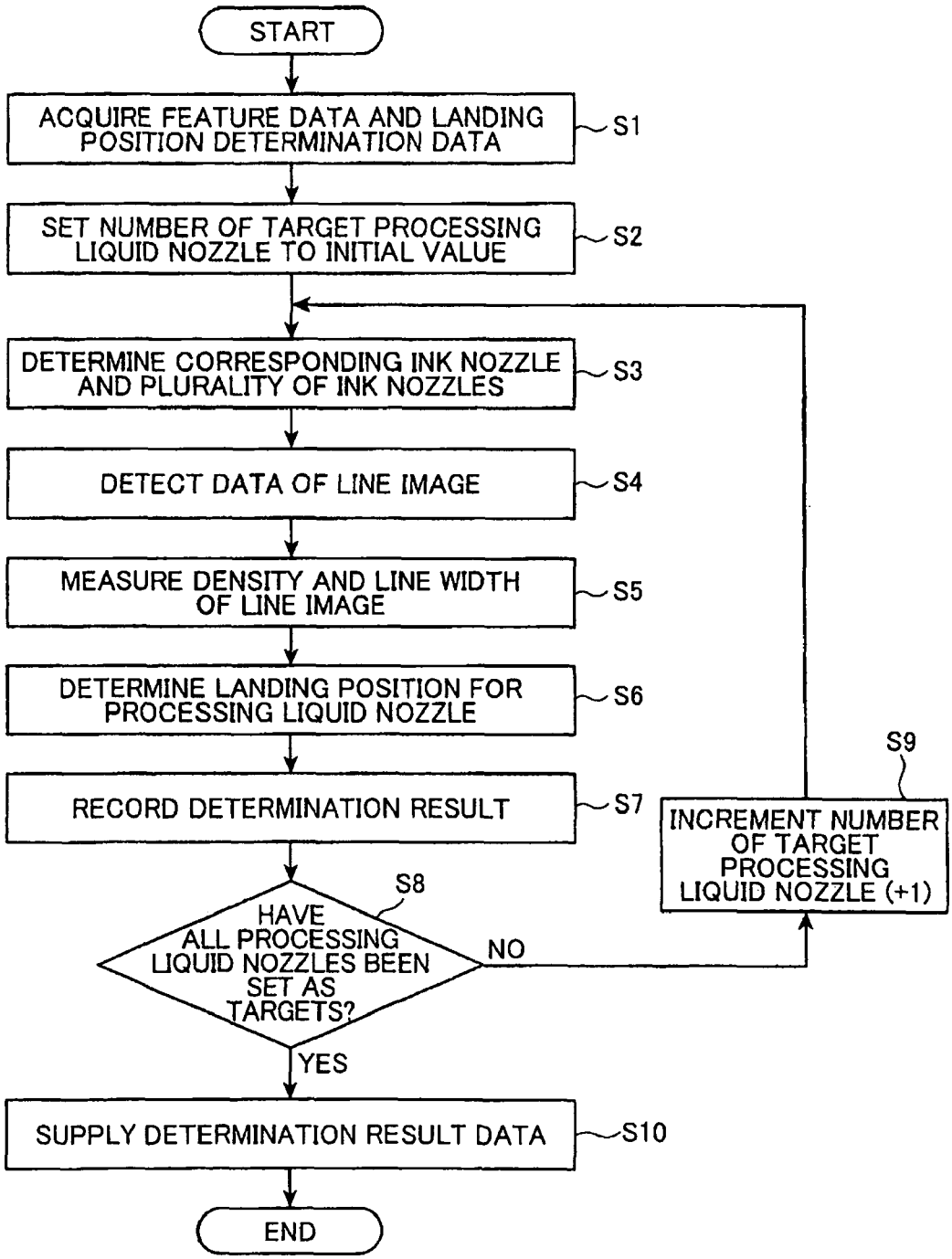
FIG. 3 is a flowchart of a landing position determining method for processing liquid nozzles according to the first embodiment.
Figure 4:
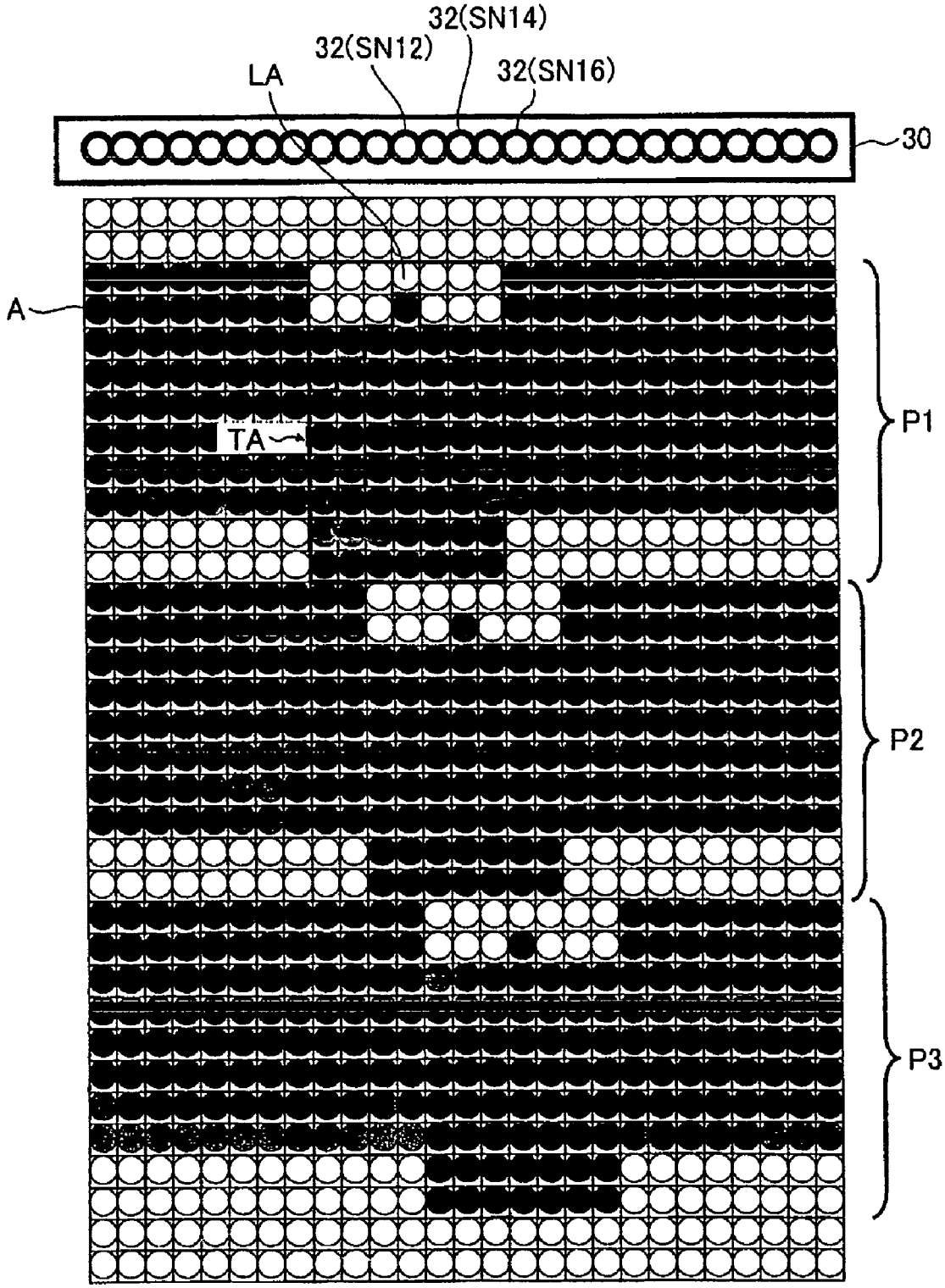
FIG. 4 is a schematic diagram of a recording medium on which an example of a processing liquid deposited pattern is formed and a processing liquid head.
Figure 5:
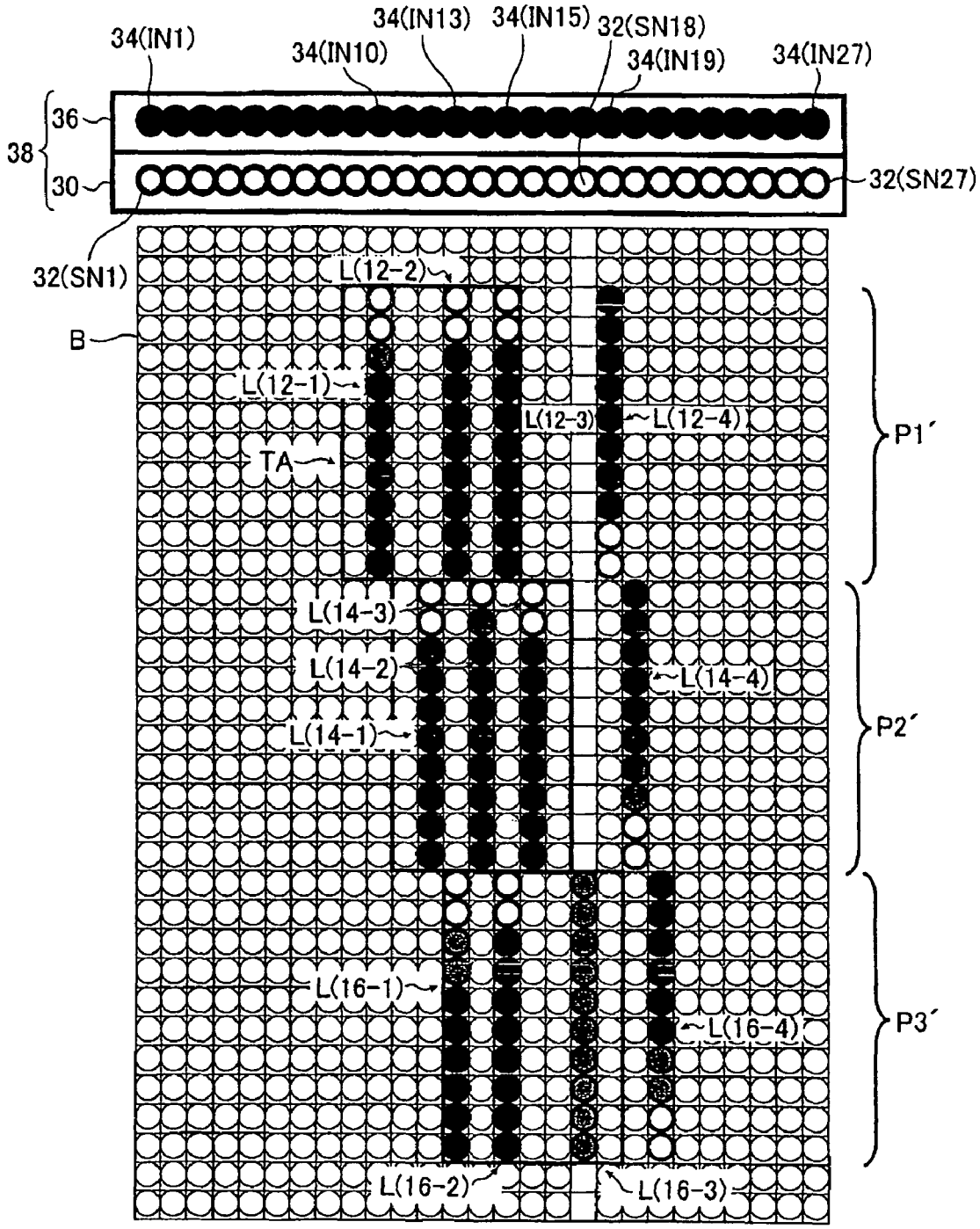
FIG. 5 is a schematic diagram of a recording medium on which an example of a landing position determination pattern is formed and an ejection head.

FIG. 3 is a flowchart of a method of determining landing positions of the processing liquid ejected from the processing-liquid ejection nozzles in the first embodiment It is assumed that a test pattern, for example, a processing liquid landing position determination pattern illustrated in FIG. 5 is formed in advance. In other words, it is assumed that a processing liquid deposited pattern illustrated in FIG. 4 is formed on a recording medium according to test pattern data for processing liquid deposited (processing liquid pattern data) and a processing liquid landing position determination pattern by test pattern data for ink deposited (ink pattern data) is formed on the processing liquid deposited pattern.

First, in Step S1, the data acquiring unit 22 acquires, from the image scanning device 14, landing position determination data obtained by scanning the processing liquid landing position determination pattern and acquires, from the deposited pattern setting unit 19, feature data of processing liquid density distribution of the landing position determination target area including the plurality of line target areas and feature data used for landing position determination such as ink deposited positions corresponding to the respective ink nozzles set in advance. The landing position determination data is supplied from the data acquiring unit 22 to the line detecting unit 24. The feature data is supplied from the data acquiring unit 22 to the determining unit 28.

The landing position determination data and the feature data are described in detail later.

Subsequently, in Step S2, the nozzle setting unit 18 sets a number of the target processing liquid nozzle to an initial value.

For example, when numbers SN1, SN2, SN3, . . . are set for the respective processing liquid nozzles and landing positions of the processing liquid from the processing liquid nozzles are determined, if determination of landing positions of the processing liquid from the processing liquid nozzles is always started with the processing liquid nozzle SN1 set as the target processing liquid nozzle, the nozzle setting unit 18 resets the number of the target processing liquid nozzle to the initial value SN1.

After resetting the number of the target processing liquid nozzle to the initial value, in Step S3, the nozzle setting unit 18 determines an ink nozzle that deposits the ink on the processing liquid deposited by the target processing liquid nozzle, i.e., an ink nozzle corresponding to the target processing liquid nozzle (corresponding ink nozzle), and a plurality of selected ink nozzles spaced apart from one another at predetermined nozzle intervals on both sides of the corresponding ink nozzle (plurality of test ink nozzles).

A method of determining the corresponding ink nozzle is not specifically limited. However, usually, the processing liquid nozzles and the ink nozzles are arranged in the ejection head such that the ink is deposited in positions where the processing liquid is deposited. Therefore, as an example, there is a method of determining an ink nozzle corresponding to the target processing liquid nozzle with the use of arrangement data.

Similarly, a method of determining the test ink nozzles is not specifically limited. As an example, there is a method of determining the test ink nozzles to be spaced apart from one another at predetermined nozzle intervals on both sides of the corresponding ink nozzle with the use of the arrangement data.

In Step S4, the line detecting unit 24 detects, from the landing position determination data, data of a line image (line data) recorded by a plurality of corresponding ink nozzles and the test ink nozzles determined in Step S3 and supplies the line data to the line measuring unit 26.

A method of detecting the line data from the landing position determination data is not specifically limited. As an example, there is a method of detecting the line data using, for example, information concerning a starting position for drawing by the ink nozzles on the recording medium.

After detecting the line data, in Step S5, the line measuring unit 26 measures the density of the line image and the width of the line image from a value of the supplied line data and supplies measurement result data, in which a measurement result is recorded, to the determining unit 28.

Subsequently, in Step S6, the determining unit 28 determines a landing position of the processing liquid ejected from the target processing liquid nozzle with the use of the measurement result data supplied from the line measuring unit 26 and the feature data supplied from the data acquiring unit 22.

A method of calculating and determining a landing position of the processing liquid ejected from the target processing liquid nozzle in Step S6 is described in detail later.

In Step S7, the storing unit 29 records a result of the determination in Step S6 in landing position recording data.

In Step S8, the nozzle setting unit 18 checks whether all the processing liquid nozzles are set as target processing liquid nozzles.

When all the processing liquid nozzles are not set as the target processing liquid nozzle, in Step S9, the nozzle setting unit 18 increments the set number of the target processing liquid nozzle by one.

For example, if the present number of the target processing liquid nozzle is SN1, the nozzle setting unit 18 sets a number of the next target processing liquid nozzle to SN2.

After the set number of the target processing liquid nozzle is incremented by one, the processing in Steps S3 to S8 is repeated.

When it is confirmed in Step S8 that all the processing liquid nozzles are set as target processing liquid nozzles, in Step S10, the landing position recording data is supplied to the storing unit 29, and the determination of landing positions of the processing liquids ejected from the processing liquid nozzles is finished.

Next, a method of determining a landing position of the processing liquid ejected from the target processing liquid nozzle with the use of the measurement result data and the feature data is described.

The measurement result data is data representing a result of measuring the density and the width of the line image detected from the landing position determination data. Therefore, first, the landing position determination data is described with reference to FIGS. 4 and 5.

In the first embodiment, test image data is data representing an image including a line image formed by depositing, using the corresponding ink nozzle and the plurality of test ink nozzles, the colored inks on a recording medium on which a plurality of line target areas each having processing liquid density with density distribution (gradation) in the line direction and also with density distribution in a direction orthogonal to the line direction in association with the target processing liquid nozzle in the center and the plurality of processing liquid nozzles on both sides thereof, and a processing liquid deposited pattern with opposite density distribution in the line direction are formed by the target processing liquid nozzle in the center and the plurality of processing liquid nozzles on both sides thereof.

A method of generating the landing position determination data is not particularly limited. An example of the method is described with reference to FIGS. 4 and 5.

FIG. 4 is a schematic explanatory diagram of a recording medium A on which three kinds of processing liquid deposited patterns (P1, P2, and P3) are formed and a processing liquid head 30 including twenty-seven processing liquid nozzles 32. The three kinds of processing liquid deposited patterns (P1, P2, and P3) are respectively set by the deposited pattern setting unit 19 with respect to the target processing liquid nozzles 32 (SN12, SN14, and SN16) set by the nozzle setting unit 18. In these processing liquid deposited patterns, linear landing position determination target areas (hereinafter, referred to as line target areas) having density distribution (gradation) in the density of the processing liquid continuously deposited a predetermined number of dots while the density of the deposited processing liquid is gradually changed to be higher or lower in one direction, are respectively formed by the target processing liquid nozzles 32 (SN12, SN14, and SN16) and the plurality of processing liquid nozzles 32 (SN9 to SN11, SN11 to SN13, and SN13 to SN15) and 32 (SN13 to SN15, SN15 to SN17, and SN17 to SN19) on both sides of the target processing liquid nozzles. A plurality of line target areas are formed such that the number of dots with higher or lower processing liquid density decreases further away from the centered line target area of the plurality of line target areas. The processing liquid is continuously deposited by the remaining processing liquid nozzles not selected as the landing position determination targets while the density of the processing liquid is changed oppositely from that in the line target areas.

FIG. 5 is a schematic explanatory diagram of a recording medium B on which processing liquid landing position determination patterns having line images formed by depositing the ink with corresponding nozzles 34 and/or test ink nozzles 34 in respective predetermined areas of the three kinds of processing liquid deposited patterns (P1, P2, and P3) of the recording medium A illustrated in FIG. 4 and an ejection head 38 that includes an ink head 36 including twenty-seven ink nozzles 34 and the processing liquid head 30.

The processing liquid landing position determination pattern illustrated in FIG. 5 is an example of an image represented by the landing position determination data.

First, for example, the image recording unit 12 deposits, according to a processing liquid deposited pattern set by the deposited pattern setting unit 19 of the determining device 16, the processing liquid according to an ejection control signal corresponding to the processing liquid deposited pattern with the use of the processing liquid nozzles 32 of the processing liquid head 30 controlled by an ejection control signal transmitted from the ejection control unit 20 and forms the recording medium A on which the processing liquid deposited pattern including the plurality of linear landing position determination target areas as illustrated in FIG. 4 is formed.

It is assumed that, as illustrated in FIG. 4, in the processing liquid head 30, the twenty-seven processing liquid nozzles 32 (SN1, SN2, . . . , SN27 from the left) are arranged in a row in a lateral direction of FIG. 4.

It is assumed that the width in the lateral direction (hereinafter, referred to as row direction) of the recording medium A illustrated in FIG. 4 coincides with the length of twenty-seven processing liquid dots arranged in a row deposited by the twenty-seven processing liquid nozzles 32 arranged in a row in the same direction. It is assumed that, on the other hand, the length in a longitudinal direction (hereinafter, referred to as column direction or line direction) of the recording medium A illustrated in FIG. 4 coincides with the length of thirty-four dots in a column (line) deposited thirty-four times by one processing liquid nozzle 32.

In other words, it is assumed that the entire surface of the recording medium A can be coated with the processing liquid by ejecting the processing liquid for thirty-four rows with the twenty-seven processing liquid nozzles 32 in total of the processing liquid head 30.

The recording medium A including the processing liquid deposited pattern having the plurality of linear landing position determination target areas is generated by using the recording medium A and the processing liquid nozzles 32 as described above.

For example, when the processing liquid nozzle 32 with the number SN12 is set as the target processing liquid nozzle, the processing head 30 and the recording medium A are relatively moved, the processing liquid is deposited on the recording medium A in a predetermined number of rows, in the example illustrated in FIG. 4, third to twelfth rows, and a processing liquid deposited pattern P1 including a landing position determination target area TA is formed such that there are obtained density distribution (gradation) in which density decreases both in the line (column) direction and the width (row) direction orthogonal to the line direction from a predetermined number of processing liquid nozzles 32 on both sides of the processing liquid nozzle 32 with the number SN12 in the center, in the example illustrated in FIG. 4, the three processing liquid nozzles 32 with the numbers SN9 to SN11 and the three processing liquid nozzles 32 with the numbers SN13 to SN15 and opposite density distribution (gradation) in the line (column) direction from the remaining processing liquid nozzles 32, in the example illustrated in FIG. 4, the processing liquid nozzles 32 with the numbers SN1 to SN8 and SN16 to SN27.

Concerning density distribution in the processing liquid deposited pattern, all the nozzles form processing liquid dots of high density, medium density, and low density by switching an ejection amount of the processing liquid by the processing liquid nozzles 32 in a plurality of stages, for example, in the example illustrated in FIG. 4, three stages. For example, in the landing position determination target area TA of the processing liquid deposited pattern P1 of the example illustrated in FIG. 4, a line target area LA including a low-density processing liquid dot in a third row, medium-density processing liquid dots in fourth to seventh rows, and high-density processing liquid dots in eighth to twelfth rows is formed by the target processing liquid nozzle 32 (SN12). In line target areas LA formed by the processing liquid nozzles 32 (SN11 and SN13) on both sides of the target processing liquid nozzle 32 (SN12), low-density processing liquid dots are formed in third and fourth rows, medium-density processing liquid dots are formed in fifth to eighth rows, and high-density processing liquid dots are formed in ninth to twelfth rows. In line target areas LA formed by the processing liquid nozzles 32 (SN10 and SN14) on the outer side thereof, low-density processing liquid dots are formed in third to fifth rows, medium-density processing liquid dots are formed in sixth to ninth rows, and high-density processing liquid dots are formed in tenth to twelfth rows. In line target areas LA formed by the processing liquid nozzles 32 (SN9 and SN15) further on the outer side thereof, low-density processing liquid dots are formed in third to sixth rows, medium-density processing liquid dots are formed in seventh to tenth rows, and high-density processing liquid dots are formed in eleventh and twelfth rows.

Further, in the example illustrated in FIG. 4, when the processing liquid nozzle 32 with the number SN14 is set as the target processing liquid nozzle, the landing position determination target area TA of the same configuration having seven line target areas LA including low-density, medium-density, and high-density processing liquid dots ejected from the seven processing liquid nozzles 32 with the numbers SN11 to SN17 including the processing liquid nozzle 32 with the number SN14 in the center is formed in the thirteenth to twenty-second rows in the same manner. In other areas, a large number of line target areas LA are formed by low-density, medium-density, and high-density processing liquid dots with the opposite density distribution (gradation) in the line (column) direction is formed. In this way, a processing liquid deposited pattern P2 is formed.

In addition, the landing position determination target area TA of the same configuration having seven line target areas LA with the processing liquid nozzle 32 with the number SN16 set as the target processing liquid nozzle is formed in the thirteenth to twenty-second rows of the recording medium A. In other areas, a large number of line target areas LA formed by low-density, medium-density, and high-density processing liquid dots with the opposite density distribution (gradation) in the line (column) direction is formed. In this way, a processing liquid deposited pattern P3 is formed.

It is possible to control the density of the processing liquid by controlling at least one of a liquid quantity of the processing liquid deposited on one processing liquid dot from the processing-liquid ejection nozzle 32, the size of one processing liquid dot, the density of small droplets of a predetermined liquid quantity forming one processing liquid dot, and an ejection ratio of the processing liquid on one processing liquid dot. Therefore, it is possible to associate the level of the processing liquid density with the liquid quantity, the size, the density of the small droplets, or the ejection ratio of the processing liquid.

It is preferable to set a processing liquid deposited pattern at least for each of the processing-liquid ejection nozzles and continuously combine the plurality of set processing liquid deposited patterns such that all the processing-liquid ejection nozzles 32 are selected as the landing position determination target. For example, in the case of the example illustrated in FIG. 4, one processing liquid deposited pattern is formed for one target processing liquid nozzle. Therefore, it is preferable to form twenty-seven processing liquid deposited patterns and continuously form the twenty-seven processing liquid deposited patterns.

An ink of equal density is deposited by the ink nozzles 34 corresponding to the target processing liquid nozzles 32 with the numbers SN12, SN14, and SN16 and/or the test nozzles 34 around the corresponding ink nozzles 34 according to test pattern data for ink deposited (ink pattern data) to form, under the control by the ejection control unit 20 or according to a control signal thereof, a line image on the recording medium A on which the three kinds of processing liquid deposited patterns P1 to P3 illustrated in FIG. 4 are formed. The recording medium B including a processing liquid landing position determination pattern having this line image is generated. In this case, as in the above-mentioned case, the corresponding ink nozzles 34 and/or the test ink nozzles deposit the ink only on a portion of a processing liquid deposited pattern in which the target processing liquid nozzles 32 form a linear position detection target area rather than depositing the ink in all the first to thirty-four rows.

As illustrated in FIG. 5, it is assumed that, in the ink head 36, twenty-seven ink nozzles 34 having the same size as those of the processing liquid head 32 are arranged in a row in the lateral direction (row direction) of FIG. 5.

The ejection head 38 includes the processing liquid head 30 and the ink head 36.

For example, as illustrated in FIG. 5, the ink nozzles 34 and/or the test ink nozzles 34 corresponding to the target processing liquid nozzles 32 with the numbers SN12, SN14, and SN16 are the ink nozzles 34 with the numbers IN10, IN12 to IN16, and IN18 to IN21. In this case, in order to deposit the ink on the line target areas LA of the recording medium A illustrated in FIG. 4, the ink nozzles 34 with the numbers IN10, IN13, IN15, and IN19 deposit the ink on the third to twelfth rows on the recording medium A, the ink nozzles 34 with the numbers IN12, IN14, IN16, and IN20 deposit the ink on the thirteenth to twenty-second rows on the recording medium A, the ink nozzles 34 with the numbers IN13, IN15, IN18, and IN21 deposit the ink on the twenty-third to thirty-second rows on the recording medium A to form line images L(12-1) to L(12-4), L(14-1) to L(14-4), and L(16-1) to L(16-4) and generate the recording medium B on which three kinds of processing liquid landing position determination patterns P1', P2', and P3' having these line images are formed.

The areas P1', P2', and P3' of the recording medium B illustrated in FIG. 5 correspond to the areas P1, P2, and P3 of the recording area A illustrated in FIG. 4.

In this way, the respective line images L of the three kinds of processing liquid landing position determination patterns P1', P2', and P3' formed on the recording medium B are formed on the line target areas LA of the three kinds of processing liquid deposited patterns P1, P2, and P3 formed on the recording medium A and the other areas. However, the respective line target areas LA and the other areas have processing liquid density distribution in the line direction. Therefore, even if the ink overlaps the processing liquid, a difference occurs in fixing of the ink, and hence line images having density distribution of the ink corresponding to the processing liquid density distribution are formed.

The recording medium B having such line images having the ink density distribution is scanned by the image scanning device 14 and converted into digital data to generate landing position determination data.

Next, in order to generate measurement result data, data of the line images is detected from such landing position determination data.

Figure 6:
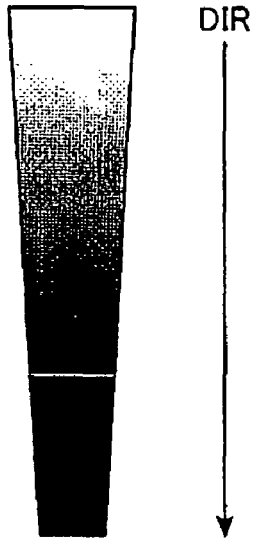
FIG. 6 is a diagram for describing distributions of a density and a line width of a line image.

In this example, only image data representing the line images L(12-1) to L(12-4), L(14-1) to L(14-4), and L(16-1) to L(16-4) illustrated in FIG. 6 is detected from the image data of the processing liquid landing position determination pattern illustrated in FIG. 5.

Among the detected line images, in a line image L1 [L(12-1) to L(12-3), L(14-1) to L(14-3), and L(16-1) to L(16-2)], the deposited processing liquid and the deposited ink overlap. However, the processing liquid dots have density distribution, and hence a difference occurs in fixing. Therefore, the line image L1 is a line image of colored inks including ink dots having density distribution and width distribution, in which directionality of the density distribution and directionality of the width distribution characteristic coincide with directionality of density distribution of the processing liquid dots.

On the other hand, among the detected line images, in an entire line image L2 [L(12-4), L(14-4), and L(16-4)], like the line image L1, the deposited processing liquid and the deposited ink overlap and the line image L2 has density distribution and the width distribution. However, the line image L2 is a line image of colored inks in which directionality of the density distribution and directionality of the width distribution characteristic are opposite to directionality of the density distribution of the processing liquid dots.

In an entire line image L3 [L(16-3)], the ink is deposited in an area without the processing liquid and is not fixed. The line image L3 is a so-called unprocessed image.

Density distribution, line width distribution, and a line width distribution characteristic of a line image, directionality thereof, and an unprocessed image are described with reference to FIG. 6.

FIG. 6 is a diagram of a normal line image having density distribution in which density changes from low to high in a direction DIR and line width distribution in which line width changes from wide to narrow in the direction DIR. The diagram of FIG. 6 is a line image formed when an ink of equal density overlap processing liquid having density distribution in which processing liquid density changes from high to low.

A line width distribution characteristic and a width distribution characteristic of the line image means that, when the line image has density distribution in which processing liquid density changes from high to low, the line image has width distribution in which the width of the line image (line width) changes from narrow to wide. A density distribution characteristic of the line image means that, when the line image has the same density distribution as described above, density distribution of the processing liquid density coincides with density distribution of the line image.

As described above, the processing liquid has the action of agglomerating and fixing color materials of colored inks on a recording medium.

Therefore, for example, when an ink of equal density is deposited on the recording medium A, which has the line target areas LA in which the processing liquid is deposited so as to have density distribution as illustrated in FIG. 4, from an upper side to a lower side of FIG. 6 by one ink nozzle to form an image, the line image having the density distribution and the width distribution as illustrated in FIG. 6 can be drawn.

On the other hand, for example, when an ink is deposited on an area outside the landing position determination target area TA in an arrow direction of FIG. 6 by one ink nozzle to form an image, a line image having density distribution and width distribution opposite to the line image having the density distribution and the width distribution illustrated in FIG. 6 is formed.

A line image in a non-deposited area on which the processing liquid is not deposited has, compared with line images having density distribution and width distribution, no directionality and has density invariable and lower than that of an image having lower density in the density distribution. The line image has no directionality and has invariable and larger width than that of an image having larger line width in the line width distribution (hereinafter, also referred to as unprocessed image).

Changes in the density and the line width of the line image formed on the line target areas LA in the landing position determination target area TA are described with reference to FIG. 7.

Figure 7:
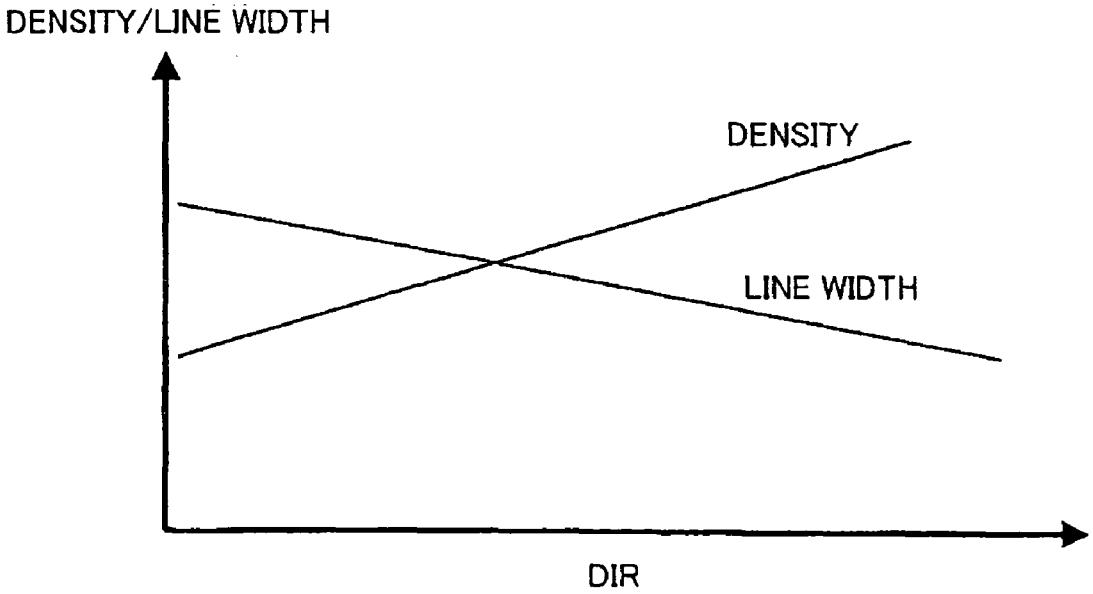
FIG. 7 is a graph of changes in the density and the line width of the line image illustrated in FIG. 6.

FIG. 7 is a graph representing a change in the density of the line image and a change in the line width of the line image in the direction DIR.

The density of the line image increases along the direction DIR. In other words, the density of the line image has directionality that coincides with directionality of a change in processing liquid density (gradation; distribution).

The line width of the line image decreases along the direction DIR. In other words, the line width of the line image has a line width distribution characteristic that directionality of the density increase of the change in processing liquid density (gradation; distribution) and directionality of the line width decrease coincide with each other.

The line image formed on the line target areas LA in the landing position determination target area TA and the line image formed on the area outside the landing position determination target area TA have the density distribution characteristic and the line width distribution characteristic in the opposite direction to each other.

The unprocessed image has density lower than the low density of the line image having the density distribution and/or the line width distribution and has width larger than the large width of such a line image.

This is because, as described above, when the ink is deposited on the area on which the processing liquid is not deposited, the ink does not fix thereon and tends to blur.

After data of the line images L(12-1) to L(12-4), L(14-1) to L(14-4), and L(16-1) to L(16-4) having such characteristics, densities and line widths of these line images L are measured to generate measurement result data.

In the measurement result data, the line images L(12-1) to L(12-3), L(14-1) to L(14-3), and L(16-1) to L(16-2) having the density distribution and/or line width distribution described above have the change in density and/or the change in line width, i.e., the density distribution characteristic and/or the line width distribution characteristic illustrated in FIGS. 6 and 7.

In the measurement result data, the line images L(12-4), L(14-4), L(16-4), and L(16-3) also have density distribution and line width distribution. However, directionality thereof is opposite to the directionality of the change in density and/or the directionality of the change in line width illustrated in FIGS. 6 and 7.

In the first embodiment, in the line images L(12-4), L(14-4), L(16-4), and L(16-3), the directionality of the density distribution and/or the directionality of the line width distribution only has to be known. Therefore, it is unnecessary to use a reference value of density and a reference value of line width, whereby accurate measurement is possible.

A method of determining landing positions of ejected liquid droplets of the target processing liquid nozzle in Step S6 of FIG. 3 with the use of the measurement result data and the feature data is described with reference to FIG. 8.

The feature data is described in detail later. As the measurement result data, data representing a result obtained by measuring the density and the line width of the line images illustrated in FIG. 5 is used.

Figure 8:
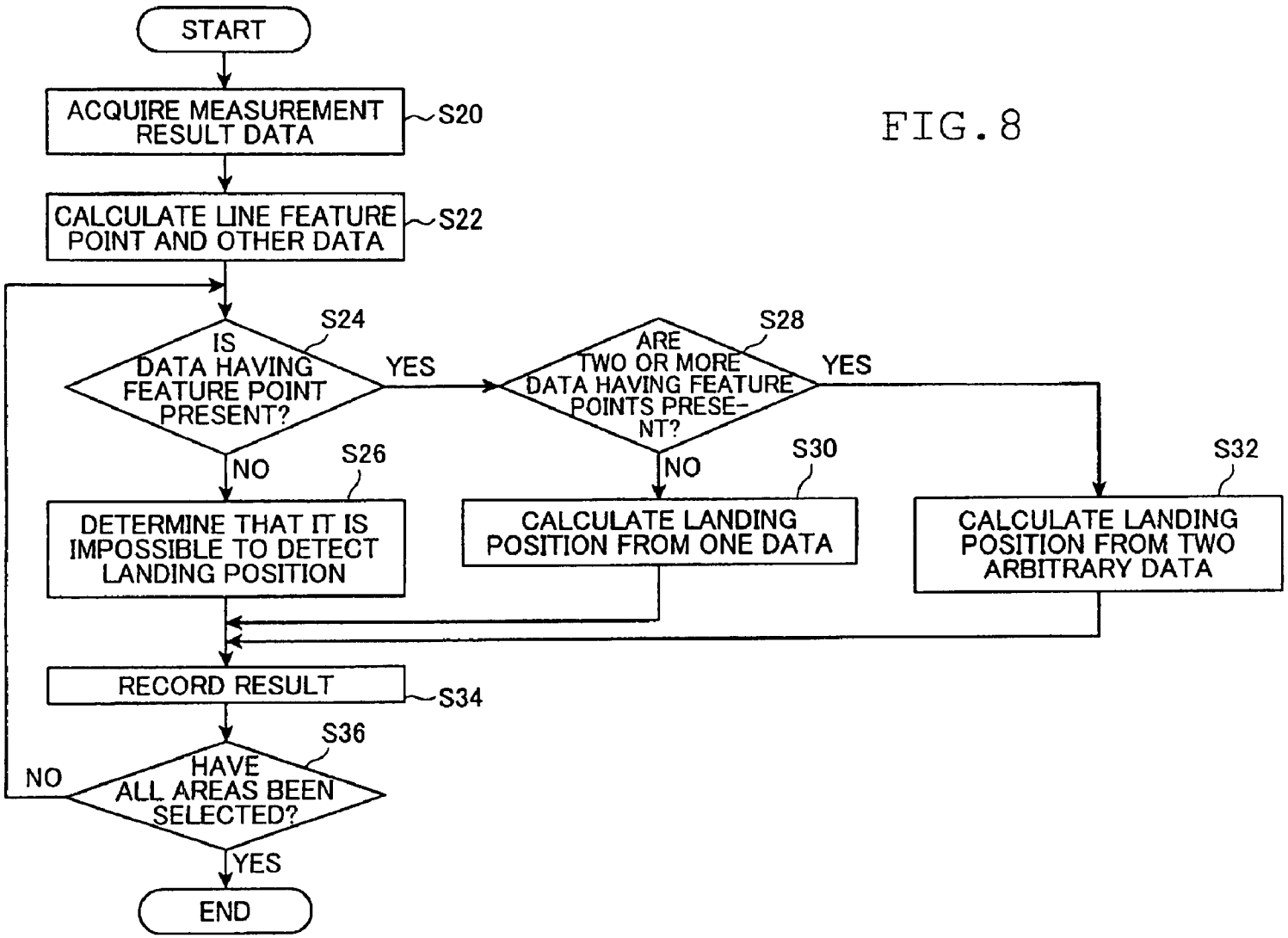
FIG. 8 is a flowchart of a method of determining a landing position of processing liquid ejected from one target processing liquid nozzle in the first embodiment.

FIG. 8 is a flowchart of an example of a landing position determining method for the target processing liquid nozzle.

First, in Step S20, the determining unit 28 acquires measurement result data. It is assumed that feature data necessary for the landing position determining method for the target processing liquid nozzle is already acquired (in Step S1 of FIG. 3).

Subsequently, in Step S22, the determining unit 28 selects, from the measurement result data, measurement result data of line images recorded by the corresponding ink nozzle and the test ink nozzles, i.e., in the first embodiment, measurement result data of line images present in the landing position determination target area TA, and calculates feature points of the line images (line feature points) and other data from density distribution and/or line width distribution of the selected line images. Examples of the other data include data necessary for the landing position determining method for the target processing liquid nozzle such as the length of the line images (line length), the length to the line feature points, the distance between the line images, and a position cpi of deposited dots corresponding to ink nozzles. A method of calculating the line feature points and the other data is described later. The position cpi of the deposited dots corresponding to the ink nozzles may be determined by position measurement and the like by another means in advance.

In Step S24, the determining unit 28 checks whether the line feature points, the line length, the length to the line feature points, and the like are present in the measurement result data of the selected line images.

When there is no measurement result data of the line images having the line feature points and the like, in Step S26, the determining unit 28 determines that it is impossible to determine a landing position of the processing liquid ejected from the target processing liquid nozzle.

On the other hand, when there is measurement result data of the line images having the line feature points and the like, in Step S28, the determining unit 28 further checks whether there are two or more such measurement result data.

When only one measurement result data of the line images having the line feature points and the like is confirmed, in Step S30, the determining unit 28 calculates, as a landing position of the processing liquid ejected from the target processing liquid nozzle, landing positions associated in advance with ink nozzles used for the recording of the measurement result data or landing positions calculated in advance.

When two or more measurement result data of the line images having the feature points and the like can be confirmed in Step S28, the determining unit 28 proceeds to Step S32 and calculates, using arbitrary two measurement result data, a landing position of the processing liquid ejected from the target processing liquid nozzle located in the line target area LA in the landing position determination target area TA formed by the target processing liquid nozzle.

A method of calculating a landing position of the processing liquid ejected from the target processing liquid nozzle using the arbitrary two measurement result data is described in detail later.

When the processing in any one of Steps S26, S30, and S32 is finished, in Step S34, a determination result of the landing position of the processing liquid ejected from the target processing liquid nozzle is recorded as landing position recording data.

Thereafter, in Step S36, the determining unit 28 determines whether selection of all the areas is completed. When the selection is not completed, the determining unit 28 returns to Step S24 and repeats Steps S24 to S36. When the selection is completed, the determining unit 28 finishes the series of landing position determination processing.

A method of calculating line feature points and various data in Step S22 of FIG. 8 is described with reference to FIGS. 9 to 12.

Figure 9:
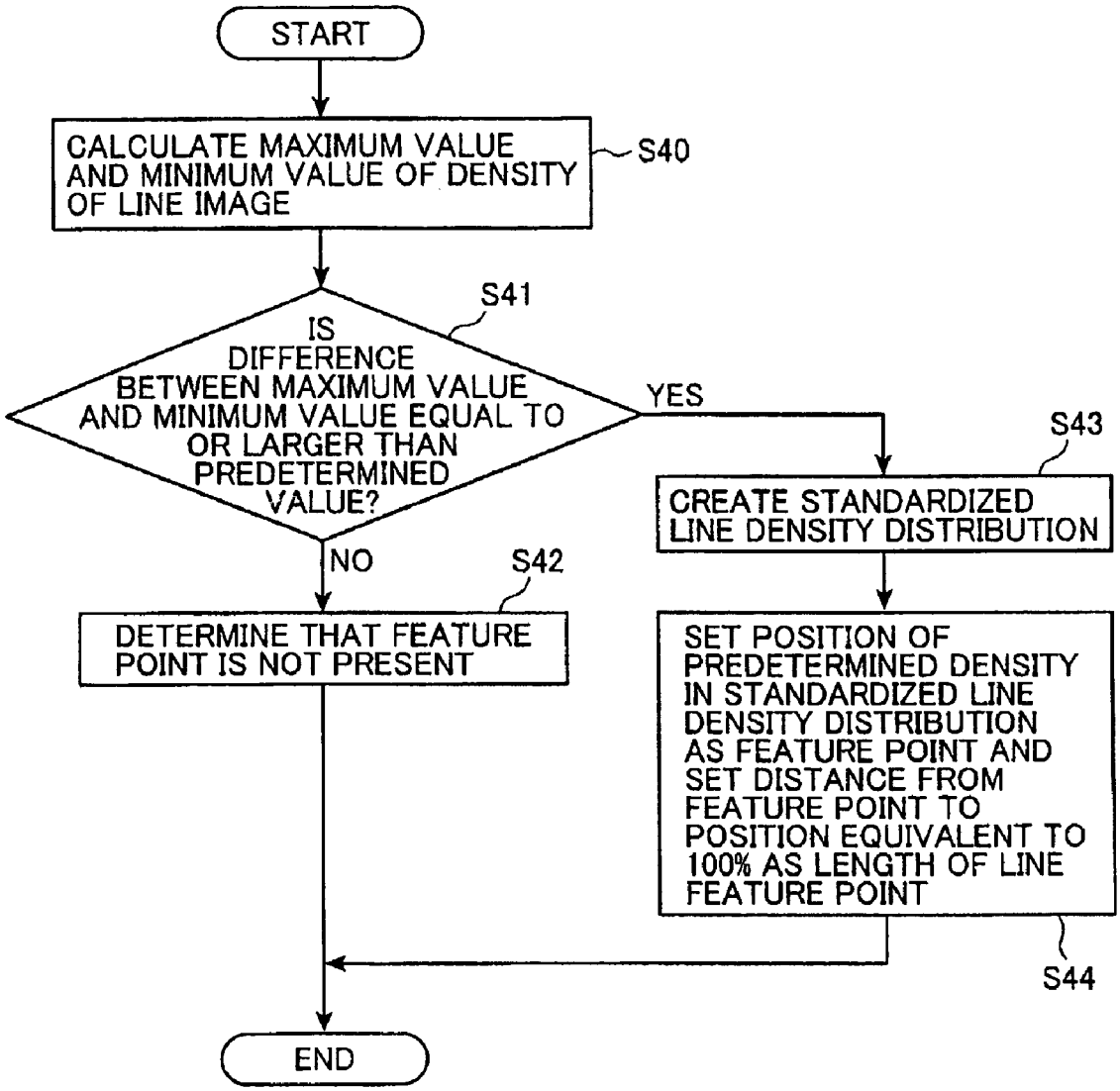
FIG. 9 is a flowchart of a method of calculating a line density feature point in the first embodiment.
Figure 10:
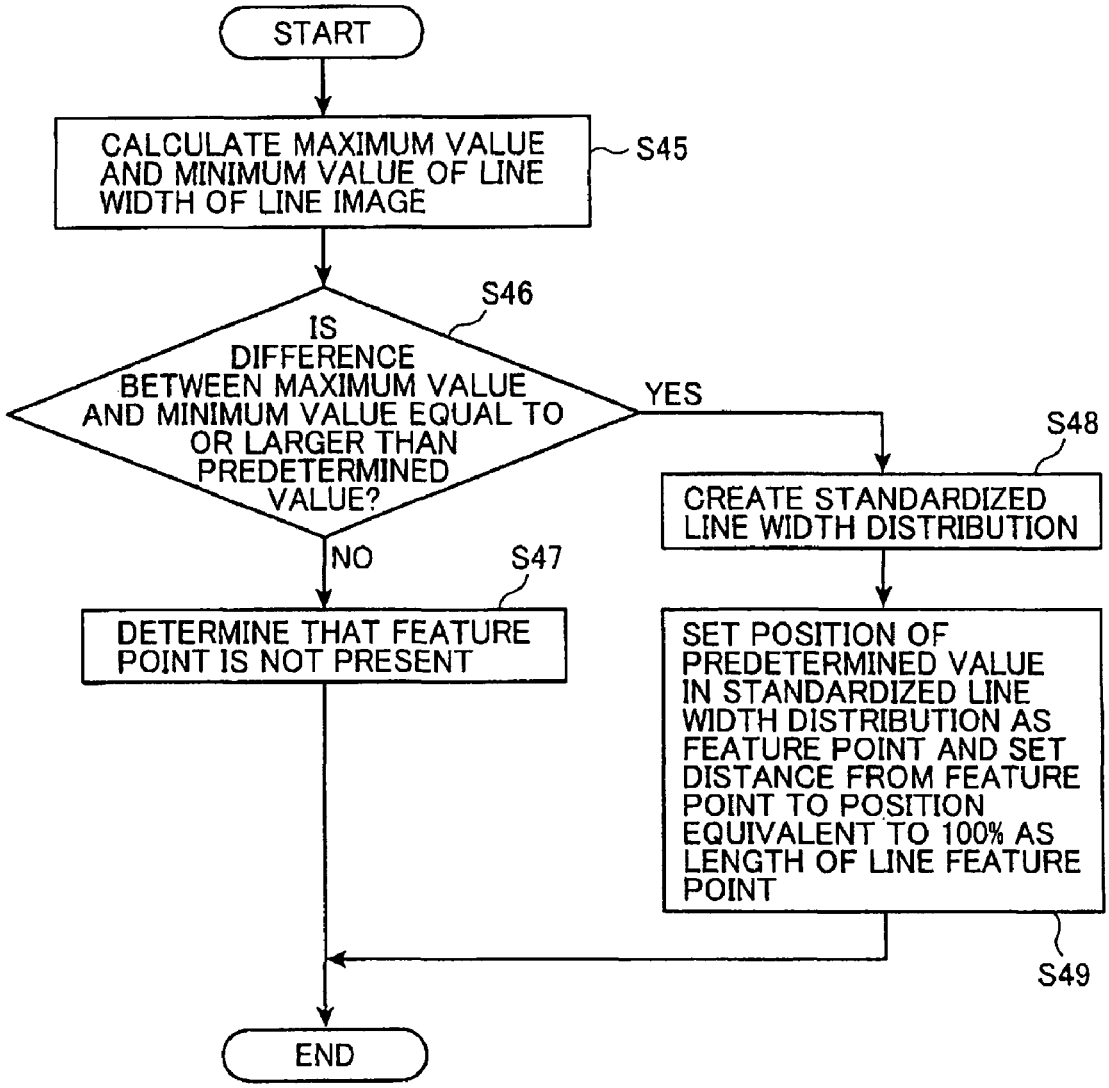
FIG. 10 is a flowchart of a method of calculating a line width feature point in the first embodiment.
Figure 11:
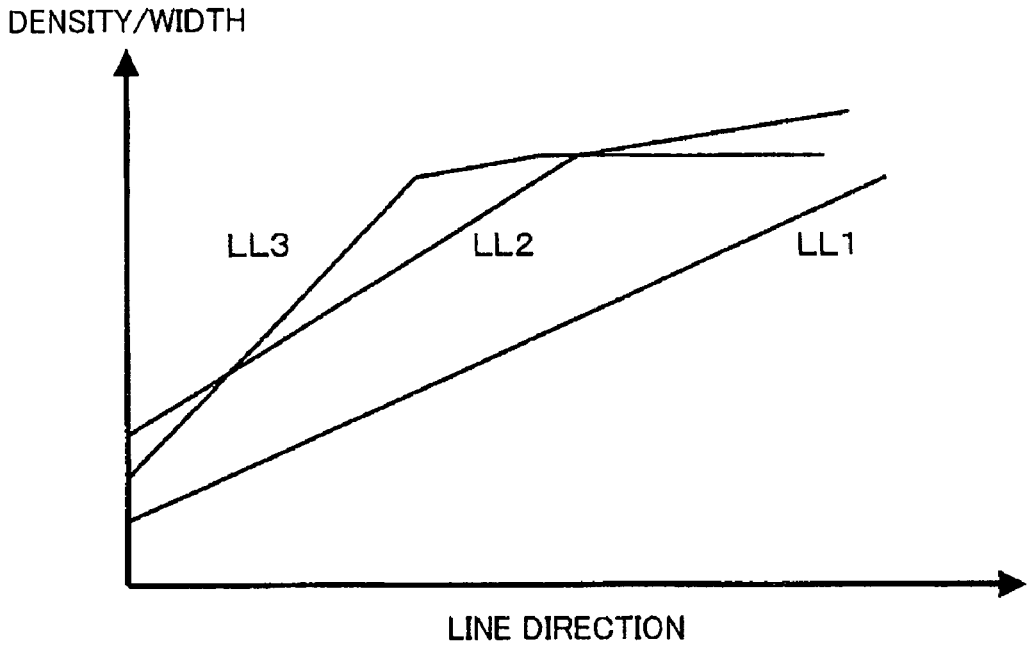
FIG. 11 is a graph of densities and widths of detected line images.
Figure 12:
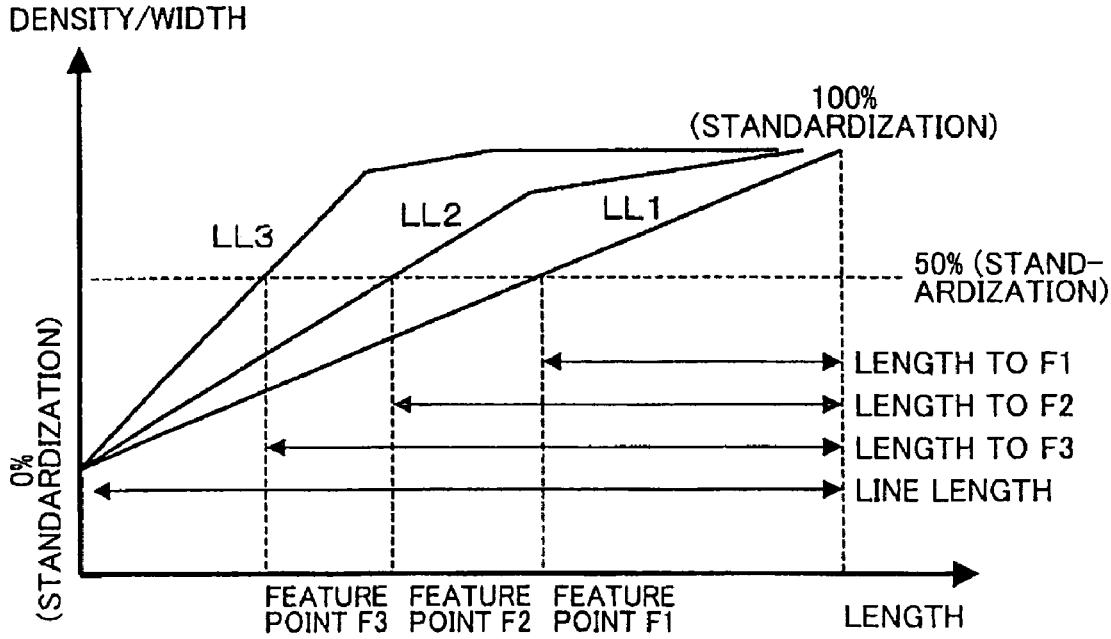
FIG. 12 is a graph of standardized densities and widths of the line images illustrated in FIG. 11.

FIGS. 9 and 10 are flowcharts of a method of calculating feature points of density and feature points of line width of a line image from measurement result data of the line image. FIGS. 11 and 12 are graphs for describing an example of the method of calculating feature points of density and feature points of line width of a line image.

First, in Step S40 of FIG. 9, the determining unit 28 calculates a maximum value and a minimum value of the density of a line image from measurement result data of the line image.

For example, as illustrated in FIG. 11, when densities in line directions of three line images (LL1, LL2, and LL3) are plotted on a graph, the three line images could have maximum values different from one another and minimum values different from one another. Therefore, for standardization, maximum values and minimum values of the densities of the respective line images are measured.

Subsequently, in Step S41, the determining unit 28 determines whether a difference between the maximum value and the minimum value of the density is equal to or larger than a predetermined value. When the difference is smaller than the predetermined value, in Step S42, the determining unit 28 determines that a feature point is not present in the line image and finishes the processing.

On the other hand, as a result of the determination in Step S41, when the difference between the maximum value and the minimum value of the density is equal to or larger than the predetermined value, in Step S43, the determining unit 28 creates line density distribution obtained by standardizing the maximum value and the minimum value of the density to 100% and 0%, respectively.

In Step S44, a position where the density becomes predetermined density in the standardized line density distribution is set as a feature point. A distance from the feature point to a position equivalent to 100% is set as the length to the line feature point.

In this way, as illustrated in FIG. 12, when there are a plurality of line images LL1, LL2, and LL3, it is possible to compare these line images by standardizing the maximum values and the minimum values of the line images. In an example illustrated in FIG. 12, with 50% set as predetermined density, feature points F1, F2, and F3 of the line images LL1, LL2, and LL3 are calculated.

Feature points of the line width of the line images can be calculated in the same manner.

First, in Step S45 of FIG. 10, the determining unit 28 calculates a maximum value and a minimum value of the line width from line width distribution of the line image in the measurement result data of the line image.

Subsequently, in Step S46, the determining unit 28 determines whether a difference between the maximum value and the minimum value of the line width is equal to or larger than a predetermined value. When the difference is smaller than the predetermined value, in Step S47, the determining unit 28 determines that a feature point is not present and finishes the processing.

On the other hand, as a result of the determination in Step S46, when the difference between the maximum value and the minimum value of the line width is equal to or larger than the predetermined value, in Step S48, the determining unit 28 creates line width distribution obtained by standardizing the maximum value and the minimum value of the line width to 100% and 0%, respectively.

In Step S49, the determining unit 28 sets a position at which the line width is predetermined line width in the standardized line width distribution, as a feature point of the line width and sets a distance from the feature point to a position equivalent to 100% as the length of the line feature point.

In FIG. 12, 50% (standardization) is selected as the predetermined density or the predetermined line width. However, the present invention is not limited to this.

The determining device 16 can determine a landing position of the processing liquid ejected by the target processing liquid nozzle as described above.

Specifically, a method of determining a landing position of the processing liquid ejected from the target processing liquid nozzle 32 (SN12) from measurement result data of the line images L(12-1) to L(12-4) of the area P1' illustrated in FIG. 5 is described.

First, as indicated in Step S22, the determining unit 28 selects the area P1' illustrated in FIG. 5 and acquires measurement result data of the line images L(12-1) to L(12-4).

Subsequently, as indicated in Step S24, the determining unit 28 checks whether there is data having density distribution and line width distribution (changes) of an image and, as a result, having feature points in the measurement result data of the line images L(12-1) to L(12-4).

As a result, the determining unit 28 can confirm the measurement result data of the line images L(12-1) to L(12-3) having feature points of the density and the line width of the image. Therefore, as indicated in Step S28, the determining unit 28 checks whether there are two or more such measurement result data.

The measurement result data of the line image L(12-4) does not have feature points of the density and the line width of the image. Therefore, at this point, the measurement result data of the line image L(12-4) is excluded from the measurement result data of the line images used for calculating a landing position of the processing liquid ejected from the target processing liquid nozzle.

The determining unit 28 can confirm three, i.e., two or more measurement result data of the line images L(12-1) to L(12-3) having the feature points of the density and the line width of the image. Therefore, as indicated in Step S32, the determining unit 28 calculates landing positions of the processing liquid ejected from the target processing liquid nozzle in combinations of the line images L(12-1) and L(12-3), the line images L(12-1) and L(12-2), and the line images L(12-2) and L(12-3) and sets an average of the landing positions as a landing position of the processing liquid ejected from the target processing liquid nozzle 32 (SN12).

Specifically, a method of determining a landing position of the processing liquid ejected from the target processing liquid nozzle 32 (SN16) from measurement result data of the line images L(16-1) to L(16-4) of the area P3' illustrated in FIG. 5 is described.

First, as indicated in Step S22, the determining unit 28 selects the area P2' illustrated in FIG. 5 and acquires measurement result data of the line images L(16-1) to L(16-4).

Subsequently, as indicated in Step S24, the determining unit 28 checks whether there is data having density distribution and line width distribution (changes) of an image and, as a result, having feature points in the measurement result data of the line images L(16-1) to L(16-4).

As a result, the determining unit 28 can confirm the measurement result data of the line images L(16-1) to L(16-3) having feature points of the density and the line width of the image. Therefore, as indicated in Step S28, the determining unit 28 checks whether there are two or more such measurement result data.

The measurement result data of the line images L(16-3) and L(16-4) do not have feature points of the density and the line width of the image. Therefore, at this point, the measurement result data of the line images L(16-3) and L(16-4) are excluded from the measurement result data of the line images used for scanning a landing position of the processing liquid ejected from the target processing liquid nozzle.

The determining unit 28 can confirm two, i.e., two or more measurement result data of the line images L(16-1) and L(16-2) having the feature points of the density and the line width of the image. Therefore, as indicated in Step S32, the determining unit 28 calculates a landing position of the processing liquid ejected from the target processing liquid nozzle in combination of the line images L(16-1) and L(16-2) and sets the calculated value as a landing position of the processing liquid ejected from the target processing liquid nozzle 32 (SN16) with respect to the processing liquid dot formed by the target processing liquid nozzle 32 (SN16).

When measurement result data of the line images L(14-1) to L(14-4) of the area P2' illustrated in FIG. 5 are selected, it is also possible to determine a landing position of the processing liquid ejected from the target processing liquid nozzle 32 (SN14) from the measurement result data in the same manner.

A method of calculating a landing position of the processing liquid ejected from the target processing liquid nozzle with the use of arbitrary two measurement result data is described in detail.

In order to calculate a landing position of the processing liquid deposited from a processing liquid nozzle selected as a landing position detection target area of the target processing liquid nozzle in the recording medium A, as illustrated in FIG. 12, the length from one end (standardization 100%) of a line image represented by measurement result data of a selected line image to a feature point, line length of the line image, and a separation distance between line images represented by measurement result data of selected two line images are used.

A method of calculating the length from one end (standardization 100%) of the line image to the feature point (hereinafter, simply referred to as length to feature point) or the line length of the line image is not particularly limited. However, besides the standardization, for example, there is employed a method of calculating the length to the feature point and the line length with the use of pattern data of a processing liquid deposited pattern.

Similarly, a method of calculating the separation distance between line images is not particularly limited. However, there is employed a method of calculating the separation distance with the use of pattern data of a processing liquid deposited pattern.

Next, a method of calculating a landing position of the processing liquid ejected from the target processing liquid nozzle is described.

Two line images having feature points of the density and the line width of an image are selected from selected line images, the length to the feature points and the line length are calculated for each of the two line images, and a separation distance between the selected two line images is calculated. A landing position of the processing liquid deposited from the target processing liquid nozzle only has to be calculated by using values of the length to the feature points, the line length, and the separation distance and landing positions of colored inks determined in advance in association with ink nozzles that record the selected two line images.

When there are three or more line images having feature points, an average of landing positions of the processing liquid ejected from the processing liquid nozzles respectively calculated for a plurality of combinations of two line images only has to be set as a deposited position of the processing liquid deposited from the target processing liquid nozzle.

As a specific example of the calculation method, a method of calculating a landing position of the processing liquid ejected from the target processing liquid nozzle with the use of the length to a feature point of a line image, the line length of the line image, a separation distance between line images, and feature data is described.

Figure 13:
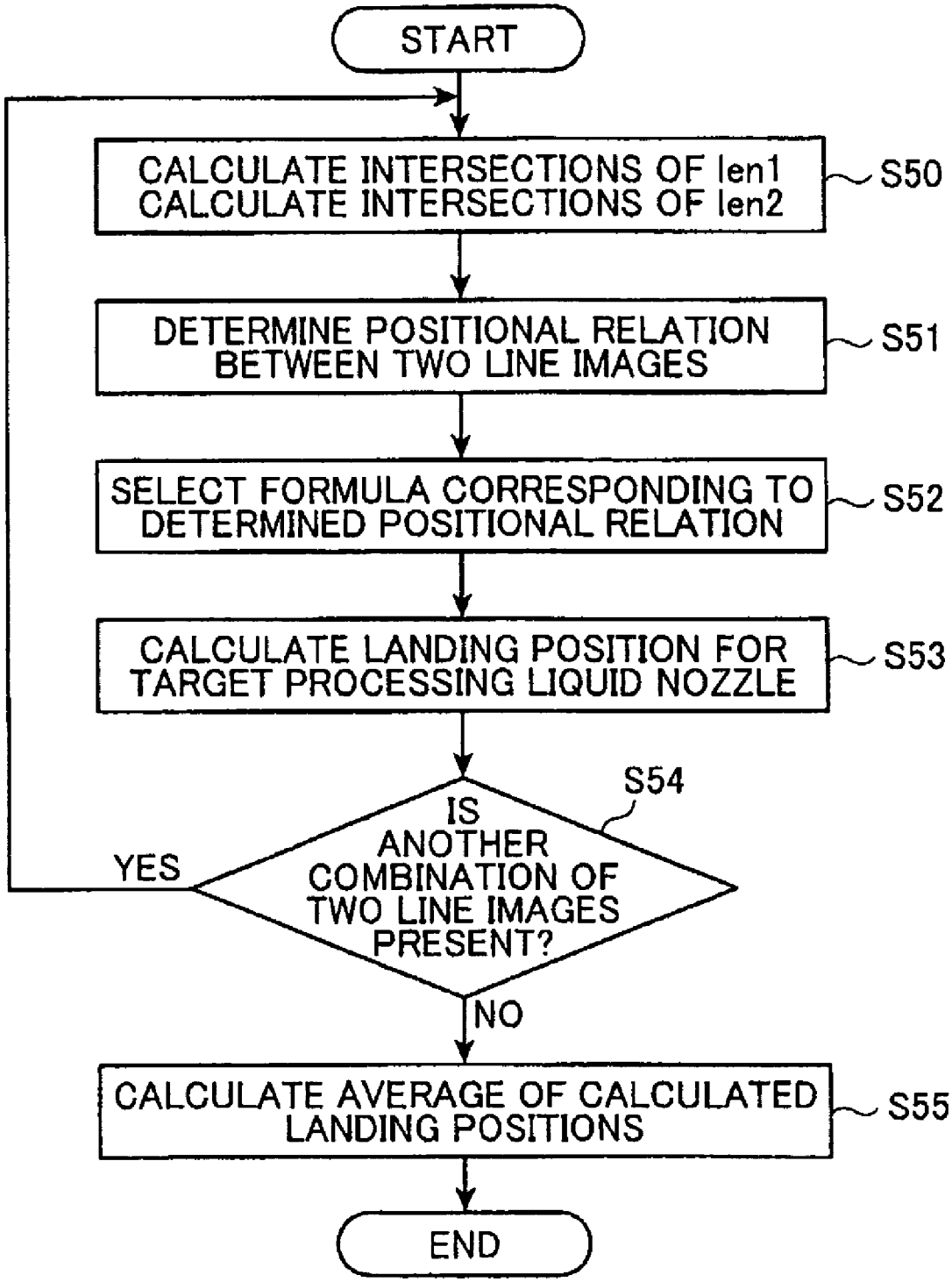
FIG. 13 is a flowchart of a method of calculating a landing position of the processing liquid ejected from a target processing liquid nozzle in the first embodiment.

FIG. 13 is a flowchart of a method of detecting a landing position of the processing liquid ejected from the target processing liquid nozzle with the use of measurement result data of arbitrary two line images.

Here, one line image of the two line images is represented as the line image len1 and the other line image is represented as the line image len2.

Figure 14:
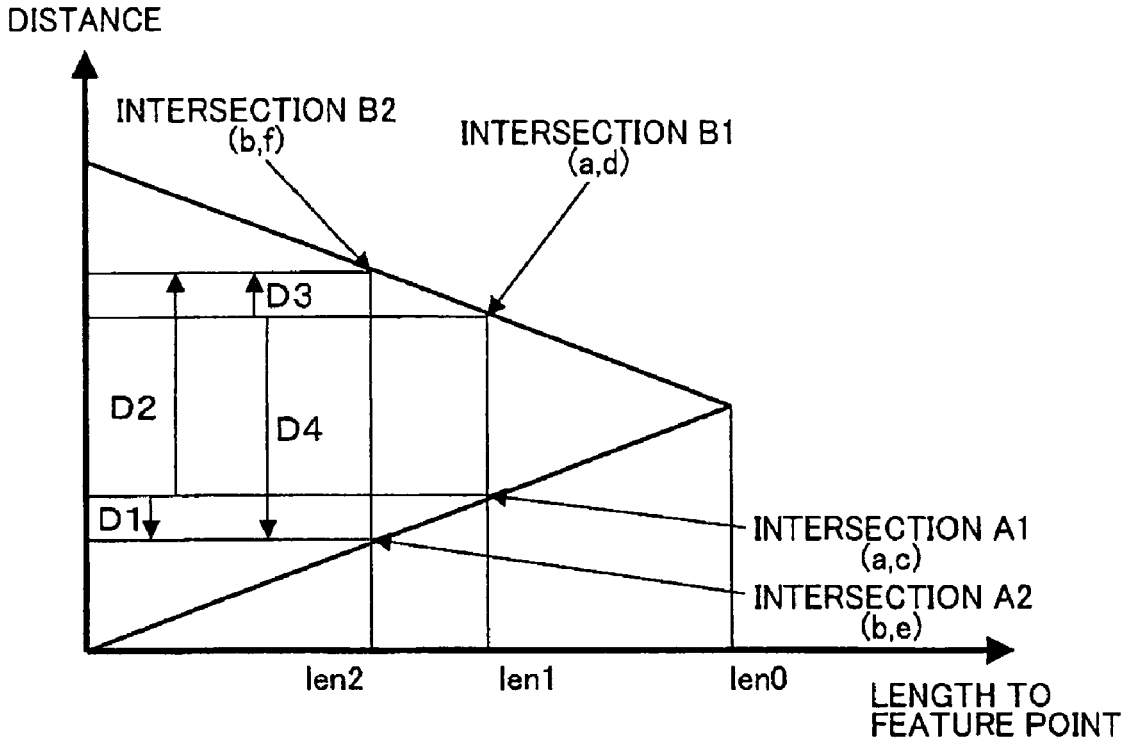
FIG. 14 is a graph for describing the method of calculating the landing position of the processing liquid ejected from the target processing liquid nozzle in the first embodiment.

First, as indicated in Step S50 of FIG. 13, the determining unit 28 calculates intersections A1 and B1 of the line image len1 and intersections A2 and B2 of the line image len2 on the basis of feature data of a feature point illustrated in FIG. 14.

The feature data of the feature point indicates a relation, as illustrated in FIG. 14, between the length to a feature point of a lie image recorded in a recording medium and a separation distance between two line images.

For example, the determining unit 28 calculates the length to a feature point of the line image len1 on the recording medium from image data of the line image len1. When the length is "a", the determining unit 28 calculates a separation distance between line images at the length "a" to the feature point with the use of a graph illustrated in FIG. 14. If values of the separation distance in this case are "c" and "d" (c<d), the intersection A1 is (a, c) and the intersection B1 is (a, d).

On the other hand, the determining unit 28 calculates the length to a feature point of the line image len2 on the recording medium from image data of the line image len2. When the length is "b", the determining unit 28 calculates a separation distance between line images at the length "b" to the feature point with the use of a graph illustrated in FIG. 14. If values of the separation distance in this case are "e" and "f" (e<f), the intersection A2 is (b, e) and the intersection B2 is (b, f).

Subsequently, as indicated in Step S51, the determining unit 28 calculates D1 to D4 with the use of the intersections A1, A2, B1, and B2. The determining unit 28 selects values close to the separation distance of the line image len1 and the line image len2 calculated for deposited position or the like of an ink in advance out of D1 to D4 and determines a positional relation between the line image len2 and the line image len1.

A method of calculating D1 to D4 is D1=(intersection A2−intersection A1), D2=(intersection B2−intersection A1), D3=(intersection B2−intersection B1), and D4=(intersection A2−intersection B1).

Subsequently, as indicated in Step S52, the determining unit 28 selects formulae corresponding to the determined positional relation between the line image len2 and the line image len1.

When the determined positional relation between the line image len2 and the line image len1 is a relation between the intersection A1 and the intersection A2 or between the intersection B1 and the intersection B2, the following formulae are used:

$$s=(T_{len1}-T_{len2})/(T_{len0}-T_{len2}) \quad (1)$$

$$t=(T_{len0}-T_{len1})/(T_{len0}-T_{len2}) \quad (2)$$

$$p=cp1-(t/s)*cp2 \quad (3)$$

When the determined positional relation between the line image len2 and the line image len1 is a relation between the intersection A1 and the intersection B2 or between the intersection B1 and the intersection A2, the following formulae are used:

$$s=(T_{len0}-T_{len1})/(2T_{len0}-T_{len1}-T_{len2}) \quad (4)$$

$$t=(T_{len0}-T_{len2})/(2T_{len0}-T_{len1}-T_{len2}) \quad (5)$$

$$p=cp1*t+cp2*s \quad (6)$$

After selecting the formulae, as indicated in Step S53, the determining unit 28 calculates a landing position p of the processing liquid ejected from the target processing liquid nozzle with the use of the formulae selected in Step S52.

$T_{len0}$ in Formulae (1), (2), (4), and (5) is line length of a line image corresponding to the target processing liquid nozzle. $T_{len1}$ is the length to a feature point 1 of the line image len1 and $T_{len2}$ is the length to a feature point of the line image len2.

cp1 and cp2 in Formulae (3) and (6) represent positions of deposited dots of the line images len1 and len2, respectively. A method of calculating cp1 and cp2 is not specifically limited, but cp1 and cp2 are calculated in advance.

When the landing position of the processing liquid ejected from the target processing liquid nozzle can be calculated, as indicated by Step S54, the determining unit 28 checks whether there is another combination of arbitrary two line images.

When there is another combination of arbitrary two line images, the determining unit 28 returns to Step S50 and repeats Steps S50 to S54.

When the processing is performed for all combinations of arbitrary two line images out of all the line images, in Step S55, the determining unit 28 calculates an average of the calculated deposited positions of the processing liquid nozzles. The determining unit 28 calculates this average as a landing position of the processing liquid ejected from the target processing liquid nozzle on dots in a processing liquid non-deposited area located in a boundary between a processing liquid deposited area and a processing liquid non-deposited area of a linear position detection target area formed by the target processing liquid nozzle.

As described above, it is possible to accurately detect a landing position of the processing liquid ejected from the target processing liquid nozzle on the basis of the length to the feature points of the density and the line width of the line image.

In other words, it is possible to determine a landing position of the processing liquid ejected from the target processing liquid nozzle without using absolute values of the density and the line width of the line image. Therefore, it is possible to perform measurement on various recording media.

Further, in addition to the detection of a landing position of the processing liquid ejected from the target processing liquid nozzle, it is also possible to determine an ejection state of the target processing liquid nozzle and the corresponding ink nozzle and a relation of deposited positions between the target processing liquid nozzle and the corresponding ink nozzle.

For example, when it is confirmed in Step S28 of FIG. 8 that measurement result data of a line image having a feature point is present in the measurement result data of the selected line image, it is possible to determine that a processing liquid nozzle that ejects the processing liquid to an area of the line image having the feature point and a corresponding ink nozzle that records the line image having the feature point normally eject the processing liquid and the link. Further, it is possible to determine that landing positions of the processing liquid and the ink from the processing liquid nozzle and the corresponding ink nozzle overlap.

Figure 15:
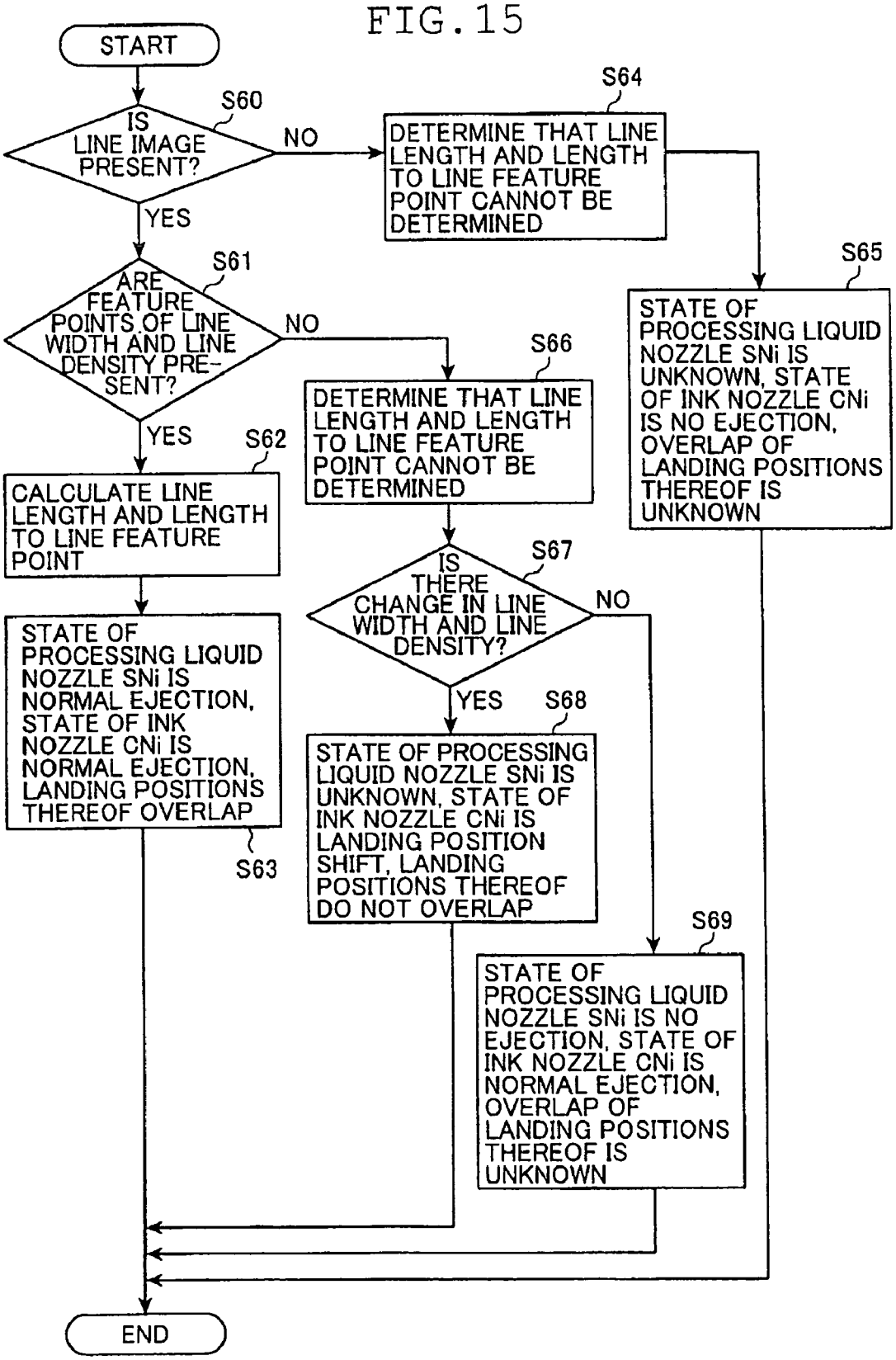
FIG. 15 is a flowchart of a method of determining ejection states of the target processing liquid nozzle and a target ink nozzle in the first embodiment.

A method of determining ejection states of the processing liquid nozzle and the corresponding ink nozzle is described with reference to FIG. 15. This determination may be performed before the landing position determination for the processing liquid nozzle according to this embodiment is performed or may be performed after the landing position determination is performed.

First, in Step S60, the determining unit 28 determines whether a line image is present. When a line image is present, in Step S61, the determining unit 28 determines whether there are feature points of line width and line density of the line image.

When there are feature points, in Step S62, the determining unit 28 calculates line length of the line image and the length to the line feature points.

Further, in Step S63, the determining unit 28 determines that a processing liquid nozzle SNi (i represents a nozzle number) performs normal ejection, an ink nozzle CNi performs normal ejection, and landing positions of the processing liquid and the ink ejected from the processing liquid nozzle SNi and the ink nozzle CNi overlap.

On the other hand, when a line image is not present in Step S60, in Step S64, the determining unit 28 determines that line length of the line image and the length to the line feature points cannot be determined. In Step S65, the determining unit 28 determines that an ejection state of the processing liquid nozzle SNi is unknown, the ink nozzle CNi does not perform ejection, and overlap of landing positions of the processing liquid and the ink ejected from the processing liquid nozzle SNi and the ink nozzle CNi is unknown.

When there is no feature points of the line width and the line density of the line image in Step S61, in Step S66, the determining unit 28 determines that line length of the line image and the length to the line feature points cannot be determined. In Step S67, the determining unit 28 determines whether there is a change in the line width and the line density of the line image.

When it is determined in Step S67 that there is a change in the line width and the line density, in Step S68, the determining unit 28 determines that an ejection state of the processing liquid nozzle SNi is unknown, a landing position of the ink ejected from the ink nozzle CNi shifts, and landing positions of the processing liquid and the ink ejected from the processing liquid nozzle SNi and the ink nozzle CNi do not overlap.

On the other hand, when it is determined in Step S67 that there is no change in the line width and the line density, in Step S69, the determining unit 28 determines that the processing liquid nozzle SNi does not perform ejection, the ink nozzle CNi performs normal ejection, and overlap of landing positions of the processing liquid and the ink ejected from the processing liquid nozzle SNi and the ink nozzle CNi is unknown.

In this way, it is possible to determine ejection states of the processing liquid nozzle and the ink nozzle and a relation between landing positions of the processing liquid and the ink.

In particular, it is possible to perform stable determination by determining ejection states of an ink nozzle that records a line image without a feature point and a processing liquid nozzle corresponding to the ink nozzle and a relation between the ink and the processing liquid ejected by the ink nozzle and the processing liquid nozzle as described above using the density and the line width of a line image, which is a normal image entirely, like the line image L(16-4) illustrated in FIG. 5 not used in determining a landing position.

As described above, according to the first embodiment, it is possible to accurately determine a landing position of the processing liquid. Further, when the landing position is determined, absolute values of the density and the line width of the line image recorded by the recording unit do not have to be used. Therefore, it is possible to accurately determine a landing position of the processing liquid in various recording media.

A test image represented by landing position determination data used for determining a landing position of the processing liquid ejected from the target processing liquid nozzle has a very small portion in which the ink and the processing liquid overlap. Therefore, it is possible to prevent the ink from adhering to conveying means or the like for a recording medium without fixing on the recording medium because of lack of the processing liquid.

In the first embodiment, three alternate processing liquid nozzles among a large number of arrayed processing liquid nozzles are selected as the target processing liquid nozzles. However, the present invention is not limited to this. The number of processing liquid nozzles selected as target processing liquid nozzles and a separation distance among the respective target processing liquid nozzles only have to be appropriately determined according to a total number of processing liquid nozzles and the size of a recording medium.

Second Embodiment

A landing position determining method for a processing liquid nozzle according to a second embodiment of the present invention is described below with reference to FIG. 16.

In the following description, differences from the first embodiment are mainly described. Description of components and processing same as those in the first embodiment is omitted to simplify description.

Figure 17:
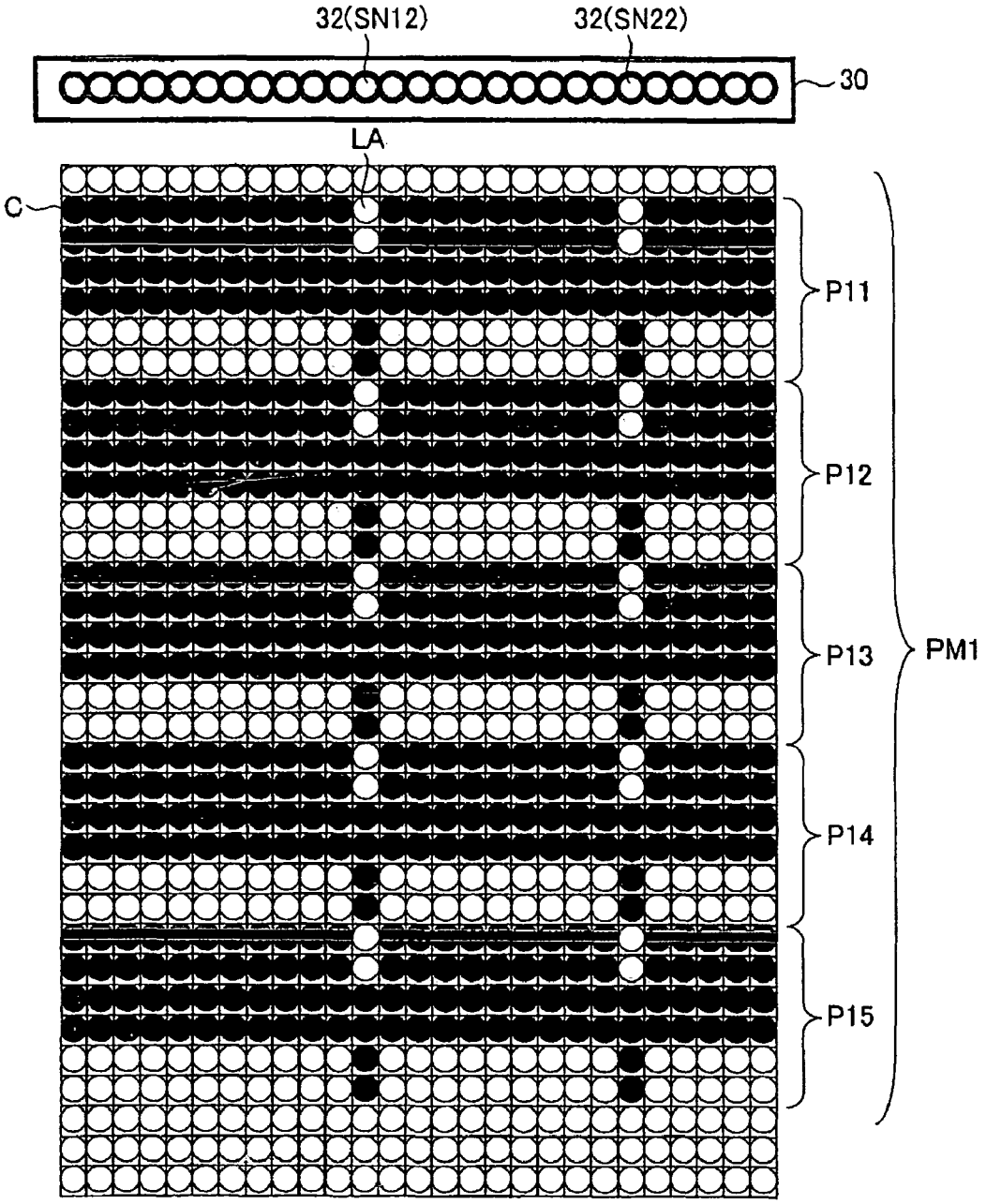
FIG. 17 is a schematic diagram of a recording medium on which a processing liquid deposited pattern is formed and a processing liquid head in the second embodiment.

In the second embodiment, a processing liquid deposited pattern is set so that a line target area is formed which has density distribution (gradation) obtained by continuously depositing, while gradually changing the density of deposited processing liquid to be high or low in one direction, the processing liquid for a predetermined number of dots by each of processing-liquid ejection nozzles selected not to be adjacent to one another as landing position determination targets of the deposited processing liquid out of all processing-liquid ejection nozzles and so that the remaining processing-liquid ejection nozzles not selected as the landing position determination targets continuously deposit the processing liquid while the density of the processing liquid is changed in an opposite direction from that in the line target area (has density distribution) (see FIG. 17 referred to later).

When directionality of processing liquid density distribution of a linear landing position determination target area formed by a processing liquid nozzle coincides with at least one of directionality of density distribution of a line image formed by an ink nozzle and directionality of line width distribution of the line image (the line width decreases as the density increases), the determining unit 28 determines a landing position of processing liquid droplets ejected by the processing liquid nozzle as a position of the line image.

Figure 16:
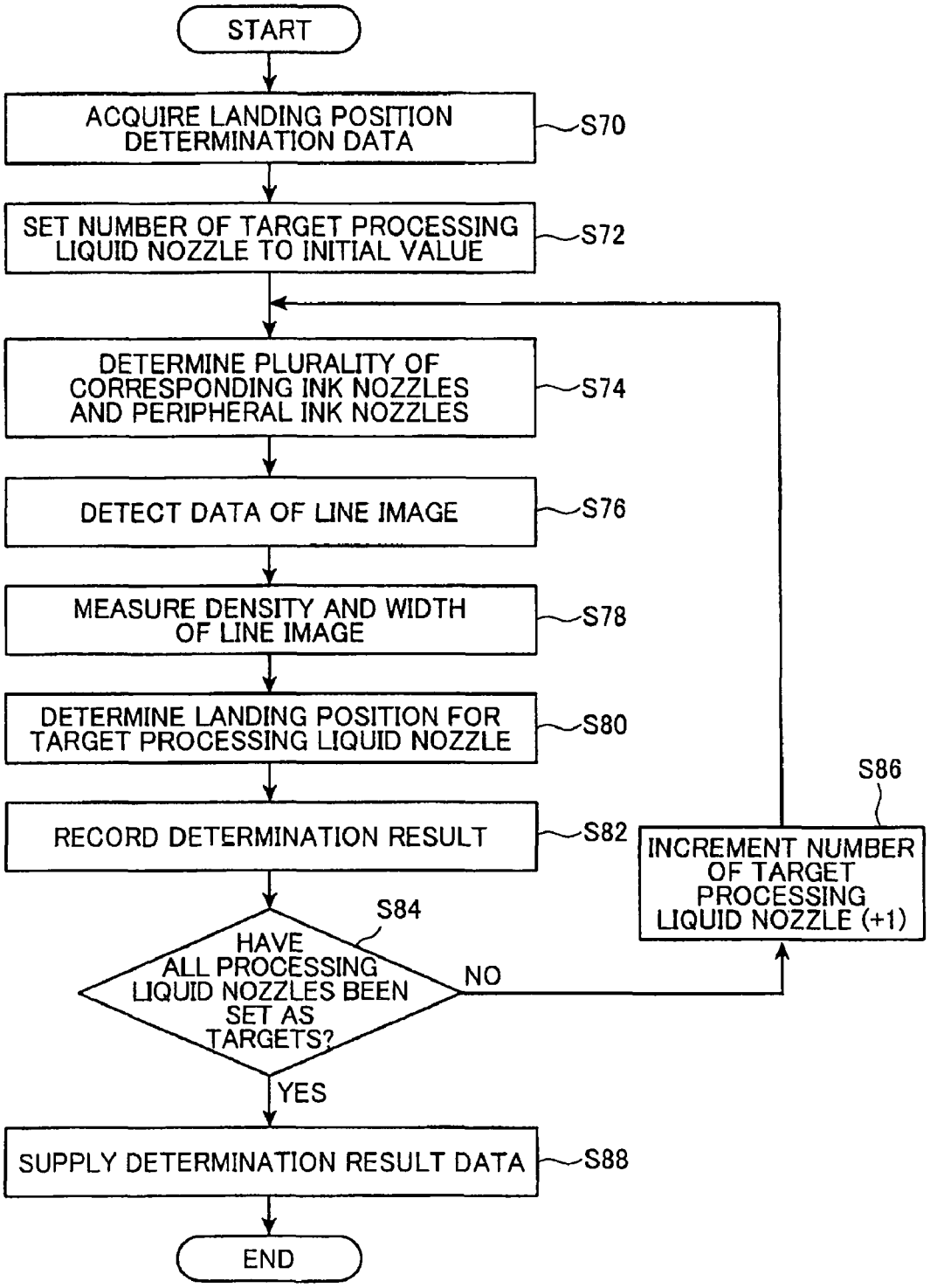
FIG. 16 is a flowchart of a landing position determining method for processing liquid nozzles in a second embodiment of the present invention.

First, in Step S70 of FIG. 16, the data acquiring unit 22 acquires landing position determination data from the image scanning device 14.

The landing position determination data used in the second embodiment is described in detail later.

Subsequently, in Step S72, the nozzle setting unit 18 sets a number of a target processing liquid nozzle to an initial value.

In Step S74, the nozzle setting unit 18 determines a plurality of ink nozzles that deposit an ink on processing liquid deposited by the target processing liquid nozzle (hereinafter, also simply referred to as a plurality of corresponding ink nozzles) and ink nozzles around the target processing liquid nozzle (hereinafter, also simply referred to as peripheral ink nozzles).

A method of determining a corresponding ink nozzle is not specifically limited. As an example, there is a method of determining a plurality of corresponding ink nozzles and peripheral ink nozzles using arrangement data of processing liquid nozzles and ink nozzles.

Subsequently, in Step S76, the line detecting unit 24 detects, from the landing position determination data, data of a line image (hereinafter, also simply referred to as line data) printed on a recording medium with the plurality of corresponding ink nozzles and the peripheral ink nozzles determined in Step S74 and supplies the data to the line measuring unit 26.

After that, in Step S78, the line measuring unit 26 measures the density and the line width of the line image recorded in the supplied line data, records a result of the measurement in measurement result data, and supplies the measurement result data to the determining unit 28.

Subsequently, in Step S80, the determining unit 28 determines a landing position of the processing liquid ejected from the target processing liquid nozzle using the measurement result data supplied from the line measuring unit 26.

A method of determining a landing position of the processing liquid ejected from the target processing liquid nozzle in the second embodiment is described in detail later.

In Step S82, the determining unit 28 records a result obtained in Step S80 in determination result recording data.

In Step S84, the nozzle setting unit 18 determines whether all the processing liquid nozzles are set as target processing liquid nozzles.

When it is not determined that all the processing liquid nozzles are set as target processing liquid nozzles, in Step S86, the nozzle setting unit 18 increments the number of target processing liquid nozzle by one. The nozzle setting unit 18 returns to Step S74 and repeats Steps S74 to S84.

When it is determined in Step S84 that all the processing liquid nozzles are set as target processing liquid nozzles, in Step S88, the nozzle setting unit 18 supplies the determination result recording data to the storing unit 29 and finishes the determination of a depositing position of the processing liquid ejected from the target processing liquid nozzle.

A method of determining a landing position of the processing liquid ejected from the target processing liquid nozzle indicated by Step S80 of FIG. 16 is described.

As described above, measurement result data is used for the determination of a landing position of the processing liquid ejected from the target processing liquid nozzle. As described above, the measurement result data is data representing a result obtained by detecting data of a line image (line data) from the landing position determination data and measuring the density and the width of the detected line image. First, the landing position determination data is described.

The landing position determination data in the second embodiment is digital data representing an image formed by depositing, with the corresponding ink nozzle and the peripheral ink nozzles, the ink on a specific area of a recording medium C on which the processing liquid is deposited in a pattern shape.

A method of generating landing position determination data is not specifically limited. An example of the method is described with reference to FIGS. 17 and 18.

FIG. 17 is a schematic diagram of the recording medium C on which the processing liquid is deposited in a specific pattern shape excluding a predetermined area and a processing liquid head including twenty-seven processing liquid nozzles.

The recording medium C illustrated in FIG. 17 is a recording medium on which one kind of processing liquid deposited pattern including the line target area LA having density distribution in a predetermined direction is repeatedly formed five times only in a processing liquid deposited line formed by the target processing liquid nozzle.

Figure 18:
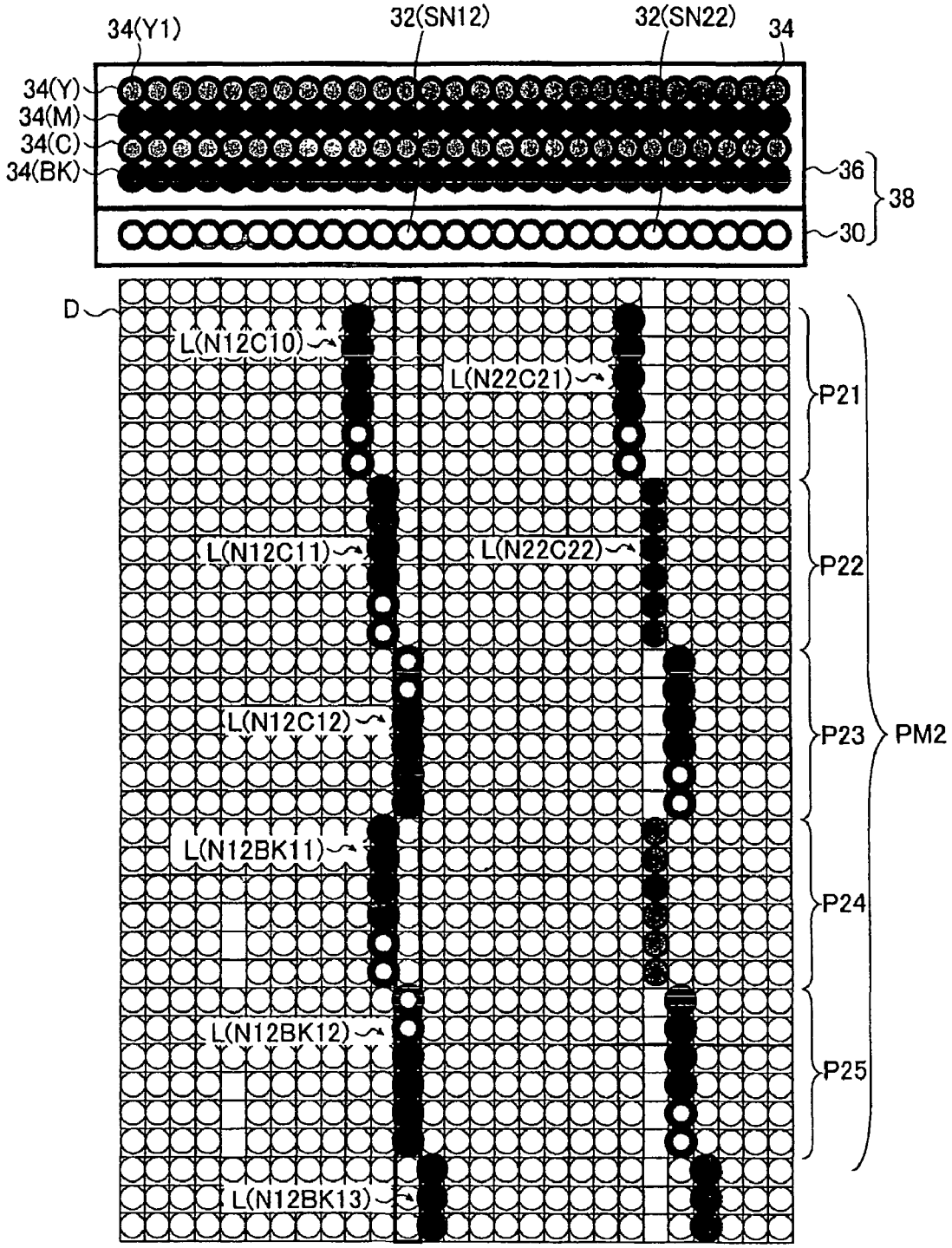
FIG. 18 is a schematic diagram of a recording medium on which a landing position determination pattern is formed and an ejection head in the second embodiment.

FIG. 18 is a schematic diagram of a recording medium D including a processing liquid landing position determination pattern having a line image formed by depositing the ink with the plurality of corresponding ink nozzles corresponding to the target processing liquid nozzle and the ink nozzles located around the target processing liquid nozzle and the ejection head 38.

The ejection head 38 includes the processing liquid head 30 and the ink head 36.

First, for example, the recording medium C including the processing liquid deposited pattern in which the line target area LA is formed as illustrated in FIG. 17 is generated by depositing, with the image recording unit 12, the processing liquid with the processing liquid nozzles of the processing liquid head.

The recording medium D including a processing liquid deposited pattern having a plurality of line target areas LA is formed by using the above-mentioned recording medium C and the processing liquid nozzles.

For example, as illustrated in FIG. 17, when the processing liquid nozzles 32 with the numbers SN12 and SN22 are set as target processing liquid nozzles, the processing liquid nozzles 32 with the numbers SN12 and SN22 are set to eject the processing liquid so that the line target areas LA having density distribution in which density increases in a predetermined direction, in the example illustrated in FIG. 17, in an up to down direction are formed only in second to seventh rows, eighth to thirteenth rows, fourteenth to nineteenth rows, twentieth to twenty-fifth rows, and twenty-sixth to thirty-first rows. The other processing liquid nozzles are set to eject the processing liquid so that line target areas have density distribution in a direction opposite to that in the line target areas LA. The processing liquid head 30 and the recording medium C are relatively moved to generate the recording medium C by depositing the processing liquid over the entire surface of the recording medium C.

In this way, on the recording medium C illustrated in FIG. 17, a processing liquid deposited pattern is formed by repeating five times the processing liquid deposited pattern in which the line target areas LA having density distribution, in which density increases in a predetermined direction, in the example illustrated in FIG. 17, in an up to down direction, are formed in the second to thirty-first rows formed by the processing liquid nozzles 32 with the numbers SN12 and SN22.

The ink is deposited on the recording medium C, on which the processing liquid deposited pattern is formed as illustrated in FIG. 17, by the plurality of corresponding ink nozzles 34 and the peripheral ink nozzles 34 of the target processing liquid nozzles 32 with the numbers SN12 and SN22 to form a line image, whereby the recording medium D on which a processing liquid landing position detection pattern having the line image is formed is generated. In this case, the plurality of ink nozzles 34 corresponding to the target processing liquid nozzles 32 and the peripheral ink nozzles 34 deposit the ink only in a processing liquid deposited pattern portion in which the target processing liquid nozzles 32 form the line target areas LA rather than depositing the ink in all the first to thirty-fourth rows.

As illustrated in FIG. 18, the ink head 36 has lines, in which the twenty-seven ink nozzles 34 are linearly arranged, in order of black (BK), cyan (C), magenta (M), and yellow (Y) from the bottom of FIG. 18.

Numbers of the ink nozzles 34 in a black line are BK1, BK2, . . . , and BK27 from the left of FIG. 18. Numbers of the ink nozzles 34 in a cyan line are C1, C2, . . . , and C27 from the left of FIG. 18. Numbers of the ink nozzles 34 in a magenta line are M1, M2, . . . , and M27 from the left of FIG. 18. Numbers of the ink nozzles 34 in a yellow line are Y1, Y2, . . . , and Y27 from the left of FIG. 18.

When such an ink head 36 as described above is used, for example, if the target processing liquid nozzle 32 is the processing liquid nozzle 32 (SN12), the corresponding ink nozzles 34 are the ink nozzles 34 (C12 and BK12) and the peripheral ink nozzles 34 are, for example, the ink nozzles 34 (C10, C11, BK11, and BK13). If the target processing liquid nozzle 32 is the processing liquid nozzle 32 (SN22), the corresponding ink nozzles 34 are the ink nozzles 34 (C22 and BK22). The peripheral ink nozzles 34 are, for example, the ink nozzles 34 (C21, C23, BK23, and BK24).

The ink nozzles 34 (C10 and C21) deposit the ink only on the second to seventh rows of the recording medium C. The ink nozzles 34 (C11 and C22) deposit the ink only on the eighth to thirteenth rows of the recording medium C. The ink nozzles 34 (C12 and C23) deposit the ink only on the fourteenth to nineteenth rows of the recording medium C. The ink nozzles 34 (BK11 and BK22) deposit the ink only on the twentieth to twenty-fifth rows of the recording medium C. The ink nozzles 34 (BK12 and BK23) deposit the ink only on the twenty-sixth to thirty-first rows of the recording medium C. The ink nozzles 34 (BK13 and BK24) deposit the ink only on the thirty-second to thirty-fourth rows of the recording medium C. In this way, the ink nozzles 34 form line images on the recording medium C and generate the recording medium D having those line images.

A line image recorded by the ink nozzle 34 (C10) is represented as L(C10). A line image recorded by the ink nozzle 34 (C22) is represented as L(C22). A line image recorded by the ink nozzle 34 (BK24) is represented as L(BK24).

Such a recording medium D as described above is scanned by the image scanning device 14 and converted into digital data to generate landing position determination data.

In order to generate measurement result data, data of the line images (line data) is detected from the landing position determination data.

Image data representing line images L(N12C10) to L(N12C12), L(N22C21) to L(N22C23), L(N12BK11) to L(N12BK13), and L(N12BK22) to L(N12BK24) is detected from the landing position determination data representing the recording medium D illustrated in FIG. 18. In the following description, the line images are referred to only with numbers of ink nozzles. For example, the line image L(N12C10) is referred to as L(C10).

Among the line images represented by the detected line image data, the line images L (C12 and BK12) are line images having density distribution having directionality coincident with that of density distribution of the processing liquid in the line target area LA. In general, as described above, as the density of the processing liquid is lower, the density of the line image is lower and the width is larger.

Among the line images represented by the detected line image data, the line images L (C22 and BK22) are recorded by depositing the ink on an area on which the processing liquid is not deposited at all. The line images L (C10, C11, BK11, BK13, C21, C23, BK23, and BK24) are recorded by depositing the ink on an area on which the processing liquid is deposited so that directionality is opposite to that of density distribution of the processing liquid in the line target area LA.

After the data of the line images (line data) are detected, the density and the line width of the line images represented by the data are measured and a result of the measurement is recorded to generate measurement result data.

In measurement result data of line images having density distribution having directionality coincident with directionality of density distribution of the processing liquid in the line target area LA, such as the line images L (C12 and BK12), directionality of density distribution is different from that of the line images in the other areas.

In measurement result data of line images such as the line images L (C22 and BK22), the ink and the processing liquid do not overlap, and hence the density and the width of the line images do not change, and predetermined values of the density and the width cannot be obtained.

In measurement result data of line images such as the line images L (C10, C11, BK11, BK13, C21, C23, BK23, and BK24), the line images have density distribution in a direction opposite to that of the line images L (C12 and BK12).

Figure 19:
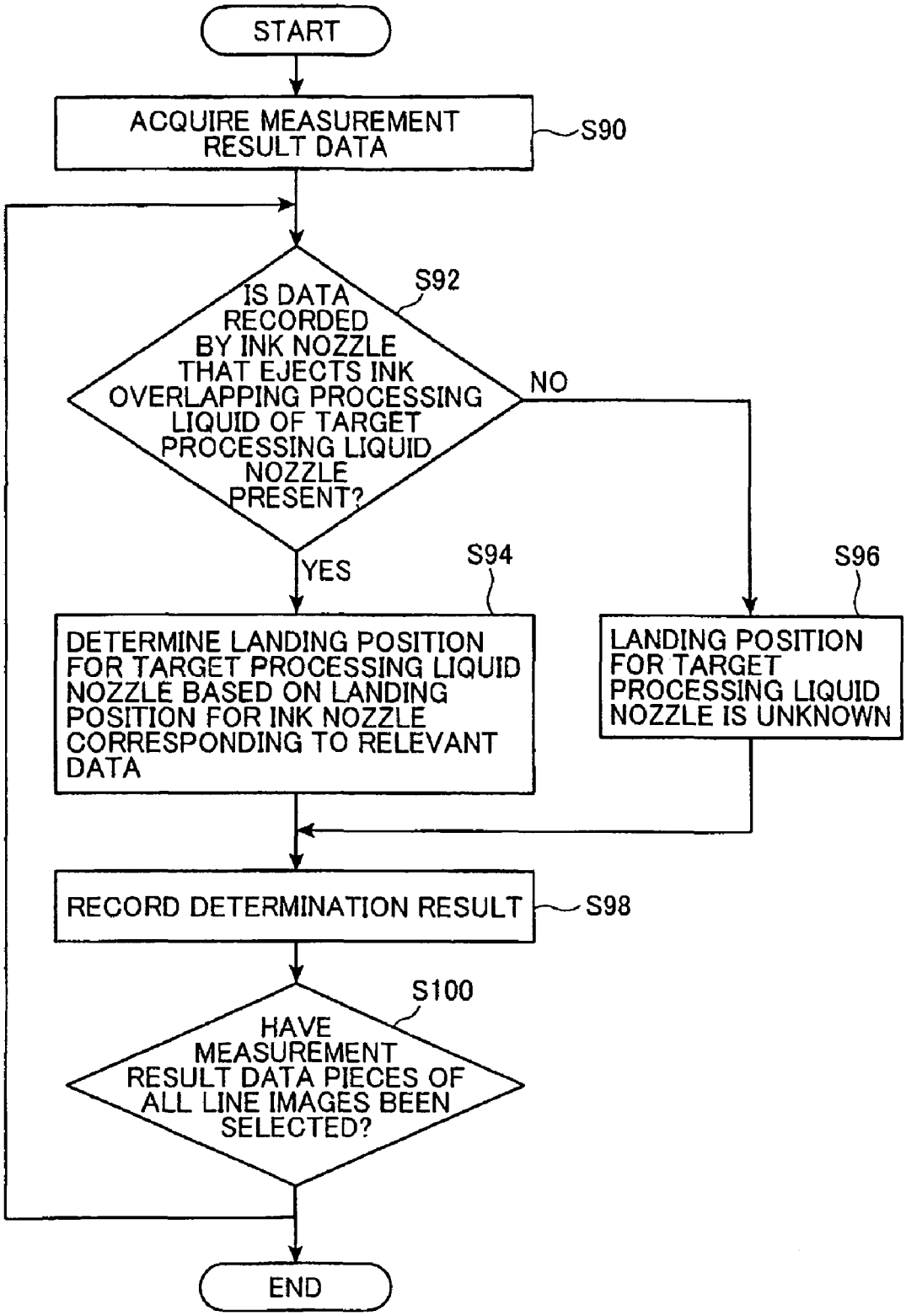
FIG. 19 is a flowchart of a method of determining a landing position of processing liquid ejected from one target processing liquid nozzle in the second embodiment.

A method of calculating a landing position of the processing liquid ejected from the target processing liquid nozzle is described in detail with reference to FIG. 19.

First, in Step S90, the determining unit 28 acquires measurement result data.

Subsequently, in Step S92, the determining unit 28 selects, out of the measurement result data, measurement result data of a line image recorded in association with the target processing liquid nozzle 32. The determining unit 28 determines whether measurement result data of a line image having density distribution having directionality coincident with directionality of density distribution of the processing liquid ejected to the line target area LA by the target processing liquid nozzle 32 is present in the selected measurement result data.

The determining unit 28 only has to check whether measurement result data of a line image having directionality of distribution of image density and line width coincident with each other is present in the selected measurement result data.

When it is determined in Step S92 that there is relevant data, in Step S94, the determining unit 28 determines, on the basis of a landing position of the ink ejected from an ink nozzle corresponding to the measurement result data of the relevant line image, a landing position of the processing liquid ejected from the target processing liquid nozzle on a processing liquid dot in which the line target area LA formed by the target processing liquid nozzle is located.

When measurement result data of a plurality of line images are acquired in Step S92, in Step S94, the determining unit 28 determines a landing position of the processing liquid ejected from the target processing liquid nozzle using an average of landing positions of the ink ejected from the ink nozzles corresponding to the respective line images.

When a landing position of the processing liquid ejected from the target processing liquid nozzle is detected from line images printed by a plurality of corresponding ink nozzles, the determining unit 28 only has to calculate an average of the landing positions and set the average as a landing position of the processing liquid ejected from the target processing liquid nozzle.

When it is determined in Step S92 that there is no relevant data, in Step S96, the determining unit 28 determines that a landing position of the processing liquid ejected from the target processing liquid nozzle is unknown.

After any one of Steps S94 and S96 is finished, in Step S98, the determining unit 28 records a determination result in the determination result recording data.

Thereafter, in Step S100, the determining unit 28 determines whether measurement result data of all the line images are selected.

When measurement result data of line images that should be selected still remain, the determining unit 28 returns to Step S92 and repeats Steps S92 to S100. On the other hand, when it is determined in Step S100 that measurement result data of all the line images are selected, the determining unit 28 determines that a landing position of the processing liquid ejected from the target processing liquid nozzle can be calculated and finishes the calculation of a landing position of the processing liquid ejected from the target processing liquid nozzle.

Specifically, in the following description, measurement result data of the line images illustrated in FIG. 18 is used as the measurement result data.

For example, after acquiring the measurement result data in Step S90, the determining unit 28 selects measurement result data of line images recorded in association with the target processing liquid nozzle (SN12), that is, measurement result data of the line images L (C10, C11, C12, BK11, BK12, and BK13). In Step S92, the determining unit 28 determines whether measurement result data of a line image having feature points of image density and width is present in the selected measurement result data.

Measurement result data of the line images L (C12 and BK12) having the feature points of image density and width are present in the selected measurement result data. Therefore, in Step S94, the determining unit 28 calculates a landing position of the processing liquid ejected from the target processing liquid nozzle (SN12) using landing positions (deposited positions) of the ink ejected from the ink nozzles (C12 and BK12) that record the line images L (C12 and BK12).

In Step S98, the determining unit 28 records a calculated result in the determination result recording data. In Step S100, the determining unit 28 determines whether measurement result data of all the line images are selected. Then, it is confirmed that measurement result data of line images not selected yet are present.

Therefore, the determining unit 28 selects, for example, measurement result data of line images recorded in association with the target processing liquid nozzle (SN22), that is, measurement result data of the line images L (C21, C22, C23, BK22, BK23, and BK24). In Step S92, the determining unit 28 determines whether measurement result data of line images having directionality of distribution of image density and line width coincident with each other are present in the selected measurement result data.

In this case, relevant measurement result data of line images are not present in the selected measurement result data. Therefore, in Step S96, the determining unit 28 determines that a landing position of the processing liquid ejected from the target processing liquid nozzle (SN22) is unknown.

In Step S98, the determining unit 28 records a determination result obtained in Step S96 in the determination result recording data. In Step S100, the determining unit 28 determines whether measurement result data of all the line images are selected.

As a result, there is no measurement result data of the line images not selected yet, and hence the determining unit 28 finishes the calculation of a landing position of the processing liquid ejected from the target processing liquid nozzle.

In this way, it is possible to determine a landing position of the processing liquid ejected from the target processing liquid nozzle.

In Step S94, in addition to the determination of a landing position of the processing liquid ejected from the target processing liquid nozzle, the determining unit 28 can also perform association of the target processing liquid nozzle, the corresponding ink nozzles, and the peripheral ink nozzles.

For example, when measurement result data of line images corresponding to the target processing liquid nozzle 32 (SN12) is selected and measurement result data of the line images L (C12 and BK12) having feature points of image density and width are present in the selected measurement result data, it is seen that landing positions of the processing liquid and the ink ejected from the target processing liquid nozzle 32 (SN12) and the ink nozzles 34 (C12 and BK12) coincide with each other. Therefore, it is possible to associate the target processing liquid nozzle 32 (SN12) and the ink nozzles 34 (C12 and BK12).

In Step S96, in addition to determining that a landing position of the processing liquid ejected from the target processing liquid nozzle is unknown, the determining unit 28 determines whether data representing that the ink does not overlap the processing liquid of the target processing liquid nozzle is present in the measurement result data of the line images. When relevant data is present, the determining unit 28 can also determine that "the target processing liquid nozzle and the ink nozzles corresponding to the target processing liquid nozzle do not correspond to each other".

For example, when measurement result data of a line image corresponding to the target processing liquid nozzle 32 (SN22) is selected, all the selected measurement result data do not have feature points in image density and width. Therefore, the determining unit 28 can determine that the target nozzle 32 (SN22) and the ink nozzles (C22 and BK22) do not correspond to each other.

In Step S94, in addition to the determination of a landing position of the processing liquid ejected from the target processing liquid nozzle, the determining unit 28 can determine ejection states of the processing liquid nozzles and the corresponding ink nozzles or the peripheral ink nozzles and a between the processing liquid nozzles and the corresponding ink nozzles or the peripheral ink nozzles.

For example, when measurement result data of a line image corresponding to the target processing liquid nozzle 32 (SN12) is selected, measurement result data of the line images L (C12 and BK12) having feature points of image density and width are present in the selected measurement result data. Therefore, the determining unit 28 can determine that the processing liquid of the target processing liquid nozzle 32 (SN12) and the ink of the ink nozzles 34 (C12 and BK12) overlap and that both the processing liquid nozzle 32 (SN12) and the ink nozzles (C12 and BK12) perform "normal ejection".

In Step S96, in addition to determining that a landing position of the processing liquid ejected from the target processing liquid nozzle is unknown, when measurement result data representing a line image having line width equal to or smaller than a reference value and density equal to or larger than a reference value among the measurement result data of the line images is confirmed, the determining unit 28 can determine that an ejection state of an ink nozzle that records the line image is "position shift", an ejection state of the target processing liquid nozzle is "unknown", and a positional relation of landing positions between the processing liquid nozzles and the ink nozzle is "unknown". On the other hand, when relevant measurement result data cannot be confirmed, the determining unit 28 can determine that an ejection state of the ink nozzle that records the line image is "normal ejection", an ejection state of the target processing liquid nozzle is "no ejection", and a landing position relation between the ink nozzle and the target processing liquid nozzle is "unknown".

The reference value of density is the density of a line image in which the processing liquid and the ink overlap. The reference value of line width is the line width of a line image in which the processing liquid and the ink overlap.

For example, when measurement result data of a line image corresponding to the target processing liquid nozzle 32 (SN22) is selected, in the line images L (C21, C23, BK23, and BK24) of the selected measurement result data, the width of the line images is smaller than the reference value and the density of the line images exceeds the reference value. Therefore, the determining unit 28 can determine that an ejection state of the ink nozzles (C21, C23, BK23, and BK24) is "position shift", an ejection state of the target processing liquid nozzle (SN22) is "unknown", and a positional relation of landing positions between the processing liquid and the ink ejected from the processing liquid nozzle 32 (SN22) and the ink nozzles 34 (C21, C23, BK23, and BK24) is "unknown".

On the other hand, the line images L (C22 and BK22) of the selected measurement result data do not have predetermined values of the density and the width, and therefore the determining unit 28 can determine that an ejection state of the ink nozzles 34 (C22 and BK22) is "normal ejection", an ejection state of the target ink nozzle 32 (SN22) is "no ejection", and a landing position relation between the ink nozzles (C22 and BK22) and the processing liquid nozzle 32 (SN22) is "unknown".

When data of a line image cannot be detected from the landing position determination data in Step S76 of FIG. 16, all ink nozzles that are about to record line images are non-ejecting nozzles. Therefore, the determining unit 28 can determine that an ejection state of the processing liquid nozzles corresponding to those nozzles is unknown and that a relation of landing positions between the processing liquid and the ink is unknown.

Figure 20:
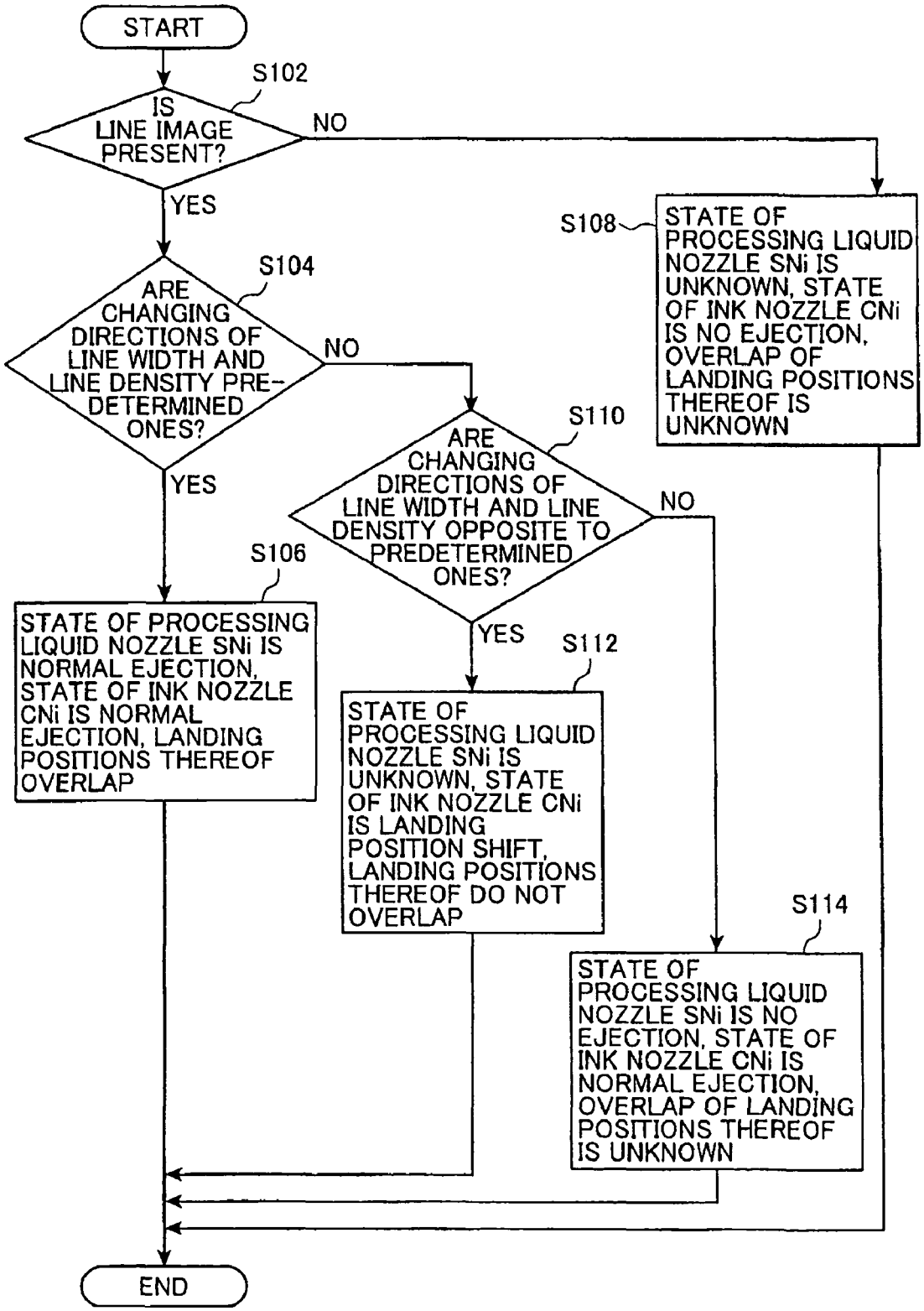
FIG. 20 is a flowchart of a method of determining ejection states of a target processing liquid nozzle and a target ink nozzle in the second embodiment.

A method of determining ejection states of the processing liquid nozzle and the corresponding ink nozzle is described with reference to FIG. 20. This determination may be performed before the landing position determination for the processing liquid nozzle according to the present invention is performed or may be performed after the landing position determination is performed.

First, in Step S102, the determining unit 28 determines whether a line image is present. When it is determined that a line image is present, in Step S104, the determining unit 28 determines whether the direction of the change in the line width and the direction of the change in the line density are a predetermined direction (directionality same as that of density distribution of the processing liquid in the line target area).

When it is determined as a result of the determination in Step S104 that the directions are the predetermined direction, in Step S106, the determining unit 28 determines that a processing liquid nozzle SNi (i represents a nozzle number) performs normal ejection, an ink nozzle CNi performs normal ejection, and landing positions of the processing liquid and the ink ejected from the processing liquid nozzle SNi and the ink nozzle CNi overlap. In this way, it is possible to determine a landing position of the processing liquid ejected from the processing liquid nozzle.

On the other hand, when it is determined in Step S102 that a line image is not present, in Step S108, the determining unit 28 determines that an ejection state of the processing liquid nozzle SNi is unknown, an ejection state of the ink nozzle CNi is no ejection, and overlap of landing positions of the processing liquid and the ink ejected from the processing liquid nozzle SNi and the ink nozzle CNi is unknown.

When it is determined in Step S104 that the directions are not the predetermined direction, in Step S110, the determining unit 28 determines whether the direction of the change in the line width and the direction of the change in the line density are a direction opposite to the predetermined direction (directionality same as that of density distribution of the processing liquid in the line target area).

When it is determined as a result of the determination that the directions are the opposite direction, in Step S112, the determining unit 28 determines that an ejection state of the processing liquid nozzle SNi is unknown, an ejection state of the ink nozzle CNi is landing position shift, and landing positions of the processing liquid and the ink ejected from the processing liquid nozzle SNi and the ink nozzle CNi do not overlap.

On the other hand, when it is determined in Step S110 that the directions are not the opposite direction (there is no change in the line width and the line density), in Step S114, the determining unit 28 determines that an ejection state of the processing liquid nozzle SNi is no ejection, an ejection state of the ink nozzle CNi is normal ejection, and overlap of landing positions of the processing liquid and the ink ejected from the processing liquid nozzle SNi and the ink nozzle CNi is unknown.

As described above, the determining unit 28 can determine landing positions of the processing liquid ejected from the target processing liquid nozzle and, in addition, can determine association between the target processing liquid nozzle and the ink nozzles, ejection states of the target processing liquid nozzle, the corresponding ink nozzles, and the peripheral ink nozzles, and a positional relation of landing positions between the target processing liquid nozzle and the corresponding ink nozzles or the peripheral ink nozzles.

Third Embodiment

A landing position determining method for a processing liquid nozzle according to a third embodiment of the present invention is described below.

In the following description, differences from the first embodiment are mainly described. Description of components and processing same as those in the first embodiment is omitted to simplify description.

In the third embodiment, in order to set a processing liquid deposited pattern, for example, target processing liquid nozzles are selected out of all processing liquid nozzles not to be adjacent as landing position determination targets of processing liquid.

The processing liquid deposited pattern includes, in each of the processing liquid nozzles selected as the landing position determination targets, a processing liquid deposited area on which the processing liquid is continuously deposited a predetermined number of dots and a processing liquid non-deposited area on which the processing liquid is not continuously deposited the predetermined number of dots. The processing liquid non-deposited area is set so that a plurality of linear landing position determination target areas in which a predetermined number of dots not deposited decreases further away from the center thereof is formed and so that the processing liquid nozzles not selected as the landing position determination targets form an area on which the processing liquid is continuously deposited.

An overall flow of the landing position determining method for a processing liquid nozzle according to the third embodiment is the same as the flow according to the first embodiment illustrated in FIG. 3.

A method of determining landing positions of the target processing liquid nozzles using measurement result data and feature data in the third embodiment is described.

The measurement result data is data representing a result obtained by detecting data of line images (line data) from landing position determination data and measuring the density and the width of the detected line images. Therefore, the landing position determination data is described with reference to FIGS. 21 and 22.

Test image data in the third embodiment is data representing an image including line images formed by depositing, with corresponding ink nozzles and test ink nozzles, colored inks on a recording medium on which the target processing liquid deposited pattern as described above is formed.

Figure 21:
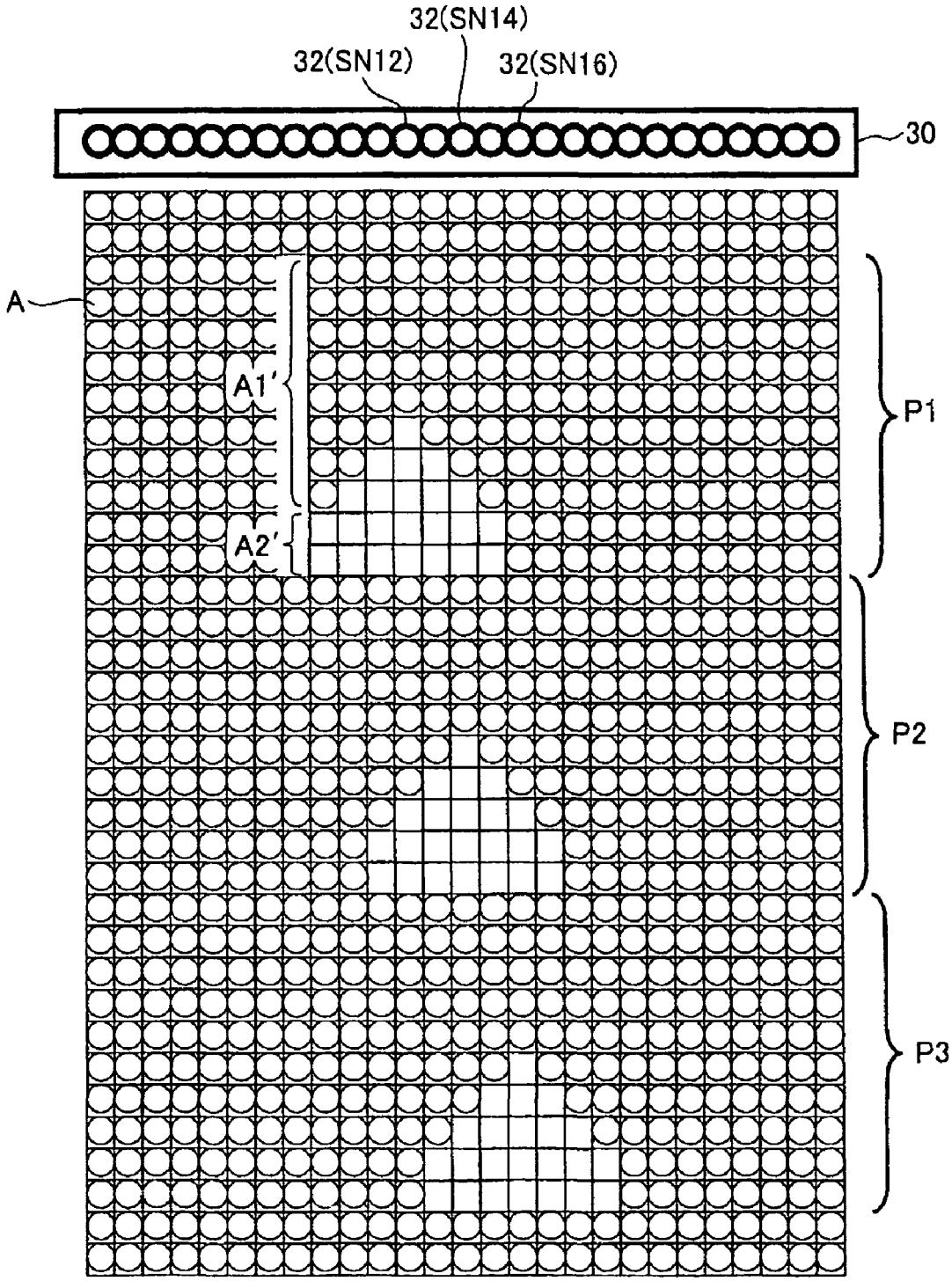
FIG. 21 is a schematic diagram of a recording medium on which a processing liquid deposited pattern is formed and a processing liquid head in a third embodiment of the present invention.

FIG. 21 is a schematic diagram of a recording medium A on which three kinds of processing liquid deposited patterns (P1, P2, and P3) are formed and a processing liquid head including twenty-seven processing liquid nozzles. Each of the processing liquid deposited patterns includes a processing liquid deposited pattern including a processing liquid deposited area on which the processing liquid is continuously deposited a predetermined number of dots in each of a target processing liquid nozzle and a plurality of processing liquid nozzles on both sides of the target processing liquid nozzle and a processing liquid non-deposited area on which the processing liquid is not continuously deposited the predetermined number of dots. The processing liquid non-deposited area has a plurality of linear landing position determination target areas in which a predetermined number of dots not deposited decreases further away from the center thereof.

Figure 22:
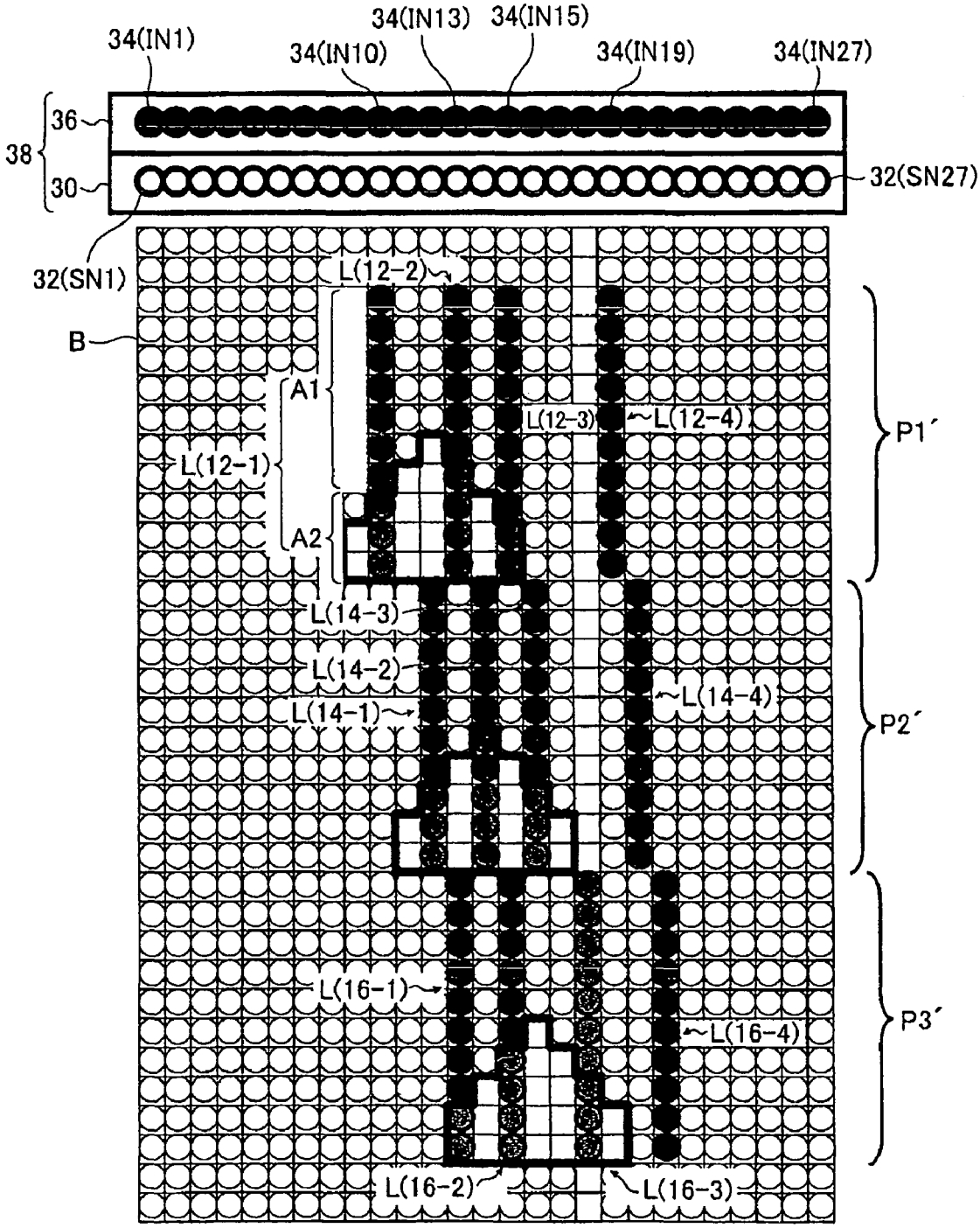
FIG. 22 is a schematic diagram of a recording medium on which a landing position determination pattern is formed and an ejection head in the third embodiment.

FIG. 22 is a schematic diagram of a recording medium B on which a processing liquid landing position determination pattern having line images is formed in a predetermined area of the recording medium A illustrated in FIG. 21 and the ejection head 38.

The processing liquid landing position determination pattern illustrated in FIG. 22 indicates an example of an image represented by landing position determination data.

First, the image recording unit 12 deposits the processing liquid with the processing liquid nozzles 32 of the processing liquid head 30 to generate the recording medium A on which the processing liquid deposited pattern including the plurality of linear landing position determination target areas illustrated in FIG. 21 is formed.

In the processing liquid head 30, as illustrated in FIG. 21, twenty-seven processing liquid nozzles 32 (SN1, SN2, . . . , and SN27 from the left) are arranged in line in a lateral direction of FIG. 21.

The width in the lateral direction of FIG. 21 (hereinafter, referred to as row direction) of the recording medium A illustrated in FIG. 21 coincides with the length of twenty-seven processing liquid dots in a row deposited by the twenty-seven processing liquid nozzles 32 arrayed in a row. The length in a longitudinal direction of FIG. 21 (hereinafter, referred to as column direction) of the recording medium A coincides with the length of thirty-four dots in a column deposited thirty-four times by one processing liquid nozzle 32.

In other words, it is possible to coat the entire surface of the recording medium A with the processing liquid by ejecting the processing liquid for thirty-four rows with the twenty-seven processing liquid nozzles in total of the processing liquid head 30.

The recording medium A on which the processing liquid deposited pattern including the plurality of linear landing position determination target areas is generated by using the recording medium A and the processing liquid nozzles 32 described above.

For example, when the processing liquid nozzles 32 with the numbers SN12, SN14, and SN16 are set as target processing liquid nozzles, the processing liquid nozzle 32 with the number SN12 is set not to eject the processing liquid on only the eighth to twelfth rows, the processing liquid nozzles 32 with the numbers SN11 and SN13 are set not to eject the processing liquid on only the ninth to twelfth rows, the processing liquid nozzles 32 with the numbers SN10 and SN14 are set not to eject the processing liquid on only the tenth to twelfth rows, and the processing liquid nozzles 32 with the numbers SN9 and SN15 are set not to eject the processing liquid on only the eleventh and twelfth rows. The other processing liquid nozzles are set to eject the processing liquid on the first to twelfth rows. The processing liquid deposited pattern P1 having the processing liquid non-deposited area is formed on the recording medium A by relatively moving the processing liquid head 30 and the recording medium A.

Further, the processing liquid nozzle 32 with the number SN14 is set not to eject the processing liquid on only the eighteenth to twenty-second rows, the processing liquid nozzles 32 with the numbers SN13 and SN15 are set not to eject the processing liquid on only the nineteenth to twenty-second rows, the processing liquid nozzles 32 with the numbers SN12 and SN16 are set not to eject the processing liquid on only the twentieth to twenty-second rows, and the processing liquid nozzles 32 with the numbers SN11 and SN17 are set not to eject the processing liquid on only the twenty-first and twenty-second rows. The other processing liquid nozzles are set to eject the processing liquid on the thirteenth to twenty-second rows. The processing liquid deposited pattern P2 having the processing liquid non-deposited area is formed on the recording medium A by relatively moving the processing liquid head 30 and the recording medium A.

Similarly, the processing liquid nozzle 32 with the number SN16 is set not to eject the processing liquid on only the twenty-eighth to thirty-second rows, the processing liquid nozzles 32 with the numbers SN15 and SN17 are set not to eject the processing liquid on only the twenty-ninth to thirty-second rows, the processing liquid nozzles 32 with the numbers SN14 and SN18 are set not to eject the processing liquid on only the thirtieth to thirty-second rows, and the processing liquid nozzles 32 with the numbers SN13 and SN19 are set not to eject the processing liquid on only the thirty-first and thirty-second rows. Accordingly, the processing liquid non-deposited area is formed. The other processing liquid nozzles are set to eject the processing liquid on the twenty-third to thirty-fourth rows. The processing liquid deposited pattern P3 having the processing liquid non-deposited area is formed on the recording medium A by relatively moving the processing liquid head 30 and the recording medium A.

Line images are formed on the recording medium A, on which the three kinds of processing liquid deposited patterns P1 to P3 are formed in this way, by depositing the ink thereon from the corresponding ink nozzles 34 corresponding to the target ink nozzles 32 with the numbers SN12, SN14, and SN16 and the test ink nozzles 34, whereby the recording medium B on which the processing liquid landing position determination pattern is formed is generated. In this case, as in the above-mentioned case, the corresponding ink nozzles 34 and the test ink nozzles 34 deposit the ink only on a portion of a processing liquid deposited pattern in which the target processing liquid nozzles 32 form a linear position detection target area rather than depositing the ink in all the first to thirty-four columns.

As illustrated in FIG. 22, it is assumed that, in the ink head 36, twenty-seven ink nozzles 34 having the same size as that of the processing liquid head 32 are arranged in a row in the lateral direction (row direction) of FIG. 22.

The ejection head 38 includes the processing liquid head 30 and the ink head 36.

For example, as illustrated in FIG. 22, the ink nozzles corresponding to the target processing liquid nozzles 32 with the numbers SN12, SN14, and SN16 are the ink nozzles 34 with the numbers IN10, IN12 to IN16, and IN18 to IN21. In this case, the ink nozzles 34 with the numbers IN10, IN13, IN15, and IN19 deposit the ink on the third to twelfth rows, the ink nozzles 34 with the numbers IN12, IN14, IN16, and IN20 deposit the ink on the thirteenth to twenty-second rows, the ink nozzles 34 with the numbers IN13, IN15, IN18, and IN21 deposit the ink on the twenty-third to thirty-second rows. Consequently, the ink is deposited on a linear landing position determination target area in which a processing liquid deposited area A1' and a processing liquid non-deposited area A2' of the recording medium A continue illustrated in FIG. 21 to form line images L12-1 to L12-4, L14-1 to L14-4, and L16-1 to L16-4 and generate the recording medium B on which the processing liquid landing position determination pattern is formed.

Areas P1', P2', and P3' of the recording medium B illustrated in FIG. 22 correspond to the areas P1, P2, and P3 of the recording medium A illustrated in FIG. 21.

The recording medium B having such line images is scanned by the image scanning device 14 and converted into digital data to generate landing position determination data.

In order to generate measurement result data, data of the line images is detected from such landing position determination data.

In this example, only image data representing the line images L12-1 to L12-4, L14-1 to L14-4, and L16-1 to L16-4 is detected from the image data of the processing liquid landing position determination pattern illustrated in FIG. 22.

The line images L12-1 to L12-3, L14-1 to L14-3, and L16-1 and L16-2 among the detected line images have a normal image area A1 (area of dark gray dots of FIG. 22) in which the deposited processing liquid and the deposited ink overlap and an unprocessed image area A2 (area of light gray dots of FIG. 22) in which the ink is deposited on an area without the processing liquid.

The normal image area and the unprocessed image area are described in detail later.

The line images L12-4, L14-4, and L16-4 are normal images having the entire surface on which the deposited processing liquid and the deposited ink overlap. The line image L16-3 is an unprocessed image having the entire surface on which the ink is deposited in an area without the processing liquid.

In FIG. 22, in order to prevent complication of the figure, the signs indicating the normal image area A1 and the unprocessed image area A2 are not affixed to the line images L12-2 and L12-3, L14-1 to L14-3, and L16-1 and L16-2. However, like the line image L12-1, a dark gray dot area of FIG. 22 represents a normal image and a light gray dot area of FIG. 22 represents an unprocessed image. In the example illustrated in FIG. 22, the width of the line images in the normal image area A1 and the width of the line images in the unprocessed image area A2 are substantially the same. However, actually, because of a reason described later, the width of the unprocessed image area A2 is larger than the width of the normal image area A1.

Figure 23A:
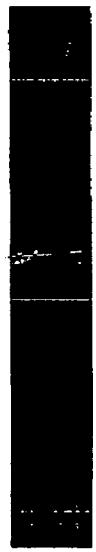
FIG. 23A is a schematic diagram of a normal image in the third embodiment.
Figure 23B:
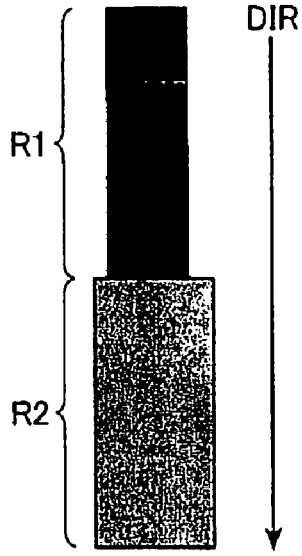
FIG. 23B is a schematic diagram of a line image having a normal image area and an unprocessed image area in the third embodiment.

The normal image and the unprocessed image serving as a reference image are described. FIG. 23A is a schematic diagram of the normal image. FIG. 23B is a schematic diagram of the reference image including both the normal image and the unprocessed image.

The processing liquid has an action of agglomerating and fixing color materials of colored inks on a recording medium. Therefore, for example, when the ink is deposited on the recording medium, on which the processing liquid is deposited, by one ink nozzle to form the normal image, a line image illustrated in FIG. 23A can be printed.

On the other hand, for example, as illustrated in FIG. 23B, the ink is deposited by one ink nozzle on a linear landing position determination target area, in which a processing liquid deposited area on which the processing liquid is deposited (area on which the processing liquid is continuously deposited a predetermined number of dots) and a processing liquid non-deposited area on which the processing liquid is not deposited (area on which the processing liquid is not continuously deposited the predetermined number of dots) are adjacent to each other, in an arrow direction of FIG. 23B to form an image. A line image in an upper area (processing liquid deposited area) R1 on which the processing liquid is deposited forms the same normal image as that of FIG. 23A. A line image in a lower area (processing liquid non-deposited area) R2 on which the processing liquid is not deposited is an image with higher density and larger width (hereafter also referred to as unprocessed image) compared with the normal image.

Changes in image density and line width in the normal image and the unprocessed image are described with reference to FIG. 24.

Figure 24:
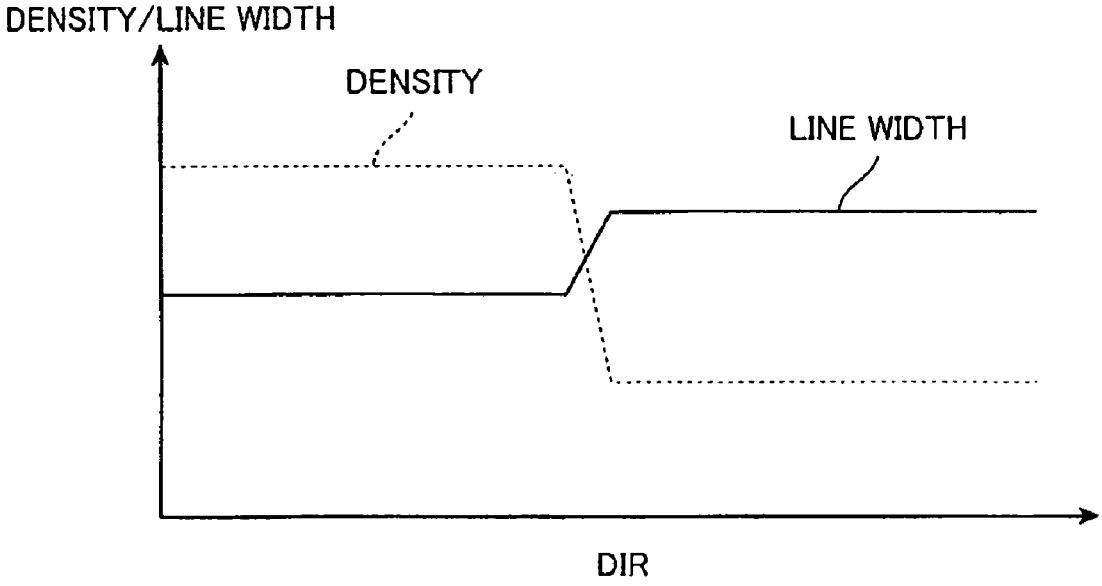
FIG. 24 is a graph of changes in a density of the line image and a line width of the line image in the third embodiment.

A dotted line of FIG. 24 indicates a change in the density in the arrow direction of the image illustrated in FIG. 23B and a solid line indicates a change in the line width in the arrow direction of the image illustrated in FIG. 23B.

As illustrated in FIG. 24, the density of the line image is greatly different between the normal image and the unprocessed image. The density of the unprocessed image is low compared with the density of the normal image. The line width of the line image is also greatly different between the normal image and the unprocessed image. The line width of the unprocessed image is large compared with the line width of the normal image.

This is because, as described above, when the ink is deposited on the area on which the processing liquid is not deposited, the ink does not fix and tends to blur.

After data of the line images L12-1 to L12-4, L14-1 to L14-4, and L16-1 to L16-4 having such characteristics, densities and line widths of those line images are measured to generate measurement result data.

In the measurement result data, values of the densities and line widths of the line images L12-1 to L12-3, L14-1 to L14-3, and L16-1 and L16-2 having the normal image area A1 and the unprocessed image area A2 described above significantly change at a boundary of the normal image area A1 and the unprocessed image area A2.

In the measurement result data, the values of the densities of the line images L12-4, L14-4, L16-4, and L16-3 do not change in the line images. Among the line images L12-4, L14-4, L16-4, and L16-3, the densities of the line images L12-4, L14-4, and L16-4 have values substantially equal to a reference value and the line widths thereof also have values substantially equal to a reference value. The density of the remaining line image L16-3 has a value smaller than the reference value and the line width of the line image has a value exceeding the reference value.

The reference value of the density represents the density of a line image formed when the processing liquid and the ink overlap on the recording medium. The reference value of the width represents the width of the line image formed when the processing liquid and the ink overlap.

A method of determining landing positions of the processing liquid ejected from the target processing liquid nozzles using the above-mentioned measurement result data and feature data is described with reference to FIG. 25.

The feature data is described in detail later. As the measurement result data, data representing a result obtained by measuring the density and the line width of the line images illustrated in FIG. 22 is used.

First, in Step S132, the determining unit 28 acquires feature data and measurement result data.

Subsequently, in Step S134, the determining unit 28 selects, out of the measurement result data, measurement result data of line images recorded by the corresponding ink nozzles and the test ink nozzles, that is, measurement result data of line images in an area that should be determined. The determining unit 28 determines whether changing points of values of the density and the line width of the line images are present in the measurement result data.

When it is determined in Step S134 that there is no changing point, in Step S136, the determining unit 28 determines that it is impossible to determine a landing position of the processing liquid ejected from the target processing liquid nozzle. On the other hand, when it is determined that changing points are present, in Step S138, the determining unit 28 determines whether there are two or more measurement result data including the changing points.

When it is determined in Step S138 that there is only one measurement result data including the changing points, in Step S140, the determining unit 28 calculates, as a landing position of the processing liquid ejected from the target processing liquid nozzle, a calculated landing position of the ink ejected from an ink nozzle used for recording the measurement result data. On the other hand, when it is determined that there are two or more measurement result data including the changing points, in Step S142, the determining unit 28 calculates a landing position of the processing liquid ejected from the target processing liquid nozzle using arbitrary two measurement result data.

A method of calculating a landing position of the processing liquid ejected from the target processing liquid nozzle using the arbitrary two measurement result data is described in detail later.

When the processing of any one of Steps S136, S140, and S142 is finished, in Step S144, a determination result of the landing position of the processing liquid ejected from the target processing liquid nozzle is recorded as landing position recording data.

Thereafter, in Step S146, the determining unit 28 determines whether selection of all the areas is completed. When the selection is not completed, the determining unit 28 returns to Step S134 and repeats Steps S134 to S146. When the selection is completed, the determining unit 28 finishes the series of landing position determination processing.

Specifically, a method of determining a landing position of the processing liquid ejected from the target processing liquid nozzle 32 (SN12) from measurement result data of the line images L12-1 to L12-4 of the area P' illustrated in FIG. 22 is described.

First, the determining unit 28 selects the area P1' and acquires measurement result data of the line images L12-1 to L12-4.

Subsequently, the determining unit 28 checks whether data having changing points of image density and line width is present in the measurement result data of the line images L12-1 to L12-4.

As a result, the measurement result data of the line images L12-1 to L12-3 having changing points of image density and line width can be confirmed. Therefore, the determining unit 28 checks whether there are two or more such measurement result data.

The measurement result data of the line image L12-4 does not have changing points of image density and width. Therefore, the measurement result data is excluded from measurement result data of line images used for calculating a landing position of the processing liquid ejected from the target processing liquid nozzle.

Three measurement result data of the line images L12-1 to L12-3 having changing points of image density and width can be confirmed. Therefore, the determining unit 28 calculates landing positions of target processing liquid nozzles in combinations of the line images L12-1 and L12-3, the line images L12-1 and L12-2, and the line images L12-2 and L12-3 and sets an average of the landing positions as a landing position of the processing liquid ejected from the target processing liquid nozzle 32 (SN12).

Specifically, a method of determining a landing position of the processing liquid ejected from the target processing liquid nozzle 32 (SN16) from measurement result data of the line images L16-1 to L16-4 of the area P3' illustrated in FIG. 22 is described.

First, the determining unit 28 selects the area P3' and acquires measurement result data of the line images L16-1 to L16-4.

Subsequently, the determining unit 28 checks whether data having changing points of image density and line width is present in the measurement result data of the line images L16-1 to L16-4.

As a result, the measurement result data of the line images L16-1 and L16-2 having changing points of image density and line width can be confirmed. Therefore, the determining unit 28 checks whether there are two or more such measurement result data.

The measurement result data of the line images L16-3 and L16-4 do not have changing points of image density and line width. Therefore, the measurement result data are excluded from data of line images used for detecting a landing position of the processing liquid ejected from the target processing liquid nozzle.

Two measurement result data of the line images L16-1 and L16-2 having changing points of image density and line width can be confirmed. Therefore, the determining unit 28 calculates landing positions of target processing liquid nozzles in a combination of the line images L16-1 and L16-2 and sets an average of the landing positions as a landing position of the processing liquid ejected from the target processing liquid nozzle 32 (SN16).

Similarly, the determining unit 28 can select the area P2' illustrated in FIG. 22 and determine, from measurement result data of the line images L14-1 to L14-4, a landing position of the processing liquid ejected from the target processing liquid nozzle 32 (SN14).

A method of calculating a landing position of the processing liquid ejected from the target processing liquid nozzle using arbitrary two measurement result data is described in detail.

In the third embodiment, in order to calculate a landing position of the processing liquid deposited from a processing liquid nozzle selected as a landing position detection target area in the recording medium A of the target processing liquid nozzle, a ratio of the length from one end to a changing point of a line image represented by measurement result data of a selected line image and the length of the line image, and a separation distance between line images represented by measurement result data of selected two line images are used.

The length of the line image is the length in a direction orthogonal to the line width of the line image.

A method of calculating a ratio of the length from one end to a changing point of a line image and the length of the line image is not specifically limited. As an example, there is provided a method of calculating the ratio using pattern data of a processing liquid deposited pattern.

Similarly, a method of calculating a separation distance between line images is not specifically limited. As an example, there is provided a method of calculating the separation distance using pattern data of a processing liquid deposited pattern.

A method of calculating a landing position of the processing liquid ejected from the target processing liquid nozzle is described.

Two line images having changing points of image density and line width are selected from selected line images. For each of the line images, a ratio of the length from one end to a changing point of the image and the length of the line image is calculated and a separation distance between the selected two line images is calculated. A landing position of the processing liquid deposited from the target processing liquid nozzle only has to be calculated by using values of the ratio and the separation distance and a landing position of colored inks determined in advance in association with ink nozzles that record the selected two line images.

When there are three or more line images having changing points, an average of landing positions of the processing liquid ejected from the processing liquid nozzles calculated in a plurality of combinations of two line images only has to be set as a deposited position of the processing liquid deposited from the target processing liquid nozzle.

Specifically, a landing position can be calculated in the same manner as the method in the first embodiment described with reference to FIG. 13. With one line image of arbitrary two line images set as the line image len1 and the other line image set as the line image len2, "changing point" only has to be used instead of "feature points" in the first embodiment.

In the third embodiment, the variables $T_{len0}$, $T_{len1}$, $T_{len2}$, cp1, and cp2 in Formulae (1) to (6) in the first embodiment indicate values described below. $T_{len0}$ represents a ratio of the length from one end to a changing point of a line image corresponding to the target processing liquid nozzle and the length of the line image. $T_{len1}$ represents a ratio of the length to a changing point of the line image len1 and the length of the line image len1. $T_{len2}$ represents a ratio of the length to a changing point of the line image len2 and the length of the line image len2. The length of the line image is obtained by adding up the length of an unprocessed image area of the line image and the length of a normal image area of the line image.

cp1 and cp2 represent positions of dots deposited first on unprocessed image areas of the line images len1 and len2, respectively. A method of calculating cp1 and cp2 is not specifically limited. However, cp1 and cp2 are calculated in advance.

In the third embodiment, as in the first embodiment, in addition to detection of a landing position of the processing liquid ejected from the target processing liquid nozzle, it is possible to determine ejection states of the target processing liquid nozzle and the corresponding ink nozzles and a relation of deposited positions between the processing liquid and the ink ejected from the target processing liquid nozzle and the corresponding ink nozzles.

Figure 25:
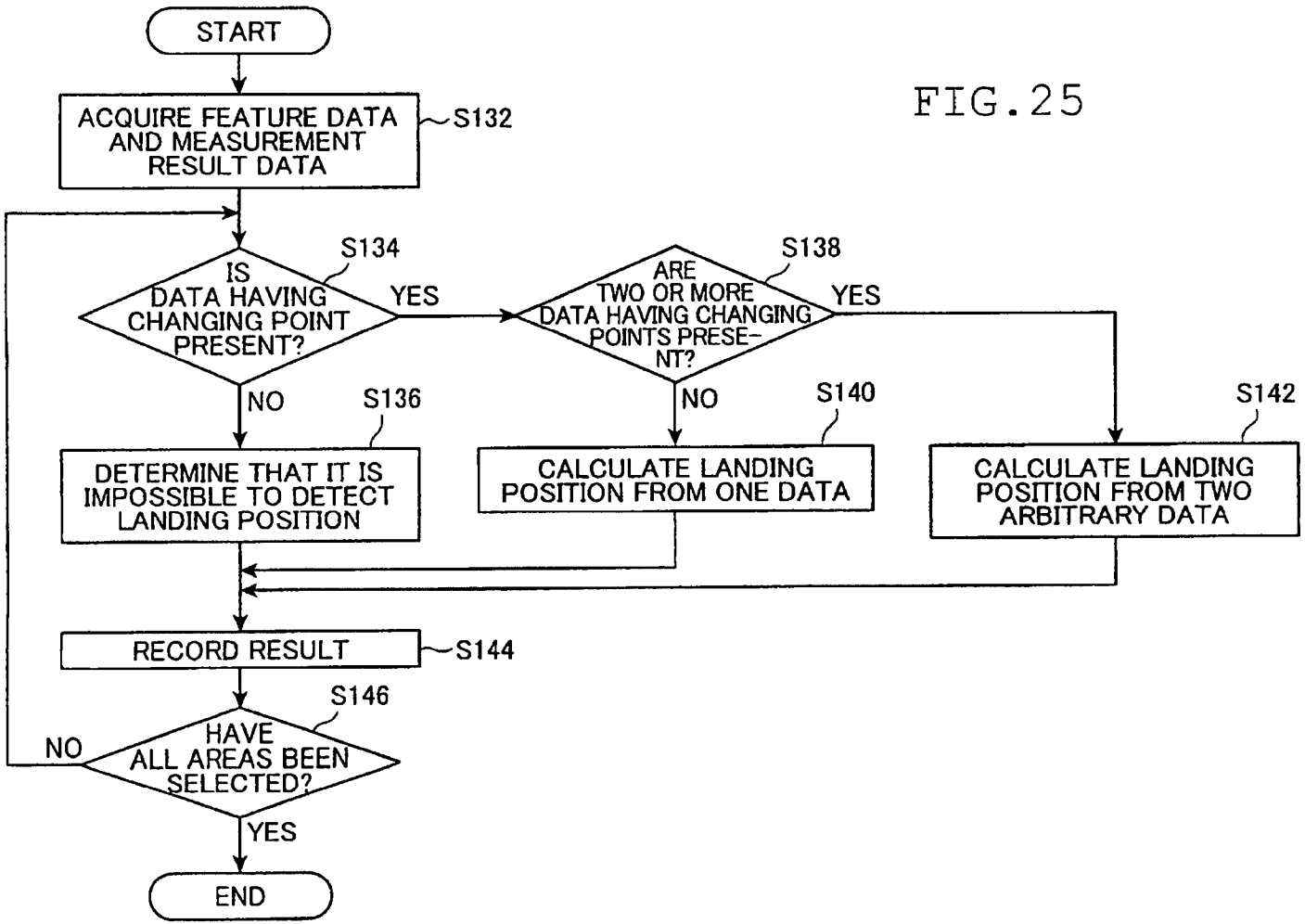
FIG. 25 is a flowchart of a method of determining a landing position of processing liquid ejected from one target processing liquid nozzle in the third embodiment.

For example, when it is confirmed in Step S134 of FIG. 25 that measurement result data of a line image having a changing point is present in the measurement result data of the selected line images, the determining unit 28 can determine that a processing liquid nozzle that ejects the processing liquid to an area of the line image having the changing point and corresponding ink nozzles that record the line image having the changing point normally eject the processing liquid and the ink, respectively. Further, the determining unit 28 can determine that landing positions of the processing liquid and the ink ejected from the processing liquid nozzle and the corresponding ink nozzles overlap.

Figure 26:
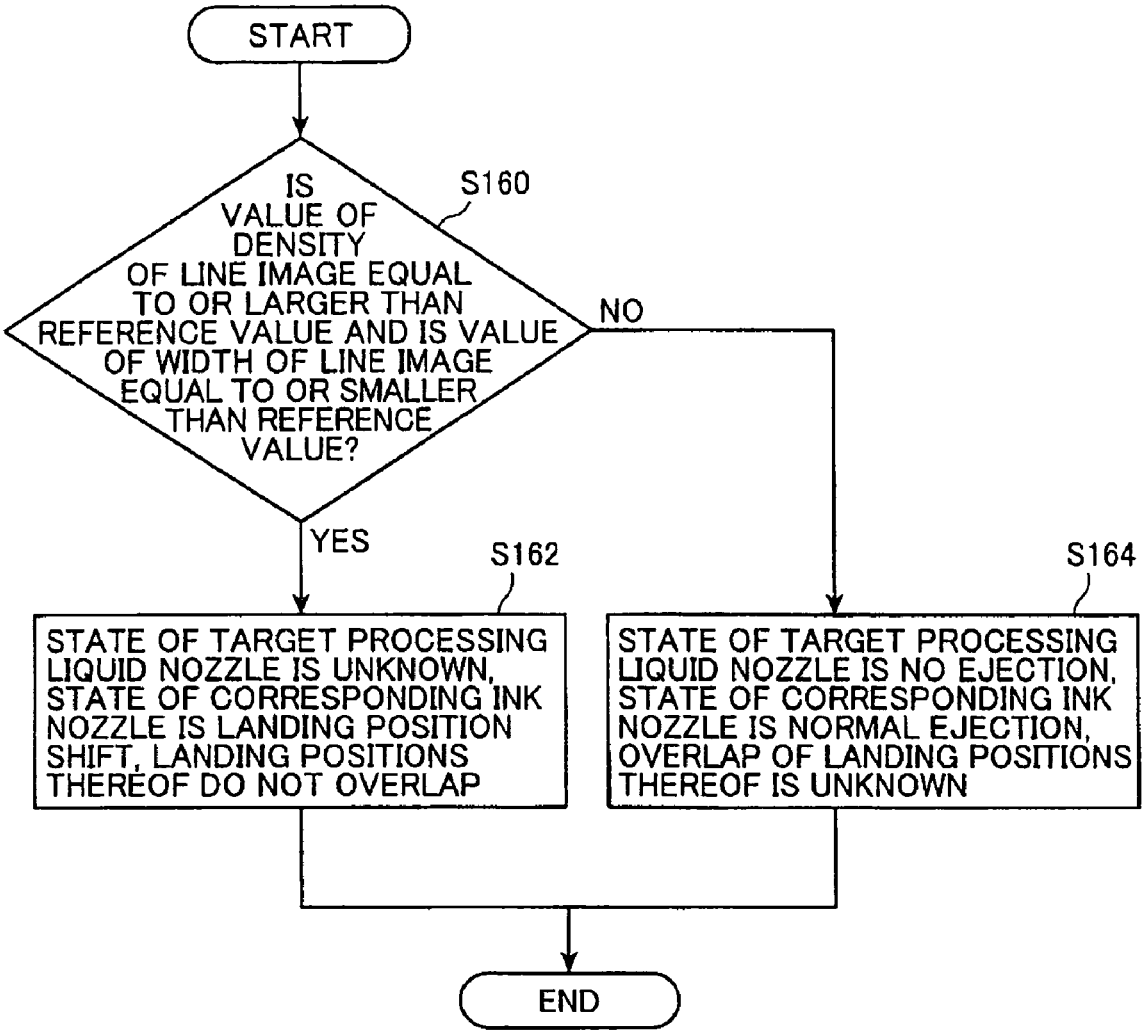
FIG. 26 is a flowchart of a method of determining ejection states of a target processing liquid nozzle and a target ink nozzle in the third embodiment.

On the other hand, when data of a line image having a changing point cannot be confirmed in Step S134, the determining unit 28 can determine, with a method illustrated in FIG. 26, ejection states of the target processing liquid nozzle and the corresponding ink nozzles and a relation of deposited positions of the processing liquid and the ink ejected from the target processing liquid nozzle and the corresponding ink nozzles.

Specifically, first, as indicated by Step S160, the determining unit 28 determines whether the density of each of the line images is equal to or larger than the reference value and the width of the line image is equal to or smaller than the reference value.

When it is determined that the density of the line image is equal to or larger than the reference value and the width of the line image is equal to or smaller than the reference value, as indicated by Step S162, the determining unit 28 can determine that a landing position of the ink ejected from the ink nozzles that record the line image shifts from a desired position, an ejection state of the processing liquid nozzles corresponding to the ink nozzles is unknown, and landing positions of the processing liquid and the ink ejected from the processing liquid nozzle and the ink nozzles do not overlap.

On the other hand, when it is determined in Step S160 that the density of the line image is smaller than the reference value or the width of the line image exceeds the reference value, in Step S164, the determining unit 28 can determine that the ink nozzles that record the line image normally eject the ink and the processing liquid nozzle corresponding to the ink nozzles does not eject the processing liquid, and, therefore, a relation of landing positions of the ink and the processing liquid ejected from the ink nozzles and the processing liquid nozzle is unknown.

The reference value of density is the density of an image formed by depositing the ink on a recording medium on which the processing liquid is deposited. The reference value of line width is the line width of the image formed by depositing the ink on the recording medium on which the processing liquid is deposited. It is preferable to calculate and use density and width represented by a normal image, for example, the line image L(16-4) or the like illustrated in FIG. 22 among measurement result data of line images.

Fourth Embodiment

Next, a landing position determining method for a processing liquid nozzle according to a fourth embodiment of the present invention is described.

In the following description, differences from the second embodiment are mainly described. Description of components and processing same as those of the second embodiment is omitted for simple description.

In the fourth embodiment, the processing liquid deposited pattern is set such that, in each of the processing-liquid ejection nozzles selected not to be adjacent to one another, a linear non-ejection detection target area is formed in which a processing liquid deposited area, on which the processing liquid is continuously deposited at a predetermined number of dots, and a processing liquid non-deposited area, on which the processing liquid is not continuously deposited, continue and the processing liquid is continuously deposited in the remaining processing-liquid ejection nozzles not selected as a non-ejection detection target.

The reference image used in the third embodiment and shown in FIG. 23B is used as a reference image in this embodiment.

An overall flow of a landing position determining method for a processing liquid nozzle according to the fourth embodiment is the same as the flow according to the second embodiment.

A method of determining landing positions of the processing liquid ejected from the target processing liquid nozzles with the use of measurement result data and feature data in the fourth embodiment is described.

The measurement result data is used for determining landing positions of the processing liquid ejected from the target processing liquid nozzles. The measurement result data is data representing a result obtained by detecting data of line images (line data) from landing position determination data and measuring the density and the width of the detected line images. Therefore, the landing position determination data is first described.

The landing position determination data of the fourth embodiment is digital data representing an image formed by depositing, with the corresponding ink nozzle and the peripheral ink nozzles, the ink on a specific area of a recording medium C on which the processing liquid is deposited in a pattern shape.

A method of generating landing position determination data is not specifically limited. An example of the method is described with reference to FIGS. 27 and 28.

Figure 27:
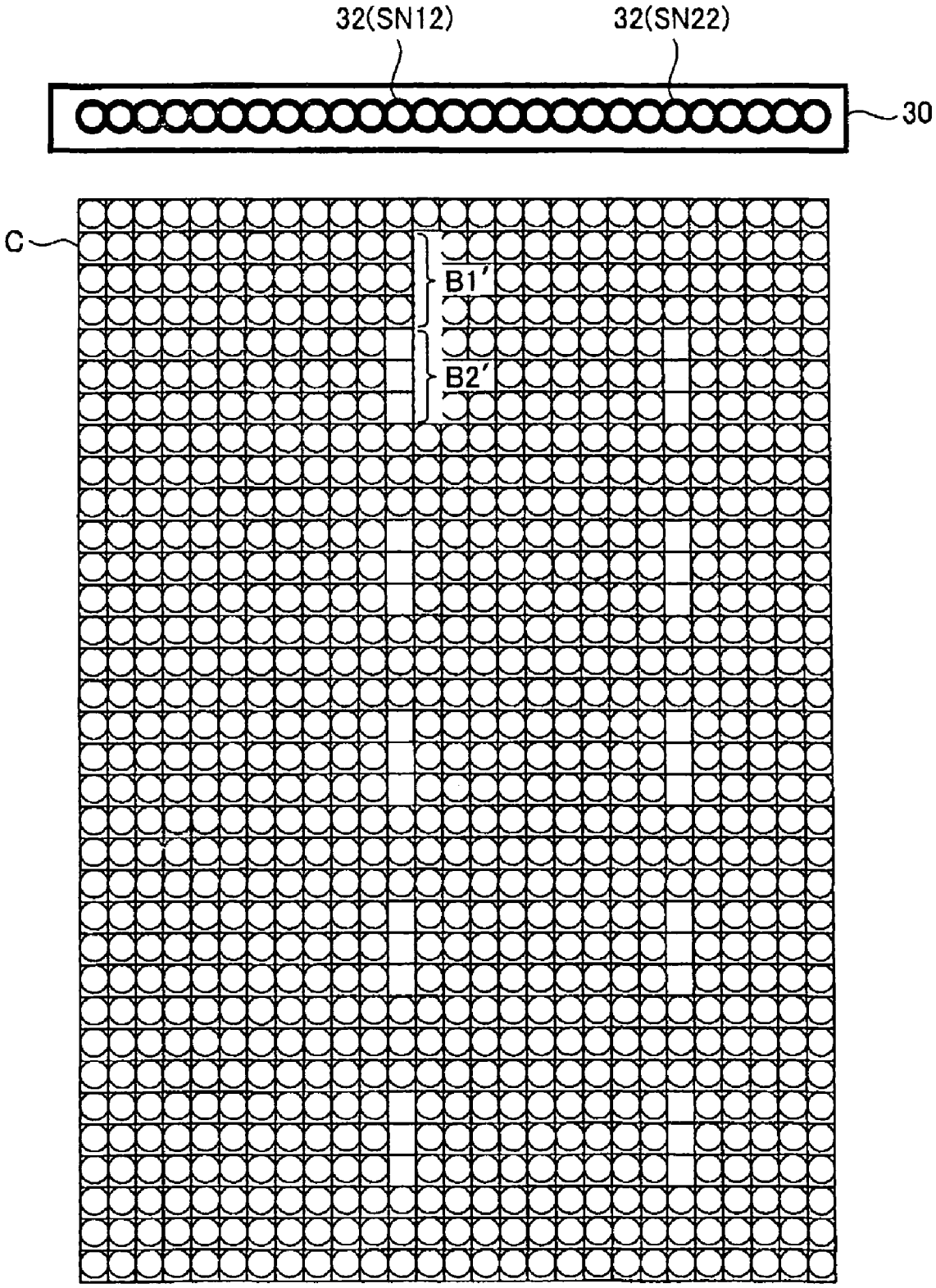
FIG. 27 is a schematic diagram of a recording medium on which a processing liquid deposited pattern is formed and a processing liquid head in a fourth embodiment of the present invention.

FIG. 27 is a schematic diagram of the recording medium C on which the processing liquid is deposited in a specific pattern shape excluding a predetermined area and a processing liquid head including twenty-seven processing liquid nozzles.

The recording medium C illustrated in FIG. 27 is a recording medium on which one kind of processing liquid deposited pattern including linear landing position determination targets on which the processing liquid deposited area and the processing liquid non-deposited area continue is repeatedly formed five times only in a processing liquid deposited line formed by the target processing liquid nozzle.

Figure 28:
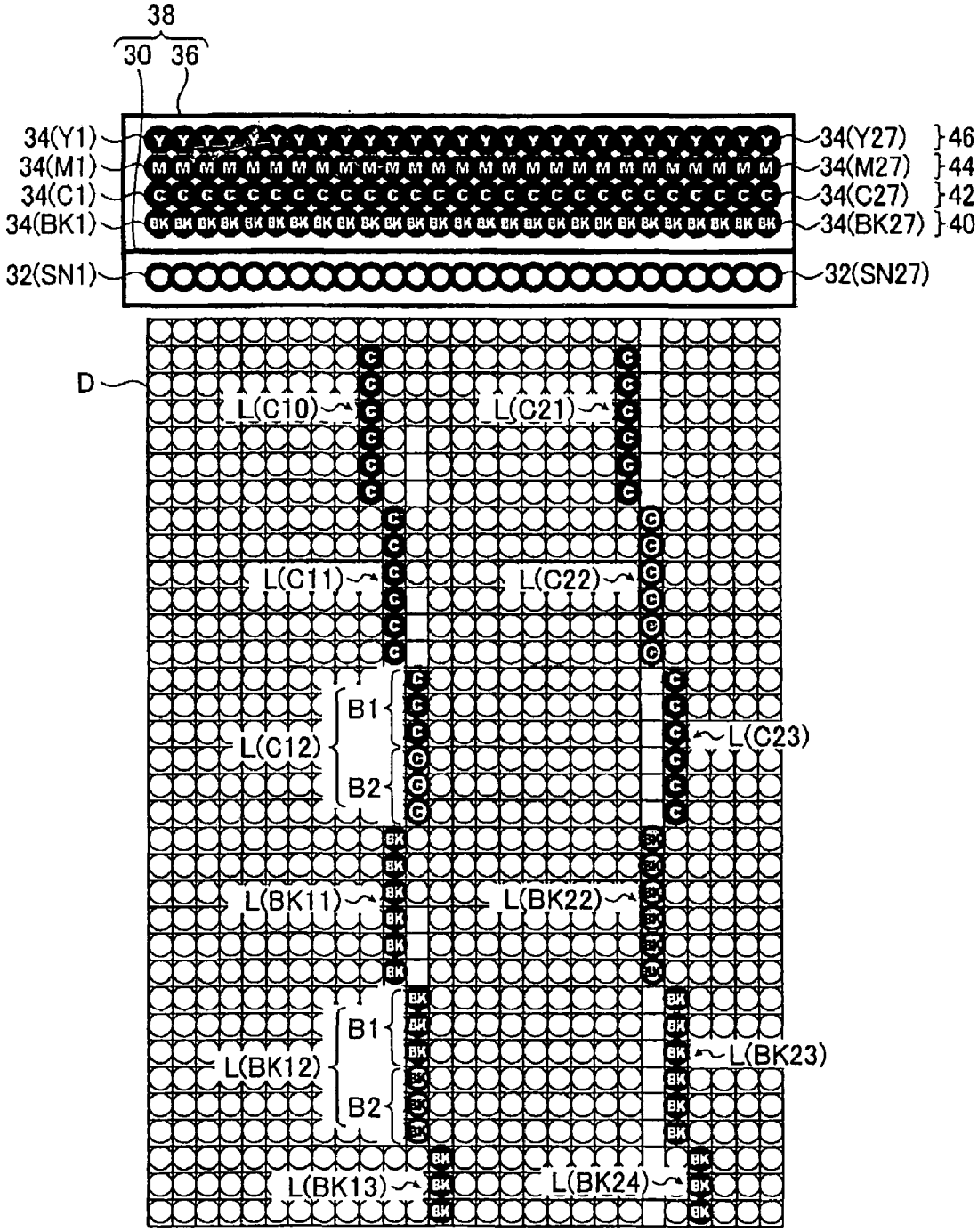
FIG. 28 is a schematic diagram of a recording medium on which a landing position determination pattern and an ejection head in the fourth embodiment.

FIG. 28 is a schematic diagram of a recording medium D including a processing liquid landing position determination pattern having a line image formed by depositing the ink with the plurality of corresponding nozzles corresponding to the target processing liquid nozzle and the ink nozzles located around the target processing liquid nozzle, and the ejection head 38.

The ejection head 38 includes the processing liquid head 30 and the ink head 36.

First, for example, the recording medium C including the processing liquid deposited pattern in which linear landing position detection target areas as illustrated in FIG. 27 are formed is generated by depositing, with the image recording unit 12, the processing liquid in the processing liquid nozzles of the processing liquid head.

The recording radium D including a processing liquid deposited pattern having a plurality of linear landing position detection target areas is formed by using the recording medium C and the processing liquid nozzles.

For example, as illustrated in FIG. 27, when the processing liquid nozzles 32 with the numbers SN12 and SN22 are set as target processing liquid nozzles, the processing liquid nozzles 32 with the numbers SN12 and SN22 are set so as not to eject the processing liquid only in fifth to seventh rows, eleventh to thirteenth rows, seventeenth to nineteenth rows, twenty-third to twenty-fifth rows, and nineteenth to twenty-first rows on the recording medium C. The other processing liquid nozzles are set to eject the processing liquid in all the rows (first to thirty-fourth rows). The processing liquid head 30 and the recording medium C are relatively moved to generate the recording medium C including the processing liquid non-deposited area.

Consequently, on the recording medium C illustrated in FIG. 27, a processing liquid deposited pattern is formed by repeating five times a processing liquid deposited pattern in which a linear landing position determination target area is formed in which a processing liquid deposited area (second to fourth rows) B1' and a processing liquid non-deposited area (fifth to seventh rows) B2' continue in second to seventh rows of the processing liquid deposited line formed by the processing liquid nozzles 32 with the numbers SN12 and SN22.

The ink is deposited on the recording medium C, on which the processing liquid deposited pattern is formed as illustrated in FIG. 27, by the plurality of corresponding ink nozzles 34 corresponding to the target processing liquid nozzles 32 with the numbers SN12 and SN22 and the peripheral ink nozzles 34 to form a line image. The recording medium D on which a processing liquid landing position detection pattern having the line image is formed is generated. In this case, the plurality of ink nozzles 34 corresponding to the target processing liquid nozzles 32 and the peripheral ink nozzles 34 deposit the ink only in a processing liquid deposited pattern portion in which the target processing liquid nozzles 32 form the linear landing position determination target area rather than depositing the ink in all the first to thirty-fourth rows.

As illustrated in FIG. 28, the ink head 36 has lines, in which the twenty-seven ink nozzles 34 are linearly arranged, in order of black (BK), cyan (C), magenta (M), and yellow (Y) from the bottom of FIG. 28.

Numbers of the ink nozzles 34 in a black line 40 are BK1, BK2, . . . , and BK27 from the left of FIG. 28. Numbers of the ink nozzles 34 in a cyan line 42 are C1, C2, . . . , and C27 from the left of FIG. 28. Numbers of the ink nozzles 34 in a magenta line 44 are M1, M2, . . . , and M27 from the left of FIG. 28. Numbers of the ink nozzles 34 in a yellow line 46 are Y1, Y2, . . . , and Y27 from the left of FIG. 28.

When such an ink head 36 is used, for example, if the target processing liquid nozzle 32 is the processing liquid nozzle 32 (SN12), the corresponding ink nozzles 34 are the ink nozzles 34 (C12 and BK12) and the peripheral ink nozzles 34 are, for example, the ink nozzles 34 (C10, C11, BK11, and BK13). If the target processing liquid nozzle 32 is the processing liquid nozzle 32 (SN22), the corresponding ink nozzles 34 are the ink nozzles 34 (C22 and BK22). The peripheral ink nozzles 34 are, for example, the ink nozzles 34 (C21, C23, BK23, and BK24).

The ink nozzles 34 (C10 and C21) deposit the ink only in the second to seventh rows. The ink nozzles 34 (C11 and C22) deposit the ink only in the eighth to thirteenth rows. The ink nozzles 34 (C12 and C23) deposit the ink only in the fourteenth to nineteenth rows. The ink nozzles 34 (BK11 and BK22) deposit the ink only in the twentieth to twenty-fifth rows. The ink nozzles 34 (BK12 and BK23) deposit the ink only in the twenty-sixth to thirty-first rows. The ink nozzles 34 (BK13 and BK24) deposit the ink only in the thirty-second to thirty-fourth rows. In this way, the ink nozzles 34 form line images on the cording medium C and generate the recording medium D having these line images.

A line image recorded by the ink nozzle 34 (C10) is represented as L(C10). A line image recorded by the ink nozzle 34 (C22) is represented as L(C22). Similarly, a line image recorded by the ink nozzle 34 (BK24) is represented as L(BK24).

Such a recording medium D is scanned by the image scanning device 14 and converted into digital data to generate landing position determination data.

In order to generate measurement result data, data of the line images (line data) is detected from the landing position determination data.

Image data representing line images L(C10) to L(C12), L(C21) to L(C23), L(BK11) to L(BK13), and L(BK22) to L(BK24) is detected from the landing position determination data representing the recording medium D illustrated in FIG. 28.

Among the line images L represented by the detected line image data, the line images L (C12 and BK12) have the normal image area B1 that has predetermined density and line width because the deposited processing liquid and the deposited ink overlap and the unprocessed image area B2 in which the predetermined density and line width are not obtained because the deposited processing liquid and the deposited ink do not overlap.

In general, as described above, the unprocessed image area B2 has low density and large width compared with the normal image area B1.

Among the line images represented by the detected line image data, the line images L (C22 and BK22) is recorded by depositing the ink on an area on which the processing liquid is not deposited at all. The line images L (C10, C11, BK11, BK13, C21, C23, BK23, and BK24) are recorded by depositing the ink on an area on which the processing liquid is deposited.

The predetermined density in this case is the density of a line image formed when landing positions of the processing liquid and the ink coincide with each other. On the other hand, the predetermined line width is the width of the line image formed when landing positions of the processing liquid and the ink coincide with each other.

After the data of the line images (line data) are detected, the density and the line width of the line images represented by the data are measured and a result of the measurement is recorded to generate measurement result data.

In measurement result data of a line image having the normal image area B1 and the unprocessed image area B2 such as the line images L (C12 and BK12), the predetermined density and the predetermined line width cannot be obtained from data of the unprocessed image area B2 because the processing liquid and the ink do not overlap. On the other hand, the predetermined density and the predetermined line width can be obtained from data of the normal image area B1 because the processing liquid and the ink overlap.

In other words, measurement result data of the line images L (C12 and BK12) have a changing point where density and line width change at a boundary between the normal image area B1 and the unprocessed image area B2.

In measurement result data of line images such as the line images L (C22 and BK22), the ink and the processing liquid do not overlap, and hence the density and the width of the line images do not change and predetermined values of the density and the width cannot be obtained.

In measurement result data of a line image such as the line images L (C10, C11, BK11, BK13, C21, C23, BK23, and BK24), the ink and the processing liquid overlap, and hence the density and the width of the line image do not change and predetermined values of the density and the width can be obtained.

The predetermined values representing the density and the width are the same as the reference values of the third embodiment.

Figure 29:
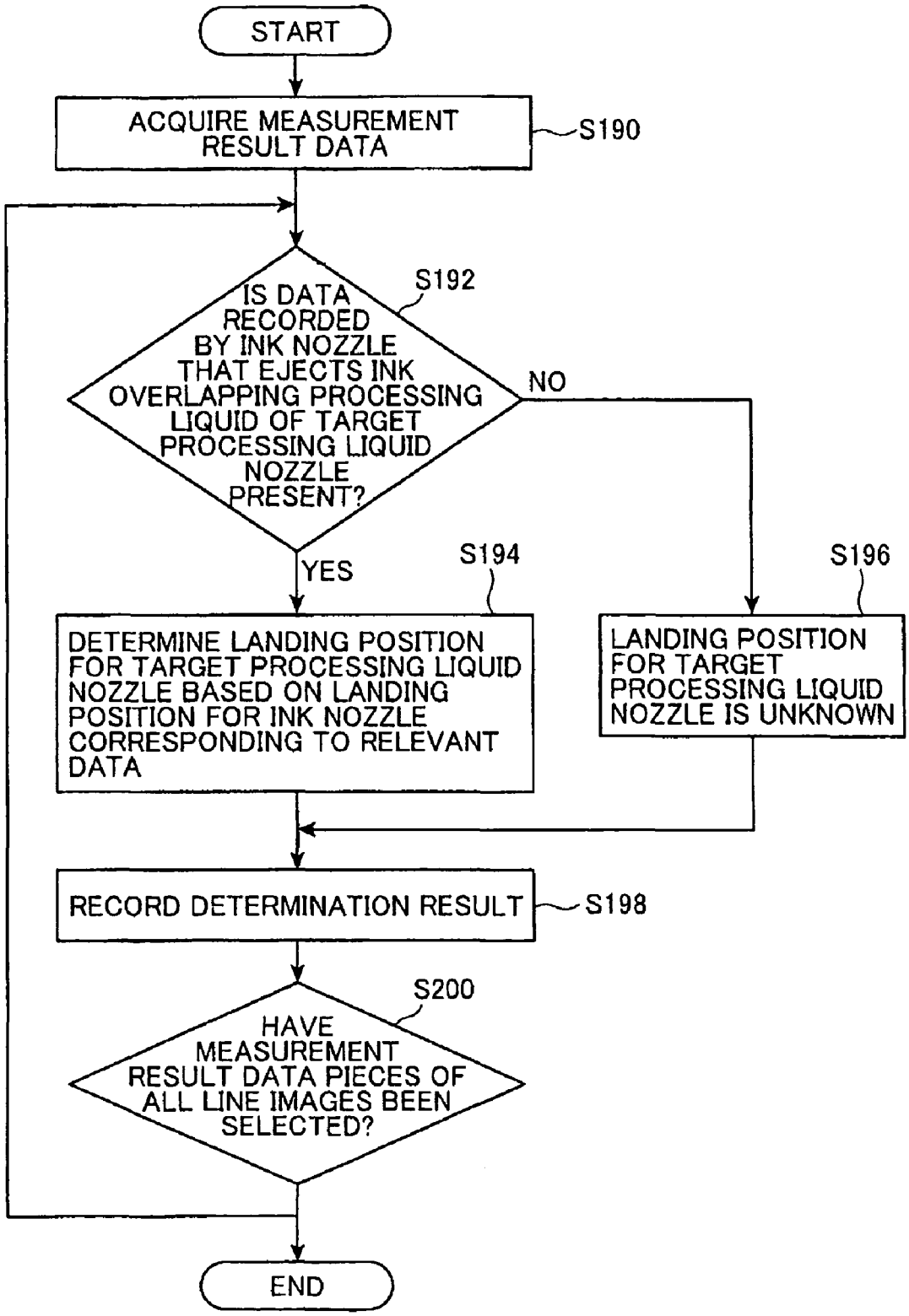
FIG. 29 is a flowchart of a method of determining a landing position of processing liquid ejected from one target processing liquid nozzle in the fourth embodiment.

A method of calculating a landing position of the processing liquid ejected from the target processing liquid nozzle is described in detail with reference to FIG. 29.

First, in Step S190, the determining unit 28 acquires measurement result data.

Subsequently, in Step S192, the determining unit 28 selects, out of the measurement result data, measurement result data of a line image recorded in association with the target processing liquid nozzle 32. The determining unit 28 determines whether measurement result data of a line image recorded by the ink nozzle that has ejected the ink overlapping the processing liquid ejected by the target processing liquid nozzle 32 is present in the selected measurement result data.

Specifically, the determining unit 28 only has to check whether measurement result data having a changing point of distribution of density and line width of the image is present in the selected measurement result data.

When it is determined in Step S192 that there is relevant data, in Step S194, the determining unit 28 determines, on the basis of a landing position of the ink ejected from an ink nozzle corresponding to the measurement result data of the relevant line image, a landing position of the processing liquid ejected from the target processing liquid nozzle on a dot of the processing liquid non-deposited area which is located at a boundary between the processing liquid deposited area and the processing liquid non-deposited area included in the linear landing position detection target area formed by the target processing liquid nozzle is located.

When measurement result data of a plurality of line images are acquired in Step S192, in Step S194, the determining unit 28 determines a landing position of the processing liquid ejected from the target processing liquid nozzle with the use of an average of landing positions of the ink ejected from the ink nozzles corresponding to the respective line images.

When a landing position of the processing liquid ejected from the target processing liquid nozzle is detected from line images printed by a plurality of corresponding ink nozzles, the determining unit 28 only has to calculate an average of the landing positions and set the average as a landing position of the processing liquid ejected from the target processing liquid nozzle.

When it is determined in Step S192 that there is no relevant data, in Step S196, the determining unit 28 determines that a landing position of the processing liquid ejected from the target processing liquid nozzle is unknown.

After any one of Steps S194 and S196 is finished, in Step S198, the determining unit 28 records a determination result in the determination result recording data.

Thereafter, in Step S200, the determining unit 28 determines whether measurement result data of all the line images are selected.

When measurement result data of line images that should be selected still remain, the determining unit 28 returns to Step S192 and repeats Steps S192 to S200. On the other hand, when it is determined in Step S200 that measurement result data of all the line images are selected, the determining unit 28 determines that a landing position of the processing liquid ejected from the target processing liquid nozzle can be calculated and finishes the calculation of a landing position of the processing liquid ejected from the target processing liquid nozzle.

Specifically, in the following description, measurement result data of the line images illustrated in FIG. 28 is used as the measurement result data.

For example, after acquiring the measurement result data in Step S190, the determining unit 28 selects measurement result data of line images recorded in association with the target processing liquid nozzle (SN12), i.e., measurement result data of the line images L (C10, C11, C12, BK11, BK12, and BK13). In Step S192, the determining unit 28 determines whether measurement result data of a line image having changing points of density and width of an image are present in the selected measurement result data.

Measurement result data of the line images L (C12 and BK12) having changing points of density and width of an image are present in the selected measurement result data. Therefore, in Step S194, the determining unit 28 calculates a landing position of the processing liquid ejected from the target processing liquid nozzle (SN12) with the use of landing positions (deposited positions) of the ink ejected from the ink nozzles (C12 and BK12) that record the line images L (C12 and BK12).

In Step S198, the determining unit 28 records a calculated result in the determination result recording data. In Step S200, when the determining unit 28 determines whether measurement result data of all the line images are selected, it is confirmed that measurement result data of line images not selected yet are present.

Therefore, the determining unit 28 selects, for example, measurement result data of line images recorded in association with the target processing liquid nozzle (SN22), i.e., measurement result data of the line images L (C21, C22, C23, BK22, BK23, and BK24). In Step S192, the determining unit 28 determines whether measurement result data of line images having changing points of density and width of an image are present in the selected measurement result data.

In this case, relevant measurement result data of line images are not present in the selected measurement result data. Therefore, in Step S196, the determining unit 28 determines that a landing position of the processing liquid ejected from the target processing liquid nozzle (SN22) is unknown.

In Step S198, the determining unit 28 records a determination result obtained in Step S196 in the determination result recording data. In Step S200, the determining unit 28 determines whether measurement result data of all the line images are selected.

As a result, there is no measurement result data of the line images not selected yet, and hence the determining unit 28 finishes the calculation of a landing position of the processing liquid ejected from the target processing liquid nozzle.

In this way, it is possible to determine a landing position of the processing liquid ejected from the target processing liquid nozzle.

In Step S194, in addition to the determination of a landing position of the processing liquid ejected from the target processing liquid nozzle, the determining unit 28 can also perform association of the target processing liquid nozzle, the corresponding ink nozzles, and the peripheral ink nozzles.

For example, when measurement result data of line images corresponding to the target processing liquid nozzle 32 (SN12) is selected and measurement result data of the line images L (C12 and BK12) having changing points of density and width of an image are present in the selected measurement result data, it is seen that landing positions of the processing liquid and the ink ejected from the target processing liquid nozzle 32 (SN12) and the ink nozzles 34 (C12 and BK12) coincide with each other. Therefore, it is possible to associate the target processing liquid nozzle 32 (SN12) and the ink nozzles 34 (C12 and BK12).

In Step S196, in addition to determining that a landing position of the processing liquid ejected from the target processing liquid nozzle is unknown, the determining unit 28 can determine whether data representing that the ink does not overlap the processing liquid of the target processing liquid nozzle is present in the measurement result data of the line images. When relevant data is present, the determining unit 28 can also determine that "the target processing liquid nozzle and the ink nozzles corresponding to the target processing liquid nozzle do not correspond to each other".

For example, when measurement result data of a line image corresponding to the target processing liquid nozzle 32 (SN22) is selected, all the selected measurement result data do not have changing points in density and width of an image. Therefore, the determining unit 28 can determine that the target nozzle 32 (SN22) and the ink nozzles (C22 and BK22) do not correspond to each other.

In Step S194, in addition to the determination of a landing position of the processing liquid ejected from the target processing liquid nozzle, the determining unit 28 can determine ejection states of the processing liquid nozzles and the corresponding ink nozzles or the peripheral ink nozzles and a positional relation of landing positions between the processing liquid nozzles and the corresponding ink nozzles or the peripheral ink nozzles.

For example, when measurement result data of a line image corresponding to the target processing liquid nozzle 32 (SN12) is selected, measurement result data of the line images L (C12 and BK12) having changing points of density and width of an image are present in the selected measurement result data. Therefore, the determining unit 28 can determine that the processing liquid of the target processing liquid nozzle 32 (SN12) and the ink of the ink nozzles 34 (C12 and BK12) overlap and that both the processing liquid nozzle 32 (SN12) and the ink nozzle (C12 and BK12) perform "normal ejection".

In Step S196, in addition to determining that a landing position of the processing liquid ejected from the target processing liquid nozzle is unknown, when measurement result data representing a line image having line width of the image equal to or smaller than a reference value and density of the image equal to or larger than a reference value among the measurement result data of the line images is confirmed, the determining unit 28 can determine that an ejection state of an ink nozzle that records the line image is "position shift", an ejection state of the target processing liquid nozzle is "unknown", and a positional relation in landing positions between the processing liquid nozzles and the ink nozzle is "unknown". On the other hand, when relevant measurement result data cannot be confirmed, the determining unit 28 can determine that the ejection state of the ink nozzle that records the line image is "normal ejection", an ejection state of the target ink nozzle is "no ejection", and a positional relation in landing positions between the ink nozzle and the target processing liquid nozzle is "unknown".

The reference value of density is the density of a line image in which the processing liquid and the ink overlap. The reference value of line width is the line width of a line image in which the processing liquid and the ink overlap.

For example, when measurement result data of a line image corresponding to the target processing liquid nozzle 32 (SN22) is selected, in the line images L (C21, C23, BK23, and BK24) of the selected measurement result data, the width of the line images is smaller than the reference value and the density of the line images exceeds the reference value. Therefore, the determining unit 28 can determine that an ejection state of the ink nozzles (C21, C23, BK23, and BK24) is "position shift", an ejection state of the target processing liquid nozzle (SN22) is "unknown", and a positional relation in landing positions between the processing liquid nozzle 32 (SN22) and the ink nozzles 34 (C21, C23, BK23, and BK24) is "unknown".

On the other hand, the line images L (C22 and BK22) of the selected measurement result data do not have predetermined values of the density and the width, and hence the determining unit 28 can determine that an ejection state of the ink nozzles 34 (C22 and BK22) is "normal ejection", an ejection state of the target ink nozzle 32 (SN22) is "no ejection", and a positional relation in landing positions between the ink nozzles 34 (C22 and BK22) and the processing liquid nozzle 32 (SN22) is "unknown".

In the first to fourth embodiments, the feature data and the landing position determination data are acquired from the image scanning device 14. However, the present invention is not limited thereto. For example, when the feature data and the landing position determination data are stored in a server or the like, the feature data and the landing position determination data may be acquired from the server.

The landing position determining method and the landing position determining device for processing liquid nozzles are described above. However, the present invention is not limited to the embodiments. It goes without saying that various improvement and modifications may be made without departing from the spirit of the present invention.

What is claimed is:

1. A landing position determining method for processing-liquid ejection nozzles used in an inkjet recording method of depositing transparent processing liquid and colored ink from the processing-liquid ejection nozzles and ink nozzles, respectively, one on top of another to form an image and fixing and recording the colored ink, the landing position determining method comprising:

setting a processing liquid deposited pattern so that, by one processing-liquid ejection nozzle and a plurality of processing-liquid ejection nozzles located on both sides of the one processing-liquid ejection nozzle selected as landing position determination targets of the deposited processing liquid, a plurality of linear landing position determination target areas are formed in which the processing liquid is continuously deposited for a predetermined number of dots while gradually changing density of the processing liquid to be deposited to one of increase and decrease in one direction and a number of dots with one of high and low density of the processing liquid decreases farther away from centered linear landing position determination target area of the plurality of linear landing position determination target areas, and, by remaining processing-liquid ejection nozzles, the processing liquid is continuously deposited while the density of the processing liquid is changed in a direction opposite to a direction of the plurality of linear landing position determination target areas;

ejecting the processing liquid from the processing-liquid ejection nozzles onto a recording medium to form the processing liquid deposited pattern on the recording medium according to the set processing liquid deposited pattern;

depositing the colored ink from a plurality of ink nozzles, which include an ink nozzle corresponding to the selected processing-liquid ejection nozzle, and are selected, from ink nozzles on both sides of the ink nozzle, with a predetermined nozzle interval, onto the processing liquid deposited pattern, and recording a plurality of linear colored ink images to form a processing liquid landing position determination pattern on the recording medium;

scanning the processing liquid landing position determination pattern formed on the recording medium with a detection sensor;

detecting the plurality of linear colored ink images in the processing liquid landing position determination pattern scanned by the detection sensor;

measuring at least one of densities and line widths of the detected plurality of linear colored ink images; and detecting presence/absence of a change in the at least one of the measured densities and line widths of the plurality of linear colored ink images, and determining, from at least one of density distribution and line width distribution in a linear colored ink image in which the change is present, a landing position of the processing liquid ejected from the processing-liquid ejection nozzle selected as the landing position determination targets.

2. The landing position determining method according to claim 1, wherein the density of the processing liquid is controlled by controlling at least one of a liquid quantity of the processing liquid deposited from the processing-liquid ejection nozzle onto one processing liquid dot, a size of the one processing liquid dot, the density of the processing liquid forming the one processing liquid dot, and an ejection ratio of the processing liquid onto the one processing liquid dot.

3. The landing position determining method according to claim 1, further comprising, when linear colored ink images in which the change in the at least one of the density and the line width is not present are detected, detecting, as a non-ejecting processing-liquid ejection nozzle, a processing-liquid ejection nozzle corresponding to the ink nozzle that records linear colored ink images having an invariable density and an invariable line width.

4. The landing position determining method according to claim 1, further comprising, in the detecting the plurality of linear colored ink images in the processing liquid landing position determination pattern scanned by the detection sensor, when the plurality of linear colored ink images corresponding to the plurality of linear landing position determination target areas are not formed, detecting ink nozzles corresponding to the plurality of linear landing position determination target areas as non-ejecting ink nozzles.

5. The landing position determining method according to claim 1, wherein a plurality of the processing liquid deposited patterns are set and the set plurality of the processing liquid deposited patterns are continuously combined so that all the processing-liquid ejection nozzles are selected as the landing position determination targets.

6. The landing position determining method according to claim 5, further comprising, when there are at least two linear colored ink images in which the at least one of the density distribution and the line width distribution is present:

selecting two linear colored ink images of different combinations;

calculating, for each of a plurality of the combinations, the landing positions of the processing liquid deposited from the processing-liquid ejection nozzles;

calculating an average of the landing positions calculated for the plurality of the combinations; and determining the calculated average as the landing position of the processing liquid deposited from the processing-liquid ejection nozzles selected as the landing position determination targets.

7. The landing position determining method according to claim 1, wherein the determining of the landing position of the processing liquid ejected from the processing-liquid ejection nozzles comprises:

calculating a length of each of the plurality of linear colored ink images, and obtaining, from the at least one of the density distribution and the line width distribution of the each of the plurality of linear colored ink images, feature points of the plurality of linear colored ink images;

selecting two linear colored ink images out of linear colored ink images in which the feature points are present;

calculating, for each of the selected two linear colored ink images, a length from one end to the feature point of the image, and calculating a distance between the selected two linear colored ink images; and calculating the landing position of the processing liquid deposited from the processing-liquid ejection nozzles selected as the landing position determination targets using the calculated lengths to the two feature points, the calculated distance, and the landing position of the colored ink determined in advance in association with each of the ink nozzles that have printed the selected two linear colored ink images.

8. The landing position determining method according to claim 7, wherein:

the feature point is obtained by calculating, from the at least one of the density distribution and the line width distribution of the each of the plurality of linear colored ink images, a maximum value and a minimum value of the at least one of the density distribution and the line width distribution, standardizing each of the calculated maximum value and minimum value to a predetermined reference value, and calculating a position on a linear colored ink image at which a standardized density is a predetermined value; and the length to the feature point is calculated as a distance between the calculated position and one of a position at which the standardized density is largest and a position at which the standardized density is smallest.

9. A landing position determining device for processing-liquid ejection nozzles used in an inkjet recording apparatus that deposits transparent processing liquid and colored ink from the processing-liquid ejection nozzles and ink nozzles of an inkjet head, respectively, onto a recording medium one on top of another to form an image and fixes and records the colored ink, the landing position determining device comprising:

a nozzle setting unit that selects, as landing position determination targets of the deposited processing liquid, one processing-liquid ejection nozzle and a plurality of processing-liquid ejection nozzles located on both sides of the one processing-liquid ejection nozzle;

a processing liquid deposited pattern setting unit that sets a processing liquid deposited pattern so that the processing-liquid ejection nozzles selected as the landing position determination targets form a plurality of linear landing position determination target areas in which the processing liquid is continuously deposited for a predetermined number of dots while gradually changing density of the processing liquid to be deposited to one of increase and decrease in one direction and a number of dots with one of high and low density of the processing liquid decreases farther away from centered linear landing position determination target area of the plurality of linear landing position determination target areas, and remaining processing-liquid ejection nozzles not selected as the landing position determination targets continuously deposit the processing liquid while the density of the processing liquid is changed in a direction opposite to a direction of the plurality of linear landing position determination target areas;

an ejection control unit that performs ejection control for the processing-liquid ejection nozzles to eject the processing liquid from the processing-liquid ejection nozzles onto the recording medium to form the processing liquid deposited pattern on the recording medium according to the set processing liquid deposited pattern, and performs ejection control for a plurality of ink nozzles, which include an ink nozzle corresponding to the selected processing-liquid ejection nozzle, and are selected, from ink nozzles on both sides of the ink nozzle, with a nozzle interval, to deposit the colored ink from the plurality of ink nozzles onto the processing liquid deposited pattern formed on the recording medium, and record a plurality of linear colored ink images on the recording medium to form a processing liquid landing position determination pattern on the recording medium;

a data acquiring unit that scans the processing liquid landing position determination pattern formed on the recording medium with a detection sensor, and acquires image data of the plurality of linear colored ink images in the scanned processing liquid landing position determination pattern;

a measuring unit that measures at least one of densities and line widths of the plurality of linear colored ink images; and a determining unit that detects presence/absence of a change in the at least one of the densities and the line widths of the plurality of linear colored ink images measured by the measuring unit, and determines, from at least one of density distribution and line width distribution in a linear colored ink image in which the change is present, a landing position of the processing liquid ejected from the processing-liquid ejection nozzles selected as the landing position determination targets.

10. The landing position determining device for processing-liquid ejection nozzles according to claim 9, wherein, when there are at least two linear colored ink images in which the at least one of the density distribution and the line width distribution is present, the determining unit:

selects two linear colored ink images of different combinations;

calculates, for each of a plurality of the combinations, the landing positions of the processing liquid deposited from the processing-liquid ejection nozzles;

calculates an average of the landing positions calculated for the plurality of the combinations; and determines the calculated average as the landing position of the processing liquid deposited from the processing-liquid ejection nozzles selected as the landing position determination targets.

11. The landing position determining device for processing-liquid ejection nozzles according to claim 9, wherein the determining unit:

calculates a length of each of the plurality of linear colored ink images, and obtains, from the at least one of the density distribution and the line width distribution of the each of the plurality of linear colored ink images, feature points of the plurality of linear colored ink images;

selects two linear colored ink images out of linear colored ink images in which the feature points are present except linear colored ink images in which the feature points are not present;

calculates, for each of the selected two linear colored ink images, a length from one end to the feature point of the image, and calculates a distance between the selected two linear colored ink images; and calculates the landing position of the processing liquid deposited from the processing-liquid ejection nozzles selected as the landing position determination targets using the calculated lengths to the two feature points, the calculated distance, and the landing position of the colored ink determined in advance in association with each of the ink nozzles that have printed the selected two linear colored ink images.

12. The landing position determining device for processing-liquid ejection nozzles according to claim 11, wherein the determining unit:

calculates, as the feature point, from the at least one of the density distribution and the line width distribution of the each of the plurality of linear colored ink images, a maximum value and a minimum value of the at least one of the density distribution and the line width distribution, standardizes each of the calculated maximum value and minimum value to a predetermined reference value, and calculates a position on a linear colored ink image at which a standardized density is a predetermined value; and calculates the length to the feature point as a distance between the calculated position and one of a position at which the standardized density is largest and a position at which the standardized density is smallest.

13. An inkjet recording apparatus, comprising:

an inkjet head comprising processing-liquid ejection nozzles and ink nozzles that deposit transparent processing liquid and colored ink onto a recording medium, respectively, one on top of another to form an image;

fixing means for fixing the colored ink deposited on the recording medium to form the image;

moving means for relatively moving the recording medium and the inkjet head; and the landing position determining device for processing-liquid ejection nozzles according to claim 9.

* * * * *